US006292159B1

(12) United States Patent
Someya et al.

(10) Patent No.: US 6,292,159 B1
(45) **Date of Patent: *Sep. 18, 2001**

(54) METHOD FOR DRIVING PLASMA DISPLAY PANEL

(75) Inventors: Jun Someya; Yoshiki Ono; Yoshiaki Okuno; Takashi Hashimoto, all of Tokyo (JP)

(73) Assignee: Mitsubishi Denki Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/070,734

(22) Filed: May 1, 1998

(30) Foreign Application Priority Data

May 8, 1997 (JP) ..... 9-118115

(51) Int. Cl.[7] ..... G09G 3/28
(52) U.S. Cl. ..... 345/60; 345/63; 345/148
(58) Field of Search ..... 345/60, 63, 66, 345/67, 68, 71, 72, 147, 148, 204, 208, 209, 210; 315/169.4, 169.3

(56) References Cited

U.S. PATENT DOCUMENTS

| | | | | |
|---|---|---|---|---|
| 5,420,602 | * | 5/1995 | Kanazawa | 345/67 |
| 5,436,634 | * | 7/1995 | Kanazawa | 345/67 |
| 5,724,053 | * | 3/1998 | Nagakubo | 345/213 |
| 5,790,095 | * | 8/1998 | Onodera et al. | 345/147 |
| 5,835,072 | * | 11/1998 | Kanazawa | 345/60 |
| 5,841,413 | * | 11/1998 | Zhu et al. | 345/63 |
| 5,936,355 | * | 8/1999 | Kim | 345/60 |

FOREIGN PATENT DOCUMENTS

| | | |
|---|---|---|
| 4-211294 | 8/1992 | (JP) . |
| 7-49663 | 2/1995 | (JP) . |

* cited by examiner

*Primary Examiner*—Xiao Wu

(57) ABSTRACT

With a plasma display panel, an object of the present invention is to suppress luminance in black display without deteriorating picture quality and to suppress pseudo contouring of moving picture, while suppressing cost of the plasma display panel. According to a plasma display panel driving method of the present invention, a plurality of discharge sustain periods for displaying equal luminance level are successively defined in a given period in one field to reduce the amount of shift of the center of luminance, and address periods for selecting arbitrary display cells on the screen are comprised of two kinds of address periods: a write address period and an erase address period.

23 Claims, 46 Drawing Sheets

FIG.22

| RELATIVE LUMINANCE | SF1 | SF2 | SF3 | SF4 | SF5 | SF6 | SF7A | SF7B | SF7C | SF7D |
|---|---|---|---|---|---|---|---|---|---|---|
| 0 | | | | | | | | | | |
| 1 | ■ | | | | | | | | | |
| 2 | | ■ | | | | | | | | |
| 3 | ■ | ■ | | | | | | | | |
| 4 | | | ■ | | | | | | | |
| 5 | ■ | | ■ | | | | | | | |
| 6 | | ■ | ■ | | | | | | | |
| 7 | ■ | ■ | ■ | | | | | | | |
| 8 | | | | ■ | | | | | | |
| 9 | ■ | | | ■ | | | | | | |
| 10 | | ■ | | ■ | | | | | | |
| 11 | ■ | ■ | | ■ | | | | | | |
| 12 | | | ■ | ■ | | | | | | |
| 13 | ■ | | ■ | ■ | | | | | | |
| 14 | | ■ | ■ | ■ | | | | | | |
| 15 | ■ | ■ | ■ | ■ | | | | | | |
| 16 | | | | | ■ | | | | | |
| 17 | ■ | | | | ■ | | | | | |
| 18 | | ■ | | | ■ | | | | | |
| 19 | ■ | ■ | | | ■ | | | | | |
| 20 | | | ■ | | ■ | | | | | |
| 21 | ■ | | ■ | | ■ | | | | | |
| 22 | | ■ | ■ | | ■ | | | | | |
| 23 | ■ | ■ | ■ | | ■ | | | | | |
| 24 | | | | ■ | ■ | | | | | |
| 25 | ■ | | | ■ | ■ | | | | | |
| 26 | | ■ | | ■ | ■ | | | | | |
| 27 | ■ | ■ | | ■ | ■ | | | | | |
| 28 | | | ■ | ■ | ■ | | | | | |
| 29 | ■ | | ■ | ■ | ■ | | | | | |
| 30 | | ■ | ■ | ■ | ■ | | | | | |
| 31 | ■ | ■ | ■ | ■ | ■ | | | | | |
| 32 | | | | | | ■ | | | | |
| 33 | ■ | | | | | ■ | | | | |
| 34 | | ■ | | | | ■ | | | | |
| 35 | ■ | ■ | | | | ■ | | | | |
| 36 | | | ■ | | | ■ | | | | |
| 37 | ■ | | ■ | | | ■ | | | | |
| 38 | | ■ | ■ | | | ■ | | | | |
| 39 | ■ | ■ | ■ | | | ■ | | | | |
| 40 | | | | ■ | | ■ | | | | |
| 41 | ■ | | | ■ | | ■ | | | | |
| 42 | | ■ | | ■ | | ■ | | | | |
| 43 | ■ | ■ | | ■ | | ■ | | | | |
| 44 | | | ■ | ■ | | ■ | | | | |
| 45 | ■ | | ■ | ■ | | ■ | | | | |
| 46 | | ■ | ■ | ■ | | ■ | | | | |
| 47 | ■ | ■ | ■ | ■ | | ■ | | | | |
| 48 | | | | | ■ | ■ | | | | |
| 49 | ■ | | | | ■ | ■ | | | | |
| 50 | | ■ | | | ■ | ■ | | | | |
| 51 | ■ | ■ | | | ■ | ■ | | | | |
| 52 | | | ■ | | ■ | ■ | | | | |
| 53 | ■ | | ■ | | ■ | ■ | | | | |
| 54 | | ■ | ■ | | ■ | ■ | | | | |
| 55 | ■ | ■ | ■ | | ■ | ■ | | | | |
| 56 | | | | ■ | ■ | ■ | | | | |
| 57 | ■ | | | ■ | ■ | ■ | | | | |
| 58 | | ■ | | ■ | ■ | ■ | | | | |
| 59 | ■ | ■ | | ■ | ■ | ■ | | | | |
| 60 | | | ■ | ■ | ■ | ■ | | | | |
| 61 | ■ | | ■ | ■ | ■ | ■ | | | | |
| 62 | | ■ | ■ | ■ | ■ | ■ | | | | |
| 63 | ■ | ■ | ■ | ■ | ■ | ■ | | | | |

| RELATIVE LUMINANCE | SF1 | SF2 | SF3 | SF4 | SF5 | SF6 | SF7A | SF7B | SF7C | SF7D |
|---|---|---|---|---|---|---|---|---|---|---|
| 64 | | | | | ■ | | ■ | | | |
| 65 | ■ | | | | ■ | | ■ | | | |
| 66 | | ■ | | | ■ | | ■ | | | |
| 67 | ■ | ■ | | | ■ | | ■ | | | |
| 68 | | | ■ | | ■ | | ■ | | | |
| 69 | ■ | | ■ | | ■ | | ■ | | | |
| 70 | | ■ | ■ | | ■ | | ■ | | | |
| 71 | ■ | ■ | ■ | | ■ | | ■ | | | |
| 72 | | | | ■ | ■ | | ■ | | | |
| 73 | ■ | | | ■ | ■ | | ■ | | | |
| 74 | | ■ | | ■ | ■ | | ■ | | | |
| 75 | ■ | ■ | | ■ | ■ | | ■ | | | |
| 76 | | | ■ | ■ | ■ | | ■ | | | |
| 77 | ■ | | ■ | ■ | ■ | | ■ | | | |
| 78 | | ■ | ■ | ■ | ■ | | ■ | | | |
| 79 | ■ | ■ | ■ | ■ | ■ | | ■ | | | |
| 80 | | | | | | ■ | ■ | | | |
| 81 | ■ | | | | | ■ | ■ | | | |
| 82 | | ■ | | | | ■ | ■ | | | |
| 83 | ■ | ■ | | | | ■ | ■ | | | |
| 84 | | | ■ | | | ■ | ■ | | | |
| 85 | ■ | | ■ | | | ■ | ■ | | | |
| 86 | | ■ | ■ | | | ■ | ■ | | | |
| 87 | ■ | ■ | ■ | | | ■ | ■ | | | |
| 88 | | | | ■ | | ■ | ■ | | | |
| 89 | ■ | | | ■ | | ■ | ■ | | | |
| 90 | | ■ | | ■ | | ■ | ■ | | | |
| 91 | ■ | ■ | | ■ | | ■ | ■ | | | |
| 92 | | | ■ | ■ | | ■ | ■ | | | |
| 93 | ■ | | ■ | ■ | | ■ | ■ | | | |
| 94 | | ■ | ■ | ■ | | ■ | ■ | | | |
| 95 | ■ | ■ | ■ | ■ | | ■ | ■ | | | |
| 96 | | | | | ■ | ■ | ■ | | | |
| 97 | ■ | | | | ■ | ■ | ■ | | | |
| 98 | | ■ | | | ■ | ■ | ■ | | | |
| 99 | ■ | ■ | | | ■ | ■ | ■ | | | |
| 100 | | | ■ | | ■ | ■ | ■ | | | |
| 101 | ■ | | ■ | | ■ | ■ | ■ | | | |
| 102 | | ■ | ■ | | ■ | ■ | ■ | | | |
| 103 | ■ | ■ | ■ | | ■ | ■ | ■ | | | |
| 104 | | | | ■ | ■ | ■ | ■ | | | |
| 105 | ■ | | | ■ | ■ | ■ | ■ | | | |
| 106 | | ■ | | ■ | ■ | ■ | ■ | | | |
| 107 | ■ | ■ | | ■ | ■ | ■ | ■ | | | |
| 108 | | | ■ | ■ | ■ | ■ | ■ | | | |
| 109 | ■ | | ■ | ■ | ■ | ■ | ■ | | | |
| 110 | | ■ | ■ | ■ | ■ | ■ | ■ | | | |
| 111 | ■ | ■ | ■ | ■ | ■ | ■ | ■ | | | |
| 112 | | | | | ■ | | ■ | ■ | | |
| 113 | ■ | | | | ■ | | ■ | ■ | | |
| 114 | | ■ | | | ■ | | ■ | ■ | | |
| 115 | ■ | ■ | | | ■ | | ■ | ■ | | |
| 116 | | | ■ | | ■ | | ■ | ■ | | |
| 117 | ■ | | ■ | | ■ | | ■ | ■ | | |
| 118 | | ■ | ■ | | ■ | | ■ | ■ | | |
| 119 | ■ | ■ | ■ | | ■ | | ■ | ■ | | |
| 120 | | | | ■ | ■ | | ■ | ■ | | |
| 121 | ■ | | | ■ | ■ | | ■ | ■ | | |
| 122 | | ■ | | ■ | ■ | | ■ | ■ | | |
| 123 | ■ | ■ | | ■ | ■ | | ■ | ■ | | |
| 124 | | | ■ | ■ | ■ | | ■ | ■ | | |
| 125 | ■ | | ■ | ■ | ■ | | ■ | ■ | | |
| 126 | | ■ | ■ | ■ | ■ | | ■ | ■ | | |
| 127 | ■ | ■ | ■ | ■ | ■ | | ■ | ■ | | |

FIG.24

| RELATIVE LUMINANCE | SF1 | SF2 | SF3 | SF4 | SF5 | SF6 | SF7A | SF7B | SF7C | SF7D |
|---|---|---|---|---|---|---|---|---|---|---|
| 0 | | | | | | | | | | |
| 1 | ■ | | | | | | | | | |
| 2 | | ■ | | | | | | | | |
| 3 | ■ | ■ | | | | | | | | |
| 4 | | | ■ | | | | | | | |
| 5 | ■ | | ■ | | | | | | | |
| 6 | | ■ | ■ | | | | | | | |
| 7 | ■ | ■ | ■ | | | | | | | |
| 8 | | | | ■ | | | | | | |
| 9 | ■ | | | ■ | | | | | | |
| 10 | | ■ | | ■ | | | | | | |
| 11 | ■ | ■ | | ■ | | | | | | |
| 12 | | | ■ | ■ | | | | | | |
| 13 | ■ | | ■ | ■ | | | | | | |
| 14 | | ■ | ■ | ■ | | | | | | |
| 15 | ■ | ■ | ■ | ■ | | | | | | |
| 16 | | | | | ■ | | | | | |
| 17 | ■ | | | | ■ | | | | | |
| 18 | | ■ | | | ■ | | | | | |
| 19 | ■ | ■ | | | ■ | | | | | |
| 20 | | | ■ | | ■ | | | | | |
| 21 | ■ | | ■ | | ■ | | | | | |
| 22 | | ■ | ■ | | ■ | | | | | |
| 23 | ■ | ■ | ■ | | ■ | | | | | |
| 24 | | | | ■ | ■ | | | | | |
| 25 | ■ | | | ■ | ■ | | | | | |
| 26 | | ■ | | ■ | ■ | | | | | |
| 27 | ■ | ■ | | ■ | ■ | | | | | |
| 28 | | | ■ | ■ | ■ | | | | | |
| 29 | ■ | | ■ | ■ | ■ | | | | | |
| 30 | | ■ | ■ | ■ | ■ | | | | | |
| 31 | ■ | ■ | ■ | ■ | ■ | | | | | |
| 32 | | | | | | ■ | | | | |
| 33 | ■ | | | | | ■ | | | | |
| 34 | | ■ | | | | ■ | | | | |
| 35 | ■ | ■ | | | | ■ | | | | |
| 36 | | | ■ | | | ■ | | | | |
| 37 | ■ | | ■ | | | ■ | | | | |
| 38 | | ■ | ■ | | | ■ | | | | |
| 39 | ■ | ■ | ■ | | | ■ | | | | |
| 40 | | | | ■ | | ■ | | | | |
| 41 | ■ | | | ■ | | ■ | | | | |
| 42 | | ■ | | ■ | | ■ | | | | |
| 43 | ■ | ■ | | ■ | | ■ | | | | |
| 44 | | | ■ | ■ | | ■ | | | | |
| 45 | ■ | | ■ | ■ | | ■ | | | | |
| 46 | | ■ | ■ | ■ | | ■ | | | | |
| 47 | ■ | ■ | ■ | ■ | | ■ | | | | |
| 48 | | | | | | | ■ | | | |
| 49 | ■ | | | | | | ■ | | | |
| 50 | | ■ | | | | | ■ | | | |
| 51 | ■ | ■ | | | | | ■ | | | |
| 52 | | | ■ | | | | ■ | | | |
| 53 | ■ | | ■ | | | | ■ | | | |
| 54 | | ■ | ■ | | | | ■ | | | |
| 55 | ■ | ■ | ■ | | | | ■ | | | |
| 56 | | | | ■ | | | ■ | | | |
| 57 | ■ | | | ■ | | | ■ | | | |
| 58 | | ■ | | ■ | | | ■ | | | |
| 59 | ■ | ■ | | ■ | | | ■ | | | |
| 60 | | | ■ | ■ | | | ■ | | | |
| 61 | ■ | | ■ | ■ | | | ■ | | | |
| 62 | | ■ | ■ | ■ | | | ■ | | | |
| 63 | ■ | ■ | ■ | ■ | | | ■ | | | |

| RELATIVE LUMINANCE | SF1 | SF2 | SF3 | SF4 | SF5 | SF6 | SF7A | SF7B | SF7C | SF7D |
|---|---|---|---|---|---|---|---|---|---|---|
| 64 | | | | | ■ | | ■ | | | |
| 65 | ■ | | | | ■ | | ■ | | | |
| 66 | | ■ | | | ■ | | ■ | | | |
| 67 | ■ | ■ | | | ■ | | ■ | | | |
| 68 | | | ■ | | ■ | | ■ | | | |
| 69 | ■ | | ■ | | ■ | | ■ | | | |
| 70 | | ■ | ■ | | ■ | | ■ | | | |
| 71 | ■ | ■ | ■ | | ■ | | ■ | | | |
| 72 | | | | ■ | ■ | | ■ | | | |
| 73 | ■ | | | ■ | ■ | | ■ | | | |
| 74 | | ■ | | ■ | ■ | | ■ | | | |
| 75 | ■ | ■ | | ■ | ■ | | ■ | | | |
| 76 | | | ■ | ■ | ■ | | ■ | | | |
| 77 | ■ | | ■ | ■ | ■ | | ■ | | | |
| 78 | | ■ | ■ | ■ | ■ | | ■ | | | |
| 79 | ■ | ■ | ■ | ■ | ■ | | ■ | | | |
| 80 | | | | | | ■ | ■ | | | |
| 81 | ■ | | | | | ■ | ■ | | | |
| 82 | | ■ | | | | ■ | ■ | | | |
| 83 | ■ | ■ | | | | ■ | ■ | | | |
| 84 | | | ■ | | | ■ | ■ | | | |
| 85 | ■ | | ■ | | | ■ | ■ | | | |
| 86 | | ■ | ■ | | | ■ | ■ | | | |
| 87 | ■ | ■ | ■ | | | ■ | ■ | | | |
| 88 | | | | ■ | | ■ | ■ | | | |
| 89 | ■ | | | ■ | | ■ | ■ | | | |
| 90 | | ■ | | ■ | | ■ | ■ | | | |
| 91 | ■ | ■ | | ■ | | ■ | ■ | | | |
| 92 | | | ■ | ■ | | ■ | ■ | | | |
| 93 | ■ | | ■ | ■ | | ■ | ■ | | | |
| 94 | | ■ | ■ | ■ | | ■ | ■ | | | |
| 95 | ■ | ■ | ■ | ■ | | ■ | ■ | | | |
| 96 | | | | | | | ■ | ■ | | |
| 97 | ■ | | | | | | ■ | ■ | | |
| 98 | | ■ | | | | | ■ | ■ | | |
| 99 | ■ | ■ | | | | | ■ | ■ | | |
| 100 | | | ■ | | | | ■ | ■ | | |
| 101 | ■ | | ■ | | | | ■ | ■ | | |
| 102 | | ■ | ■ | | | | ■ | ■ | | |
| 103 | ■ | ■ | ■ | | | | ■ | ■ | | |
| 104 | | | | ■ | | | ■ | ■ | | |
| 105 | ■ | | | ■ | | | ■ | ■ | | |
| 106 | | ■ | | ■ | | | ■ | ■ | | |
| 107 | ■ | ■ | | ■ | | | ■ | ■ | | |
| 108 | | | ■ | ■ | | | ■ | ■ | | |
| 109 | ■ | | ■ | ■ | | | ■ | ■ | | |
| 110 | | ■ | ■ | ■ | | | ■ | ■ | | |
| 111 | ■ | ■ | ■ | ■ | | | ■ | ■ | | |
| 112 | | | | | ■ | | ■ | ■ | | |
| 113 | ■ | | | | ■ | | ■ | ■ | | |
| 114 | | ■ | | | ■ | | ■ | ■ | | |
| 115 | ■ | ■ | | | ■ | | ■ | ■ | | |
| 116 | | | ■ | | ■ | | ■ | ■ | | |
| 117 | ■ | | ■ | | ■ | | ■ | ■ | | |
| 118 | | ■ | ■ | | ■ | | ■ | ■ | | |
| 119 | ■ | ■ | ■ | | ■ | | ■ | ■ | | |
| 120 | | | | ■ | ■ | | ■ | ■ | | |
| 121 | ■ | | | ■ | ■ | | ■ | ■ | | |
| 122 | | ■ | | ■ | ■ | | ■ | ■ | | |
| 123 | ■ | ■ | | ■ | ■ | | ■ | ■ | | |
| 124 | | | ■ | ■ | ■ | | ■ | ■ | | |
| 125 | ■ | | ■ | ■ | ■ | | ■ | ■ | | |
| 126 | | ■ | ■ | ■ | ■ | | ■ | ■ | | |
| 127 | ■ | ■ | ■ | ■ | ■ | | ■ | ■ | | |

FIG.25

| RELATIVE LUMINANCE | SF1 | SF2 | SF3 | SF4 | SF5 | SF6 | SF7A | SF7B | SF7C | SF7D |
|---|---|---|---|---|---|---|---|---|---|---|
| 128 | | | | | | ■ | | ■ | | |
| 129 | ■ | | | | | ■ | | ■ | | |
| 130 | | ■ | | | | ■ | | ■ | | |
| 131 | ■ | ■ | | | | ■ | | ■ | | |
| 132 | | | ■ | | | ■ | | ■ | | |
| 133 | ■ | | ■ | | | ■ | | ■ | | |
| 134 | | ■ | ■ | | | ■ | | ■ | | |
| 135 | ■ | ■ | ■ | | | ■ | | ■ | | |
| 136 | | | | ■ | | ■ | | ■ | | |
| 137 | ■ | | | ■ | | ■ | | ■ | | |
| 138 | | ■ | | ■ | | ■ | | ■ | | |
| 139 | ■ | ■ | | ■ | | ■ | | ■ | | |
| 140 | | | ■ | ■ | | ■ | | ■ | | |
| 141 | ■ | | ■ | ■ | | ■ | | ■ | | |
| 142 | | ■ | ■ | ■ | | ■ | | ■ | | |
| 143 | ■ | ■ | ■ | ■ | | ■ | | ■ | | |
| 144 | | | | | | | ■ | ■ | ■ | |
| 145 | ■ | | | | | | ■ | ■ | ■ | |
| 146 | | ■ | | | | | ■ | ■ | ■ | |
| 147 | ■ | ■ | | | | | ■ | ■ | ■ | |
| 148 | | | ■ | | | | ■ | ■ | ■ | |
| 149 | ■ | | ■ | | | | ■ | ■ | ■ | |
| 150 | | ■ | ■ | | | | ■ | ■ | ■ | |
| 151 | ■ | ■ | ■ | | | | ■ | ■ | ■ | |
| 152 | | | | ■ | | | ■ | ■ | ■ | |
| 153 | ■ | | | ■ | | | ■ | ■ | ■ | |
| 154 | | ■ | | ■ | | | ■ | ■ | ■ | |
| 155 | ■ | ■ | | ■ | | | ■ | ■ | ■ | |
| 156 | | | ■ | ■ | | | ■ | ■ | ■ | |
| 157 | ■ | | ■ | ■ | | | ■ | ■ | ■ | |
| 158 | | ■ | ■ | ■ | | | ■ | ■ | ■ | |
| 159 | ■ | ■ | ■ | ■ | | | ■ | ■ | ■ | |
| 160 | | | | | ■ | | ■ | ■ | ■ | |
| 161 | ■ | | | | ■ | | ■ | ■ | ■ | |
| 162 | | ■ | | | ■ | | ■ | ■ | ■ | |
| 163 | ■ | ■ | | | ■ | | ■ | ■ | ■ | |
| 164 | | | ■ | | ■ | | ■ | ■ | ■ | |
| 165 | ■ | | ■ | | ■ | | ■ | ■ | ■ | |
| 166 | | ■ | ■ | | ■ | | ■ | ■ | ■ | |
| 167 | ■ | ■ | ■ | | ■ | | ■ | ■ | ■ | |
| 168 | | | | ■ | ■ | | ■ | ■ | ■ | |
| 169 | ■ | | | ■ | ■ | | ■ | ■ | ■ | |
| 170 | | ■ | | ■ | ■ | | ■ | ■ | ■ | |
| 171 | ■ | ■ | | ■ | ■ | | ■ | ■ | ■ | |
| 172 | | | ■ | ■ | ■ | | ■ | ■ | ■ | |
| 173 | ■ | | ■ | ■ | ■ | | ■ | ■ | ■ | |
| 174 | | ■ | ■ | ■ | ■ | | ■ | ■ | ■ | |
| 175 | ■ | ■ | ■ | ■ | ■ | | ■ | ■ | ■ | |
| 176 | | | | | | ■ | ■ | ■ | ■ | |
| 177 | ■ | | | | | ■ | ■ | ■ | ■ | |
| 178 | | ■ | | | | ■ | ■ | ■ | ■ | |
| 179 | ■ | ■ | | | | ■ | ■ | ■ | ■ | |
| 180 | | | ■ | | | ■ | ■ | ■ | ■ | |
| 181 | ■ | | ■ | | | ■ | ■ | ■ | ■ | |
| 182 | | ■ | ■ | | | ■ | ■ | ■ | ■ | |
| 183 | ■ | ■ | ■ | | | ■ | ■ | ■ | ■ | |
| 184 | | | | ■ | | ■ | ■ | ■ | ■ | |
| 185 | ■ | | | ■ | | ■ | ■ | ■ | ■ | |
| 186 | | ■ | | ■ | | ■ | ■ | ■ | ■ | |
| 187 | ■ | ■ | | ■ | | ■ | ■ | ■ | ■ | |
| 188 | | | ■ | ■ | | ■ | ■ | ■ | ■ | |
| 189 | ■ | | ■ | ■ | | ■ | ■ | ■ | ■ | |
| 190 | | ■ | ■ | ■ | | ■ | ■ | ■ | ■ | |
| 191 | ■ | ■ | ■ | ■ | | ■ | ■ | ■ | ■ | |

| RELATIVE LUMINANCE | SF1 | SF2 | SF3 | SF4 | SF5 | SF6 | SF7A | SF7B | SF7C | SF7D |
|---|---|---|---|---|---|---|---|---|---|---|
| 192 | | | | | | | ■ | ■ | ■ | ■ |
| 193 | ■ | | | | | | ■ | ■ | ■ | ■ |
| 194 | | ■ | | | | | ■ | ■ | ■ | ■ |
| 195 | ■ | ■ | | | | | ■ | ■ | ■ | ■ |
| 196 | | | ■ | | | | ■ | ■ | ■ | ■ |
| 197 | ■ | | ■ | | | | ■ | ■ | ■ | ■ |
| 198 | | ■ | ■ | | | | ■ | ■ | ■ | ■ |
| 199 | ■ | ■ | ■ | | | | ■ | ■ | ■ | ■ |
| 200 | | | | ■ | | | ■ | ■ | ■ | ■ |
| 201 | ■ | | | ■ | | | ■ | ■ | ■ | ■ |
| 202 | | ■ | | ■ | | | ■ | ■ | ■ | ■ |
| 203 | ■ | ■ | | ■ | | | ■ | ■ | ■ | ■ |
| 204 | | | ■ | ■ | | | ■ | ■ | ■ | ■ |
| 205 | ■ | | ■ | ■ | | | ■ | ■ | ■ | ■ |
| 206 | | ■ | ■ | ■ | | | ■ | ■ | ■ | ■ |
| 207 | ■ | ■ | ■ | ■ | | | ■ | ■ | ■ | ■ |
| 208 | | | | | ■ | | ■ | ■ | ■ | ■ |
| 209 | ■ | | | | ■ | | ■ | ■ | ■ | ■ |
| 210 | | ■ | | | ■ | | ■ | ■ | ■ | ■ |
| 211 | ■ | ■ | | | ■ | | ■ | ■ | ■ | ■ |
| 212 | | | ■ | | ■ | | ■ | ■ | ■ | ■ |
| 213 | ■ | | ■ | | ■ | | ■ | ■ | ■ | ■ |
| 214 | | ■ | ■ | | ■ | | ■ | ■ | ■ | ■ |
| 215 | ■ | ■ | ■ | | ■ | | ■ | ■ | ■ | ■ |
| 216 | | | | ■ | ■ | | ■ | ■ | ■ | ■ |
| 217 | ■ | | | ■ | ■ | | ■ | ■ | ■ | ■ |
| 218 | | ■ | | ■ | ■ | | ■ | ■ | ■ | ■ |
| 219 | ■ | ■ | | ■ | ■ | | ■ | ■ | ■ | ■ |
| 220 | | | ■ | ■ | ■ | | ■ | ■ | ■ | ■ |
| 221 | ■ | | ■ | ■ | ■ | | ■ | ■ | ■ | ■ |
| 222 | | ■ | ■ | ■ | ■ | | ■ | ■ | ■ | ■ |
| 223 | ■ | ■ | ■ | ■ | ■ | | ■ | ■ | ■ | ■ |
| 224 | | | | | | ■ | ■ | ■ | ■ | ■ |
| 225 | ■ | | | | | ■ | ■ | ■ | ■ | ■ |
| 226 | | ■ | | | | ■ | ■ | ■ | ■ | ■ |
| 227 | ■ | ■ | | | | ■ | ■ | ■ | ■ | ■ |
| 228 | | | ■ | | | ■ | ■ | ■ | ■ | ■ |
| 229 | ■ | | ■ | | | ■ | ■ | ■ | ■ | ■ |
| 230 | | ■ | ■ | | | ■ | ■ | ■ | ■ | ■ |
| 231 | ■ | ■ | ■ | | | ■ | ■ | ■ | ■ | ■ |
| 232 | | | | ■ | | ■ | ■ | ■ | ■ | ■ |
| 233 | ■ | | | ■ | | ■ | ■ | ■ | ■ | ■ |
| 234 | | ■ | | ■ | | ■ | ■ | ■ | ■ | ■ |
| 235 | ■ | ■ | | ■ | | ■ | ■ | ■ | ■ | ■ |
| 236 | | | ■ | ■ | | ■ | ■ | ■ | ■ | ■ |
| 237 | ■ | | ■ | ■ | | ■ | ■ | ■ | ■ | ■ |
| 238 | | ■ | ■ | ■ | | ■ | ■ | ■ | ■ | ■ |
| 239 | ■ | ■ | ■ | ■ | | ■ | ■ | ■ | ■ | ■ |
| 240 | | | | | ■ | ■ | ■ | ■ | ■ | ■ |
| 241 | ■ | | | | ■ | ■ | ■ | ■ | ■ | ■ |
| 242 | | ■ | | | ■ | ■ | ■ | ■ | ■ | ■ |
| 243 | ■ | ■ | | | ■ | ■ | ■ | ■ | ■ | ■ |
| 244 | | | ■ | | ■ | ■ | ■ | ■ | ■ | ■ |
| 245 | ■ | | ■ | | ■ | ■ | ■ | ■ | ■ | ■ |
| 246 | | ■ | ■ | | ■ | ■ | ■ | ■ | ■ | ■ |
| 247 | ■ | ■ | ■ | | ■ | ■ | ■ | ■ | ■ | ■ |
| 248 | | | | ■ | ■ | ■ | ■ | ■ | ■ | ■ |
| 249 | ■ | | | ■ | ■ | ■ | ■ | ■ | ■ | ■ |
| 250 | | ■ | | ■ | ■ | ■ | ■ | ■ | ■ | ■ |
| 251 | ■ | ■ | | ■ | ■ | ■ | ■ | ■ | ■ | ■ |
| 252 | | | ■ | ■ | ■ | ■ | ■ | ■ | ■ | ■ |
| 253 | ■ | | ■ | ■ | ■ | ■ | ■ | ■ | ■ | ■ |
| 254 | | ■ | ■ | ■ | ■ | ■ | ■ | ■ | ■ | ■ |
| 255 | ■ | ■ | ■ | ■ | ■ | ■ | ■ | ■ | ■ | ■ |

FIG.29

| RELATIVE LUMINANCE | SF1 | SF2 | SF3 | SF4 | SF5 | SF6 | SF7A | SF7B | SF7C | SF7D |
|---|---|---|---|---|---|---|---|---|---|---|
| 128 | | | | | | ■ | | ■ | ■ | |
| 129 | ■ | | | | | ■ | | ■ | ■ | |
| 130 | | ■ | | | | ■ | | ■ | ■ | |
| 131 | ■ | ■ | | | | ■ | | ■ | ■ | |
| 132 | | | ■ | | | ■ | | ■ | ■ | |
| 133 | ■ | | ■ | | | ■ | | ■ | ■ | |
| 134 | | ■ | ■ | | | ■ | | ■ | ■ | |
| 135 | ■ | ■ | ■ | | | ■ | | ■ | ■ | |
| 136 | | | | ■ | | ■ | | ■ | ■ | |
| 137 | ■ | | | ■ | | ■ | | ■ | ■ | |
| 138 | | ■ | | ■ | | ■ | | ■ | ■ | |
| 139 | ■ | ■ | | ■ | | ■ | | ■ | ■ | |
| 140 | | | ■ | ■ | | ■ | | ■ | ■ | |
| 141 | ■ | | ■ | ■ | | ■ | | ■ | ■ | |
| 142 | | ■ | ■ | ■ | | ■ | | ■ | ■ | |
| 143 | ■ | ■ | ■ | ■ | | ■ | | ■ | ■ | |
| 144 | | | | | ■ | ■ | | ■ | ■ | |
| 145 | ■ | | | | ■ | ■ | | ■ | ■ | |
| 146 | | ■ | | | ■ | ■ | | ■ | ■ | |
| 147 | ■ | ■ | | | ■ | ■ | | ■ | ■ | |
| 148 | | | ■ | | ■ | ■ | | ■ | ■ | |
| 149 | ■ | | ■ | | ■ | ■ | | ■ | ■ | |
| 150 | | ■ | ■ | | ■ | ■ | | ■ | ■ | |
| 151 | ■ | ■ | ■ | | ■ | ■ | | ■ | ■ | |
| 152 | | | | ■ | ■ | ■ | | ■ | ■ | |
| 153 | ■ | | | ■ | ■ | ■ | | ■ | ■ | |
| 154 | | ■ | | ■ | ■ | ■ | | ■ | ■ | |
| 155 | ■ | ■ | | ■ | ■ | ■ | | ■ | ■ | |
| 156 | | | ■ | ■ | ■ | ■ | | ■ | ■ | |
| 157 | ■ | | ■ | ■ | ■ | ■ | | ■ | ■ | |
| 158 | | ■ | ■ | ■ | ■ | ■ | | ■ | ■ | |
| 159 | ■ | ■ | ■ | ■ | ■ | ■ | | ■ | ■ | |
| 160 | | | | | ■ | | ■ | ■ | ■ | |
| 161 | ■ | | | | ■ | | ■ | ■ | ■ | |
| 162 | | ■ | | | ■ | | ■ | ■ | ■ | |
| 163 | ■ | ■ | | | ■ | | ■ | ■ | ■ | |
| 164 | | | ■ | | ■ | | ■ | ■ | ■ | |
| 165 | ■ | | ■ | | ■ | | ■ | ■ | ■ | |
| 166 | | ■ | ■ | | ■ | | ■ | ■ | ■ | |
| 167 | ■ | ■ | ■ | | ■ | | ■ | ■ | ■ | |
| 168 | | | | ■ | ■ | | ■ | ■ | ■ | |
| 169 | ■ | | | ■ | ■ | | ■ | ■ | ■ | |
| 170 | | ■ | | ■ | ■ | | ■ | ■ | ■ | |
| 171 | ■ | ■ | | ■ | ■ | | ■ | ■ | ■ | |
| 172 | | | ■ | ■ | ■ | | ■ | ■ | ■ | |
| 173 | ■ | | ■ | ■ | ■ | | ■ | ■ | ■ | |
| 174 | | ■ | ■ | ■ | ■ | | ■ | ■ | ■ | |
| 175 | ■ | ■ | ■ | ■ | ■ | | ■ | ■ | ■ | |
| 176 | | | | | | ■ | ■ | ■ | ■ | |
| 177 | ■ | | | | | ■ | ■ | ■ | ■ | |
| 178 | | ■ | | | | ■ | ■ | ■ | ■ | |
| 179 | ■ | ■ | | | | ■ | ■ | ■ | ■ | |
| 180 | | | ■ | | | ■ | ■ | ■ | ■ | |
| 181 | ■ | | ■ | | | ■ | ■ | ■ | ■ | |
| 182 | | ■ | ■ | | | ■ | ■ | ■ | ■ | |
| 183 | ■ | ■ | ■ | | | ■ | ■ | ■ | ■ | |
| 184 | | | | ■ | | ■ | ■ | ■ | ■ | |
| 185 | ■ | | | ■ | | ■ | ■ | ■ | ■ | |
| 186 | | ■ | | ■ | | ■ | ■ | ■ | ■ | |
| 187 | ■ | ■ | | ■ | | ■ | ■ | ■ | ■ | |
| 188 | | | ■ | ■ | | ■ | ■ | ■ | ■ | |
| 189 | ■ | | ■ | ■ | | ■ | ■ | ■ | ■ | |
| 190 | | ■ | ■ | ■ | | ■ | ■ | ■ | ■ | |
| 191 | ■ | ■ | ■ | ■ | | ■ | ■ | ■ | ■ | |

| RELATIVE LUMINANCE | SF1 | SF2 | SF3 | SF4 | SF5 | SF6 | SF7A | SF7B | SF7C | SF7D |
|---|---|---|---|---|---|---|---|---|---|---|
| 192 | | | | | ■ | ■ | ■ | ■ | ■ | |
| 193 | ■ | | | | ■ | ■ | ■ | ■ | ■ | |
| 194 | | ■ | | | ■ | ■ | ■ | ■ | ■ | |
| 195 | ■ | ■ | | | ■ | ■ | ■ | ■ | ■ | |
| 196 | | | ■ | | ■ | ■ | ■ | ■ | ■ | |
| 197 | ■ | | ■ | | ■ | ■ | ■ | ■ | ■ | |
| 198 | | ■ | ■ | | ■ | ■ | ■ | ■ | ■ | |
| 199 | ■ | ■ | ■ | | ■ | ■ | ■ | ■ | ■ | |
| 200 | | | | ■ | ■ | ■ | ■ | ■ | ■ | |
| 201 | ■ | | | ■ | ■ | ■ | ■ | ■ | ■ | |
| 202 | | ■ | | ■ | ■ | ■ | ■ | ■ | ■ | |
| 203 | ■ | ■ | | ■ | ■ | ■ | ■ | ■ | ■ | |
| 204 | | | ■ | ■ | ■ | ■ | ■ | ■ | ■ | |
| 205 | ■ | | ■ | ■ | ■ | ■ | ■ | ■ | ■ | |
| 206 | | ■ | ■ | ■ | ■ | ■ | ■ | ■ | ■ | |
| 207 | ■ | ■ | ■ | ■ | ■ | ■ | ■ | ■ | ■ | |
| 208 | | | | | ■ | | ■ | ■ | ■ | ■ |
| 209 | ■ | | | | ■ | | ■ | ■ | ■ | ■ |
| 210 | | ■ | | | ■ | | ■ | ■ | ■ | ■ |
| 211 | ■ | ■ | | | ■ | | ■ | ■ | ■ | ■ |
| 212 | | | ■ | | ■ | | ■ | ■ | ■ | ■ |
| 213 | ■ | | ■ | | ■ | | ■ | ■ | ■ | ■ |
| 214 | | ■ | ■ | | ■ | | ■ | ■ | ■ | ■ |
| 215 | ■ | ■ | ■ | | ■ | | ■ | ■ | ■ | ■ |
| 216 | | | | ■ | ■ | | ■ | ■ | ■ | ■ |
| 217 | ■ | | | ■ | ■ | | ■ | ■ | ■ | ■ |
| 218 | | ■ | | ■ | ■ | | ■ | ■ | ■ | ■ |
| 219 | ■ | ■ | | ■ | ■ | | ■ | ■ | ■ | ■ |
| 220 | | | ■ | ■ | ■ | | ■ | ■ | ■ | ■ |
| 221 | ■ | | ■ | ■ | ■ | | ■ | ■ | ■ | ■ |
| 222 | | ■ | ■ | ■ | ■ | | ■ | ■ | ■ | ■ |
| 223 | ■ | ■ | ■ | ■ | ■ | | ■ | ■ | ■ | ■ |
| 224 | | | | | | ■ | ■ | ■ | ■ | ■ |
| 225 | ■ | | | | | ■ | ■ | ■ | ■ | ■ |
| 226 | | ■ | | | | ■ | ■ | ■ | ■ | ■ |
| 227 | ■ | ■ | | | | ■ | ■ | ■ | ■ | ■ |
| 228 | | | ■ | | | ■ | ■ | ■ | ■ | ■ |
| 229 | ■ | | ■ | | | ■ | ■ | ■ | ■ | ■ |
| 230 | | ■ | ■ | | | ■ | ■ | ■ | ■ | ■ |
| 231 | ■ | ■ | ■ | | | ■ | ■ | ■ | ■ | ■ |
| 232 | | | | ■ | | ■ | ■ | ■ | ■ | ■ |
| 233 | ■ | | | ■ | | ■ | ■ | ■ | ■ | ■ |
| 234 | | ■ | | ■ | | ■ | ■ | ■ | ■ | ■ |
| 235 | ■ | ■ | | ■ | | ■ | ■ | ■ | ■ | ■ |
| 236 | | | ■ | ■ | | ■ | ■ | ■ | ■ | ■ |
| 237 | ■ | | ■ | ■ | | ■ | ■ | ■ | ■ | ■ |
| 238 | | ■ | ■ | ■ | | ■ | ■ | ■ | ■ | ■ |
| 239 | ■ | ■ | ■ | ■ | | ■ | ■ | ■ | ■ | ■ |
| 240 | | | | | ■ | ■ | ■ | ■ | ■ | ■ |
| 241 | ■ | | | | ■ | ■ | ■ | ■ | ■ | ■ |
| 242 | | ■ | | | ■ | ■ | ■ | ■ | ■ | ■ |
| 243 | ■ | ■ | | | ■ | ■ | ■ | ■ | ■ | ■ |
| 244 | | | ■ | | ■ | ■ | ■ | ■ | ■ | ■ |
| 245 | ■ | | ■ | | ■ | ■ | ■ | ■ | ■ | ■ |
| 246 | | ■ | ■ | | ■ | ■ | ■ | ■ | ■ | ■ |
| 247 | ■ | ■ | ■ | | ■ | ■ | ■ | ■ | ■ | ■ |
| 248 | | | | ■ | ■ | ■ | ■ | ■ | ■ | ■ |
| 249 | ■ | | | ■ | ■ | ■ | ■ | ■ | ■ | ■ |
| 250 | | ■ | | ■ | ■ | ■ | ■ | ■ | ■ | ■ |
| 251 | ■ | ■ | | ■ | ■ | ■ | ■ | ■ | ■ | ■ |
| 252 | | | ■ | ■ | ■ | ■ | ■ | ■ | ■ | ■ |
| 253 | ■ | | ■ | ■ | ■ | ■ | ■ | ■ | ■ | ■ |
| 254 | | ■ | ■ | ■ | ■ | ■ | ■ | ■ | ■ | ■ |
| 255 | ■ | ■ | ■ | ■ | ■ | ■ | ■ | ■ | ■ | ■ |

FIG.31

| RELATIVE LUMINANCE | SF1 | SF2 | SF3 | SF4 | SF5 | SF6 | SF7A | SF7B | SF7C | SF7D |
|---|---|---|---|---|---|---|---|---|---|---|
| 128 | | | | | | ■ | | ■ | ■ | |
| 129 | ■ | | | | | ■ | | ■ | ■ | |
| 130 | | ■ | | | | ■ | | ■ | ■ | |
| 131 | ■ | ■ | | | | ■ | | ■ | ■ | |
| 132 | | | ■ | | | ■ | | ■ | ■ | |
| 133 | ■ | | ■ | | | ■ | | ■ | ■ | |
| 134 | | ■ | ■ | | | ■ | | ■ | ■ | |
| 135 | ■ | ■ | ■ | | | ■ | | ■ | ■ | |
| 136 | | | | ■ | | ■ | | ■ | ■ | |
| 137 | ■ | | | ■ | | ■ | | ■ | ■ | |
| 138 | | ■ | | ■ | | ■ | | ■ | ■ | |
| 139 | ■ | ■ | | ■ | | ■ | | ■ | ■ | |
| 140 | | | ■ | ■ | | ■ | | ■ | ■ | |
| 141 | ■ | | ■ | ■ | | ■ | | ■ | ■ | |
| 142 | | ■ | ■ | ■ | | ■ | | ■ | ■ | |
| 143 | ■ | ■ | ■ | ■ | | ■ | | ■ | ■ | |
| 144 | | | | | | | ■ | ■ | ■ | |
| 145 | ■ | | | | | | ■ | ■ | ■ | |
| 146 | | ■ | | | | | ■ | ■ | ■ | |
| 147 | ■ | ■ | | | | | ■ | ■ | ■ | |
| 148 | | | ■ | | | | ■ | ■ | ■ | |
| 149 | ■ | | ■ | | | | ■ | ■ | ■ | |
| 150 | | ■ | ■ | | | | ■ | ■ | ■ | |
| 151 | ■ | ■ | ■ | | | | ■ | ■ | ■ | |
| 152 | | | | ■ | | | ■ | ■ | ■ | |
| 153 | ■ | | | ■ | | | ■ | ■ | ■ | |
| 154 | | ■ | | ■ | | | ■ | ■ | ■ | |
| 155 | ■ | ■ | | ■ | | | ■ | ■ | ■ | |
| 156 | | | ■ | ■ | | | ■ | ■ | ■ | |
| 157 | ■ | | ■ | ■ | | | ■ | ■ | ■ | |
| 158 | | ■ | ■ | ■ | | | ■ | ■ | ■ | |
| 159 | ■ | ■ | ■ | ■ | | | ■ | ■ | ■ | |
| 160 | | | | | ■ | | ■ | ■ | ■ | |
| 161 | ■ | | | | ■ | | ■ | ■ | ■ | |
| 162 | | ■ | | | ■ | | ■ | ■ | ■ | |
| 163 | ■ | ■ | | | ■ | | ■ | ■ | ■ | |
| 164 | | | ■ | | ■ | | ■ | ■ | ■ | |
| 165 | ■ | | ■ | | ■ | | ■ | ■ | ■ | |
| 166 | | ■ | ■ | | ■ | | ■ | ■ | ■ | |
| 167 | ■ | ■ | ■ | | ■ | | ■ | ■ | ■ | |
| 168 | | | | ■ | ■ | | ■ | ■ | ■ | |
| 169 | ■ | | | ■ | ■ | | ■ | ■ | ■ | |
| 170 | | ■ | | ■ | ■ | | ■ | ■ | ■ | |
| 171 | ■ | ■ | | ■ | ■ | | ■ | ■ | ■ | |
| 172 | | | ■ | ■ | ■ | | ■ | ■ | ■ | |
| 173 | ■ | | ■ | ■ | ■ | | ■ | ■ | ■ | |
| 174 | | ■ | ■ | ■ | ■ | | ■ | ■ | ■ | |
| 175 | ■ | ■ | ■ | ■ | ■ | | ■ | ■ | ■ | |
| 176 | | | | | | ■ | ■ | ■ | ■ | |
| 177 | ■ | | | | | ■ | ■ | ■ | ■ | |
| 178 | | ■ | | | | ■ | ■ | ■ | ■ | |
| 179 | ■ | ■ | | | | ■ | ■ | ■ | ■ | |
| 180 | | | ■ | | | ■ | ■ | ■ | ■ | |
| 181 | ■ | | ■ | | | ■ | ■ | ■ | ■ | |
| 182 | | ■ | ■ | | | ■ | ■ | ■ | ■ | |
| 183 | ■ | ■ | ■ | | | ■ | ■ | ■ | ■ | |
| 184 | | | | ■ | | ■ | ■ | ■ | ■ | |
| 185 | ■ | | | ■ | | ■ | ■ | ■ | ■ | |
| 186 | | ■ | | ■ | | ■ | ■ | ■ | ■ | |
| 187 | ■ | ■ | | ■ | | ■ | ■ | ■ | ■ | |
| 188 | | | ■ | ■ | | ■ | ■ | ■ | ■ | |
| 189 | ■ | | ■ | ■ | | ■ | ■ | ■ | ■ | |
| 190 | | ■ | ■ | ■ | | ■ | ■ | ■ | ■ | |
| 191 | ■ | ■ | ■ | ■ | | ■ | ■ | ■ | ■ | |

| RELATIVE LUMINANCE | SF1 | SF2 | SF3 | SF4 | SF5 | SF6 | SF7A | SF7B | SF7C | SF7D |
|---|---|---|---|---|---|---|---|---|---|---|
| 192 | | | | | | | ■ | ■ | ■ | ■ |
| 193 | ■ | | | | | | ■ | ■ | ■ | ■ |
| 194 | | ■ | | | | | ■ | ■ | ■ | ■ |
| 195 | ■ | ■ | | | | | ■ | ■ | ■ | ■ |
| 196 | | | ■ | | | | ■ | ■ | ■ | ■ |
| 197 | ■ | | ■ | | | | ■ | ■ | ■ | ■ |
| 198 | | ■ | ■ | | | | ■ | ■ | ■ | ■ |
| 199 | ■ | ■ | ■ | | | | ■ | ■ | ■ | ■ |
| 200 | | | | ■ | | | ■ | ■ | ■ | ■ |
| 201 | ■ | | | ■ | | | ■ | ■ | ■ | ■ |
| 202 | | ■ | | ■ | | | ■ | ■ | ■ | ■ |
| 203 | ■ | ■ | | ■ | | | ■ | ■ | ■ | ■ |
| 204 | | | ■ | ■ | | | ■ | ■ | ■ | ■ |
| 205 | ■ | | ■ | ■ | | | ■ | ■ | ■ | ■ |
| 206 | | ■ | ■ | ■ | | | ■ | ■ | ■ | ■ |
| 207 | ■ | ■ | ■ | ■ | | | ■ | ■ | ■ | ■ |
| 208 | | | | | ■ | | ■ | ■ | ■ | ■ |
| 209 | ■ | | | | ■ | | ■ | ■ | ■ | ■ |
| 210 | | ■ | | | ■ | | ■ | ■ | ■ | ■ |
| 211 | ■ | ■ | | | ■ | | ■ | ■ | ■ | ■ |
| 212 | | | ■ | | ■ | | ■ | ■ | ■ | ■ |
| 213 | ■ | | ■ | | ■ | | ■ | ■ | ■ | ■ |
| 214 | | ■ | ■ | | ■ | | ■ | ■ | ■ | ■ |
| 215 | ■ | ■ | ■ | | ■ | | ■ | ■ | ■ | ■ |
| 216 | | | | ■ | ■ | | ■ | ■ | ■ | ■ |
| 217 | ■ | | | ■ | ■ | | ■ | ■ | ■ | ■ |
| 218 | | ■ | | ■ | ■ | | ■ | ■ | ■ | ■ |
| 219 | ■ | ■ | | ■ | ■ | | ■ | ■ | ■ | ■ |
| 220 | | | ■ | ■ | ■ | | ■ | ■ | ■ | ■ |
| 221 | ■ | | ■ | ■ | ■ | | ■ | ■ | ■ | ■ |
| 222 | | ■ | ■ | ■ | ■ | | ■ | ■ | ■ | ■ |
| 223 | ■ | ■ | ■ | ■ | ■ | | ■ | ■ | ■ | ■ |
| 224 | | | | | | ■ | ■ | ■ | ■ | ■ |
| 225 | ■ | | | | | ■ | ■ | ■ | ■ | ■ |
| 226 | | ■ | | | | ■ | ■ | ■ | ■ | ■ |
| 227 | ■ | ■ | | | | ■ | ■ | ■ | ■ | ■ |
| 228 | | | ■ | | | ■ | ■ | ■ | ■ | ■ |
| 229 | ■ | | ■ | | | ■ | ■ | ■ | ■ | ■ |
| 230 | | ■ | ■ | | | ■ | ■ | ■ | ■ | ■ |
| 231 | ■ | ■ | ■ | | | ■ | ■ | ■ | ■ | ■ |
| 232 | | | | ■ | | ■ | ■ | ■ | ■ | ■ |
| 233 | ■ | | | ■ | | ■ | ■ | ■ | ■ | ■ |
| 234 | | ■ | | ■ | | ■ | ■ | ■ | ■ | ■ |
| 235 | ■ | ■ | | ■ | | ■ | ■ | ■ | ■ | ■ |
| 236 | | | ■ | ■ | | ■ | ■ | ■ | ■ | ■ |
| 237 | ■ | | ■ | ■ | | ■ | ■ | ■ | ■ | ■ |
| 238 | | ■ | ■ | ■ | | ■ | ■ | ■ | ■ | ■ |
| 239 | ■ | ■ | ■ | ■ | | ■ | ■ | ■ | ■ | ■ |
| 240 | | | | | ■ | ■ | ■ | ■ | ■ | ■ |
| 241 | ■ | | | | ■ | ■ | ■ | ■ | ■ | ■ |
| 242 | | ■ | | | ■ | ■ | ■ | ■ | ■ | ■ |
| 243 | ■ | ■ | | | ■ | ■ | ■ | ■ | ■ | ■ |
| 244 | | | ■ | | ■ | ■ | ■ | ■ | ■ | ■ |
| 245 | ■ | | ■ | | ■ | ■ | ■ | ■ | ■ | ■ |
| 246 | | ■ | ■ | | ■ | ■ | ■ | ■ | ■ | ■ |
| 247 | ■ | ■ | ■ | | ■ | ■ | ■ | ■ | ■ | ■ |
| 248 | | | | ■ | ■ | ■ | ■ | ■ | ■ | ■ |
| 249 | ■ | | | ■ | ■ | ■ | ■ | ■ | ■ | ■ |
| 250 | | ■ | | ■ | ■ | ■ | ■ | ■ | ■ | ■ |
| 251 | ■ | ■ | | ■ | ■ | ■ | ■ | ■ | ■ | ■ |
| 252 | | | ■ | ■ | ■ | ■ | ■ | ■ | ■ | ■ |
| 253 | ■ | | ■ | ■ | ■ | ■ | ■ | ■ | ■ | ■ |
| 254 | | ■ | ■ | ■ | ■ | ■ | ■ | ■ | ■ | ■ |
| 255 | ■ | ■ | ■ | ■ | ■ | ■ | ■ | ■ | ■ | ■ |

FIG.33

| RELATIVE LUMINANCE | SF1 | SF2 | SF3 | SF4 | SF5 | SF6 | SF7A | SF7B | SF7C | SF7D |
|---|---|---|---|---|---|---|---|---|---|---|
| 0 | | | | | | | | | | |
| 1 | ■ | | | | | | | | | |
| 2 | | ■ | | | | | | | | |
| 3 | ■ | ■ | | | | | | | | |
| 4 | | | ■ | | | | | | | |
| 5 | ■ | | ■ | | | | | | | |
| 6 | | ■ | ■ | | | | | | | |
| 7 | ■ | ■ | ■ | | | | | | | |
| 8 | | | | ■ | | | | | | |
| 9 | ■ | | | ■ | | | | | | |
| 10 | | ■ | | ■ | | | | | | |
| 11 | ■ | ■ | | ■ | | | | | | |
| 12 | | | ■ | ■ | | | | | | |
| 13 | ■ | | ■ | ■ | | | | | | |
| 14 | | ■ | ■ | ■ | | | | | | |
| 15 | ■ | ■ | ■ | ■ | | | | | | |
| 16 | | | | | ■ | | | | | |
| 17 | ■ | | | | ■ | | | | | |
| 18 | | ■ | | | ■ | | | | | |
| 19 | ■ | ■ | | | ■ | | | | | |
| 20 | | | ■ | | ■ | | | | | |
| 21 | ■ | | ■ | | ■ | | | | | |
| 22 | | ■ | ■ | | ■ | | | | | |
| 23 | ■ | ■ | ■ | | ■ | | | | | |
| 24 | | | | ■ | ■ | | | | | |
| 25 | ■ | | | ■ | ■ | | | | | |
| 26 | | ■ | | ■ | ■ | | | | | |
| 27 | ■ | ■ | | ■ | ■ | | | | | |
| 28 | | | ■ | ■ | ■ | | | | | |
| 29 | ■ | | ■ | ■ | ■ | | | | | |
| 30 | | ■ | ■ | ■ | ■ | | | | | |
| 31 | ■ | ■ | ■ | ■ | ■ | | | | | |
| 32 | | | | | | ■ | | | | |
| 33 | ■ | | | | | ■ | | | | |
| 34 | | ■ | | | | ■ | | | | |
| 35 | ■ | ■ | | | | ■ | | | | |
| 36 | | | ■ | | | ■ | | | | |
| 37 | ■ | | ■ | | | ■ | | | | |
| 38 | | ■ | ■ | | | ■ | | | | |
| 39 | ■ | ■ | ■ | | | ■ | | | | |
| 40 | | | | ■ | | ■ | | | | |
| 41 | ■ | | | ■ | | ■ | | | | |
| 42 | | ■ | | ■ | | ■ | | | | |
| 43 | ■ | ■ | | ■ | | ■ | | | | |
| 44 | | | ■ | ■ | | ■ | | | | |
| 45 | ■ | | ■ | ■ | | ■ | | | | |
| 46 | | ■ | ■ | ■ | | ■ | | | | |
| 47 | ■ | ■ | ■ | ■ | | ■ | | | | |
| 48 | | | | | ■ | ■ | | | | |
| 49 | ■ | | | | ■ | ■ | | | | |
| 50 | | ■ | | | ■ | ■ | | | | |
| 51 | ■ | ■ | | | ■ | ■ | | | | |
| 52 | | | ■ | | ■ | ■ | | | | |
| 53 | ■ | | ■ | | ■ | ■ | | | | |
| 54 | | ■ | ■ | | ■ | ■ | | | | |
| 55 | ■ | ■ | ■ | | ■ | ■ | | | | |
| 56 | | | | ■ | ■ | ■ | | | | |
| 57 | ■ | | | ■ | ■ | ■ | | | | |
| 58 | | ■ | | ■ | ■ | ■ | | | | |
| 59 | ■ | ■ | | ■ | ■ | ■ | | | | |
| 60 | | | ■ | ■ | ■ | ■ | | | | |
| 61 | ■ | | ■ | ■ | ■ | ■ | | | | |
| 62 | | ■ | ■ | ■ | ■ | ■ | | | | |
| 63 | ■ | ■ | ■ | ■ | ■ | ■ | | | | |

| RELATIVE LUMINANCE | SF1 | SF2 | SF3 | SF4 | SF5 | SF6 | SF7A | SF7B | SF7C | SF7D |
|---|---|---|---|---|---|---|---|---|---|---|
| 64 | | | | | ■ | | | ■ | | |
| 65 | ■ | | | | ■ | | | ■ | | |
| 66 | | ■ | | | ■ | | | ■ | | |
| 67 | ■ | ■ | | | ■ | | | ■ | | |
| 68 | | | ■ | | ■ | | | ■ | | |
| 69 | ■ | | ■ | | ■ | | | ■ | | |
| 70 | | ■ | ■ | | ■ | | | ■ | | |
| 71 | ■ | ■ | ■ | | ■ | | | ■ | | |
| 72 | | | | ■ | ■ | | | ■ | | |
| 73 | ■ | | | ■ | ■ | | | ■ | | |
| 74 | | ■ | | ■ | ■ | | | ■ | | |
| 75 | ■ | ■ | | ■ | ■ | | | ■ | | |
| 76 | | | ■ | ■ | ■ | | | ■ | | |
| 77 | ■ | | ■ | ■ | ■ | | | ■ | | |
| 78 | | ■ | ■ | ■ | ■ | | | ■ | | |
| 79 | ■ | ■ | ■ | ■ | ■ | | | ■ | | |
| 80 | | | | | | ■ | | ■ | | |
| 81 | ■ | | | | | ■ | | ■ | | |
| 82 | | ■ | | | | ■ | | ■ | | |
| 83 | ■ | ■ | | | | ■ | | ■ | | |
| 84 | | | ■ | | | ■ | | ■ | | |
| 85 | ■ | | ■ | | | ■ | | ■ | | |
| 86 | | ■ | ■ | | | ■ | | ■ | | |
| 87 | ■ | ■ | ■ | | | ■ | | ■ | | |
| 88 | | | | ■ | | ■ | | ■ | | |
| 89 | ■ | | | ■ | | ■ | | ■ | | |
| 90 | | ■ | | ■ | | ■ | | ■ | | |
| 91 | ■ | ■ | | ■ | | ■ | | ■ | | |
| 92 | | | ■ | ■ | | ■ | | ■ | | |
| 93 | ■ | | ■ | ■ | | ■ | | ■ | | |
| 94 | | ■ | ■ | ■ | | ■ | | ■ | | |
| 95 | ■ | ■ | ■ | ■ | | ■ | | ■ | | |
| 96 | | | | | ■ | ■ | | ■ | | |
| 97 | ■ | | | | ■ | ■ | | ■ | | |
| 98 | | ■ | | | ■ | ■ | | ■ | | |
| 99 | ■ | ■ | | | ■ | ■ | | ■ | | |
| 100 | | | ■ | | ■ | ■ | | ■ | | |
| 101 | ■ | | ■ | | ■ | ■ | | ■ | | |
| 102 | | ■ | ■ | | ■ | ■ | | ■ | | |
| 103 | ■ | ■ | ■ | | ■ | ■ | | ■ | | |
| 104 | | | | ■ | ■ | ■ | | ■ | | |
| 105 | ■ | | | ■ | ■ | ■ | | ■ | | |
| 106 | | ■ | | ■ | ■ | ■ | | ■ | | |
| 107 | ■ | ■ | | ■ | ■ | ■ | | ■ | | |
| 108 | | | ■ | ■ | ■ | ■ | | ■ | | |
| 109 | ■ | | ■ | ■ | ■ | ■ | | ■ | | |
| 110 | | ■ | ■ | ■ | ■ | ■ | | ■ | | |
| 111 | ■ | ■ | ■ | ■ | ■ | ■ | | ■ | | |
| 112 | | | | | ■ | ■ | | ■ | ■ | |
| 113 | ■ | | | | ■ | ■ | | ■ | ■ | |
| 114 | | ■ | | | ■ | ■ | | ■ | ■ | |
| 115 | ■ | ■ | | | ■ | ■ | | ■ | ■ | |
| 116 | | | ■ | | ■ | ■ | | ■ | ■ | |
| 117 | ■ | | ■ | | ■ | ■ | | ■ | ■ | |
| 118 | | ■ | ■ | | ■ | ■ | | ■ | ■ | |
| 119 | ■ | ■ | ■ | | ■ | ■ | | ■ | ■ | |
| 120 | | | | ■ | ■ | ■ | | ■ | ■ | |
| 121 | ■ | | | ■ | ■ | ■ | | ■ | ■ | |
| 122 | | ■ | | ■ | ■ | ■ | | ■ | ■ | |
| 123 | ■ | ■ | | ■ | ■ | ■ | | ■ | ■ | |
| 124 | | | ■ | ■ | ■ | ■ | | ■ | ■ | |
| 125 | ■ | | ■ | ■ | ■ | ■ | | ■ | ■ | |
| 126 | | ■ | ■ | ■ | ■ | ■ | | ■ | ■ | |
| 127 | ■ | ■ | ■ | ■ | ■ | ■ | | ■ | ■ | |

FIG.34

| RELATIVE LUMINANCE | SF1 | SF2 | SF3 | SF4 | SF5 | SF6 | SF7A | SF7B | SF7C | SF7D |
|---|---|---|---|---|---|---|---|---|---|---|
| 128 | | | | | | ▨ | ▨ | ▨ | | |
| 129 | ▨ | | | | | ▨ | ▨ | ▨ | | |
| 130 | | ▨ | | | | ▨ | ▨ | ▨ | | |
| 131 | ▨ | ▨ | | | | ▨ | ▨ | ▨ | | |
| 132 | | | ▨ | | | ▨ | ▨ | ▨ | | |
| 133 | ▨ | | ▨ | | | ▨ | ▨ | ▨ | | |
| 134 | | ▨ | ▨ | | | ▨ | ▨ | ▨ | | |
| 135 | ▨ | ▨ | ▨ | | | ▨ | ▨ | ▨ | | |
| 136 | | | | ▨ | | ▨ | ▨ | ▨ | | |
| 137 | ▨ | | | ▨ | | ▨ | ▨ | ▨ | | |
| 138 | | ▨ | | ▨ | | ▨ | ▨ | ▨ | | |
| 139 | ▨ | ▨ | | ▨ | | ▨ | ▨ | ▨ | | |
| 140 | | | ▨ | ▨ | | ▨ | ▨ | ▨ | | |
| 141 | ▨ | | ▨ | ▨ | | ▨ | ▨ | ▨ | | |
| 142 | | ▨ | ▨ | ▨ | | ▨ | ▨ | ▨ | | |
| 143 | ▨ | ▨ | ▨ | ▨ | | ▨ | ▨ | ▨ | | |
| 144 | | | | | ▨ | ▨ | ▨ | ▨ | | |
| 145 | ▨ | | | | ▨ | ▨ | ▨ | ▨ | | |
| 146 | | ▨ | | | ▨ | ▨ | ▨ | ▨ | | |
| 147 | ▨ | ▨ | | | ▨ | ▨ | ▨ | ▨ | | |
| 148 | | | ▨ | | ▨ | ▨ | ▨ | ▨ | | |
| 149 | ▨ | | ▨ | | ▨ | ▨ | ▨ | ▨ | | |
| 150 | | ▨ | ▨ | | ▨ | ▨ | ▨ | ▨ | | |
| 151 | ▨ | ▨ | ▨ | | ▨ | ▨ | ▨ | ▨ | | |
| 152 | | | | ▨ | ▨ | ▨ | ▨ | ▨ | | |
| 153 | ▨ | | | ▨ | ▨ | ▨ | ▨ | ▨ | | |
| 154 | | ▨ | | ▨ | ▨ | ▨ | ▨ | ▨ | | |
| 155 | ▨ | ▨ | | ▨ | ▨ | ▨ | ▨ | ▨ | | |
| 156 | | | ▨ | ▨ | ▨ | ▨ | ▨ | ▨ | | |
| 157 | ▨ | | ▨ | ▨ | ▨ | ▨ | ▨ | ▨ | | |
| 158 | | ▨ | ▨ | ▨ | ▨ | ▨ | ▨ | ▨ | | |
| 159 | ▨ | ▨ | ▨ | ▨ | ▨ | ▨ | ▨ | ▨ | | |
| 160 | | | | | ▨ | | ▨ | ▨ | ▨ | |
| 161 | ▨ | | | | ▨ | | ▨ | ▨ | ▨ | |
| 162 | | ▨ | | | ▨ | | ▨ | ▨ | ▨ | |
| 163 | ▨ | ▨ | | | ▨ | | ▨ | ▨ | ▨ | |
| 164 | | | ▨ | | ▨ | | ▨ | ▨ | ▨ | |
| 165 | ▨ | | ▨ | | ▨ | | ▨ | ▨ | ▨ | |
| 166 | | ▨ | ▨ | | ▨ | | ▨ | ▨ | ▨ | |
| 167 | ▨ | ▨ | ▨ | | ▨ | | ▨ | ▨ | ▨ | |
| 168 | | | | ▨ | ▨ | | ▨ | ▨ | ▨ | |
| 169 | ▨ | | | ▨ | ▨ | | ▨ | ▨ | ▨ | |
| 170 | | ▨ | | ▨ | ▨ | | ▨ | ▨ | ▨ | |
| 171 | ▨ | ▨ | | ▨ | ▨ | | ▨ | ▨ | ▨ | |
| 172 | | | ▨ | ▨ | ▨ | | ▨ | ▨ | ▨ | |
| 173 | ▨ | | ▨ | ▨ | ▨ | | ▨ | ▨ | ▨ | |
| 174 | | ▨ | ▨ | ▨ | ▨ | | ▨ | ▨ | ▨ | |
| 175 | ▨ | ▨ | ▨ | ▨ | ▨ | | ▨ | ▨ | ▨ | |
| 176 | | | | | | ▨ | ▨ | ▨ | ▨ | |
| 177 | ▨ | | | | | ▨ | ▨ | ▨ | ▨ | |
| 178 | | ▨ | | | | ▨ | ▨ | ▨ | ▨ | |
| 179 | ▨ | ▨ | | | | ▨ | ▨ | ▨ | ▨ | |
| 180 | | | ▨ | | | ▨ | ▨ | ▨ | ▨ | |
| 181 | ▨ | | ▨ | | | ▨ | ▨ | ▨ | ▨ | |
| 182 | | ▨ | ▨ | | | ▨ | ▨ | ▨ | ▨ | |
| 183 | ▨ | ▨ | ▨ | | | ▨ | ▨ | ▨ | ▨ | |
| 184 | | | | ▨ | | ▨ | ▨ | ▨ | ▨ | |
| 185 | ▨ | | | ▨ | | ▨ | ▨ | ▨ | ▨ | |
| 186 | | ▨ | | ▨ | | ▨ | ▨ | ▨ | ▨ | |
| 187 | ▨ | ▨ | | ▨ | | ▨ | ▨ | ▨ | ▨ | |
| 188 | | | ▨ | ▨ | | ▨ | ▨ | ▨ | ▨ | |
| 189 | ▨ | | ▨ | ▨ | | ▨ | ▨ | ▨ | ▨ | |
| 190 | | ▨ | ▨ | ▨ | | ▨ | ▨ | ▨ | ▨ | |
| 191 | ▨ | ▨ | ▨ | ▨ | | ▨ | ▨ | ▨ | ▨ | |

| RELATIVE LUMINANCE | SF1 | SF2 | SF3 | SF4 | SF5 | SF6 | SF7A | SF7B | SF7C | SF7D |
|---|---|---|---|---|---|---|---|---|---|---|
| 192 | | | | | ▨ | ▨ | ▨ | ▨ | ▨ | |
| 193 | ▨ | | | | ▨ | ▨ | ▨ | ▨ | ▨ | |
| 194 | | ▨ | | | ▨ | ▨ | ▨ | ▨ | ▨ | |
| 195 | ▨ | ▨ | | | ▨ | ▨ | ▨ | ▨ | ▨ | |
| 196 | | | ▨ | | ▨ | ▨ | ▨ | ▨ | ▨ | |
| 197 | ▨ | | ▨ | | ▨ | ▨ | ▨ | ▨ | ▨ | |
| 198 | | ▨ | ▨ | | ▨ | ▨ | ▨ | ▨ | ▨ | |
| 199 | ▨ | ▨ | ▨ | | ▨ | ▨ | ▨ | ▨ | ▨ | |
| 200 | | | | ▨ | ▨ | ▨ | ▨ | ▨ | ▨ | |
| 201 | ▨ | | | ▨ | ▨ | ▨ | ▨ | ▨ | ▨ | |
| 202 | | ▨ | | ▨ | ▨ | ▨ | ▨ | ▨ | ▨ | |
| 203 | ▨ | ▨ | | ▨ | ▨ | ▨ | ▨ | ▨ | ▨ | |
| 204 | | | ▨ | ▨ | ▨ | ▨ | ▨ | ▨ | ▨ | |
| 205 | ▨ | | ▨ | ▨ | ▨ | ▨ | ▨ | ▨ | ▨ | |
| 206 | | ▨ | ▨ | ▨ | ▨ | ▨ | ▨ | ▨ | ▨ | |
| 207 | ▨ | ▨ | ▨ | ▨ | ▨ | ▨ | ▨ | ▨ | ▨ | |
| 208 | | | | | ▨ | | ▨ | ▨ | ▨ | ▨ |
| 209 | ▨ | | | | ▨ | | ▨ | ▨ | ▨ | ▨ |
| 210 | | ▨ | | | ▨ | | ▨ | ▨ | ▨ | ▨ |
| 211 | ▨ | ▨ | | | ▨ | | ▨ | ▨ | ▨ | ▨ |
| 212 | | | ▨ | | ▨ | | ▨ | ▨ | ▨ | ▨ |
| 213 | ▨ | | ▨ | | ▨ | | ▨ | ▨ | ▨ | ▨ |
| 214 | | ▨ | ▨ | | ▨ | | ▨ | ▨ | ▨ | ▨ |
| 215 | ▨ | ▨ | ▨ | | ▨ | | ▨ | ▨ | ▨ | ▨ |
| 216 | | | | ▨ | ▨ | | ▨ | ▨ | ▨ | ▨ |
| 217 | ▨ | | | ▨ | ▨ | | ▨ | ▨ | ▨ | ▨ |
| 218 | | ▨ | | ▨ | ▨ | | ▨ | ▨ | ▨ | ▨ |
| 219 | ▨ | ▨ | | ▨ | ▨ | | ▨ | ▨ | ▨ | ▨ |
| 220 | | | ▨ | ▨ | ▨ | | ▨ | ▨ | ▨ | ▨ |
| 221 | ▨ | | ▨ | ▨ | ▨ | | ▨ | ▨ | ▨ | ▨ |
| 222 | | ▨ | ▨ | ▨ | ▨ | | ▨ | ▨ | ▨ | ▨ |
| 223 | ▨ | ▨ | ▨ | ▨ | ▨ | | ▨ | ▨ | ▨ | ▨ |
| 224 | | | | | | ▨ | ▨ | ▨ | ▨ | ▨ |
| 225 | ▨ | | | | | ▨ | ▨ | ▨ | ▨ | ▨ |
| 226 | | ▨ | | | | ▨ | ▨ | ▨ | ▨ | ▨ |
| 227 | ▨ | ▨ | | | | ▨ | ▨ | ▨ | ▨ | ▨ |
| 228 | | | ▨ | | | ▨ | ▨ | ▨ | ▨ | ▨ |
| 229 | ▨ | | ▨ | | | ▨ | ▨ | ▨ | ▨ | ▨ |
| 230 | | ▨ | ▨ | | | ▨ | ▨ | ▨ | ▨ | ▨ |
| 231 | ▨ | ▨ | ▨ | | | ▨ | ▨ | ▨ | ▨ | ▨ |
| 232 | | | | ▨ | | ▨ | ▨ | ▨ | ▨ | ▨ |
| 233 | ▨ | | | ▨ | | ▨ | ▨ | ▨ | ▨ | ▨ |
| 234 | | ▨ | | ▨ | | ▨ | ▨ | ▨ | ▨ | ▨ |
| 235 | ▨ | ▨ | | ▨ | | ▨ | ▨ | ▨ | ▨ | ▨ |
| 236 | | | ▨ | ▨ | | ▨ | ▨ | ▨ | ▨ | ▨ |
| 237 | ▨ | | ▨ | ▨ | | ▨ | ▨ | ▨ | ▨ | ▨ |
| 238 | | ▨ | ▨ | ▨ | | ▨ | ▨ | ▨ | ▨ | ▨ |
| 239 | ▨ | ▨ | ▨ | ▨ | | ▨ | ▨ | ▨ | ▨ | ▨ |
| 240 | | | | | ▨ | ▨ | ▨ | ▨ | ▨ | ▨ |
| 241 | ▨ | | | | ▨ | ▨ | ▨ | ▨ | ▨ | ▨ |
| 242 | | ▨ | | | ▨ | ▨ | ▨ | ▨ | ▨ | ▨ |
| 243 | ▨ | ▨ | | | ▨ | ▨ | ▨ | ▨ | ▨ | ▨ |
| 244 | | | ▨ | | ▨ | ▨ | ▨ | ▨ | ▨ | ▨ |
| 245 | ▨ | | ▨ | | ▨ | ▨ | ▨ | ▨ | ▨ | ▨ |
| 246 | | ▨ | ▨ | | ▨ | ▨ | ▨ | ▨ | ▨ | ▨ |
| 247 | ▨ | ▨ | ▨ | | ▨ | ▨ | ▨ | ▨ | ▨ | ▨ |
| 248 | | | | ▨ | ▨ | ▨ | ▨ | ▨ | ▨ | ▨ |
| 249 | ▨ | | | ▨ | ▨ | ▨ | ▨ | ▨ | ▨ | ▨ |
| 250 | | ▨ | | ▨ | ▨ | ▨ | ▨ | ▨ | ▨ | ▨ |
| 251 | ▨ | ▨ | | ▨ | ▨ | ▨ | ▨ | ▨ | ▨ | ▨ |
| 252 | | | ▨ | ▨ | ▨ | ▨ | ▨ | ▨ | ▨ | ▨ |
| 253 | ▨ | | ▨ | ▨ | ▨ | ▨ | ▨ | ▨ | ▨ | ▨ |
| 254 | | ▨ | ▨ | ▨ | ▨ | ▨ | ▨ | ▨ | ▨ | ▨ |
| 255 | ▨ | ▨ | ▨ | ▨ | ▨ | ▨ | ▨ | ▨ | ▨ | ▨ |

FIG.35

| RELATIVE LUMINANCE | SF1 | SF2 | SF3 | SF4 | SF5 | SF6 | SF7A | SF7B | SF7C | SF7D |
|---|---|---|---|---|---|---|---|---|---|---|
| 0 | | | | | | | | | | |
| 1 | ■ | | | | | | | | | |
| 2 | | ■ | | | | | | | | |
| 3 | ■ | ■ | | | | | | | | |
| 4 | | | ■ | | | | | | | |
| 5 | ■ | | ■ | | | | | | | |
| 6 | | ■ | ■ | | | | | | | |
| 7 | ■ | ■ | ■ | | | | | | | |
| 8 | | | | ■ | | | | | | |
| 9 | ■ | | | ■ | | | | | | |
| 10 | | ■ | | ■ | | | | | | |
| 11 | ■ | ■ | | ■ | | | | | | |
| 12 | | | ■ | ■ | | | | | | |
| 13 | ■ | | ■ | ■ | | | | | | |
| 14 | | ■ | ■ | ■ | | | | | | |
| 15 | ■ | ■ | ■ | ■ | | | | | | |
| 16 | | | | | ■ | | | | | |
| 17 | ■ | | | | ■ | | | | | |
| 18 | | ■ | | | ■ | | | | | |
| 19 | ■ | ■ | | | ■ | | | | | |
| 20 | | | ■ | | ■ | | | | | |
| 21 | ■ | | ■ | | ■ | | | | | |
| 22 | | ■ | ■ | | ■ | | | | | |
| 23 | ■ | ■ | ■ | | ■ | | | | | |
| 24 | | | | ■ | ■ | | | | | |
| 25 | ■ | | | ■ | ■ | | | | | |
| 26 | | ■ | | ■ | ■ | | | | | |
| 27 | ■ | ■ | | ■ | ■ | | | | | |
| 28 | | | ■ | ■ | ■ | | | | | |
| 29 | ■ | | ■ | ■ | ■ | | | | | |
| 30 | | ■ | ■ | ■ | ■ | | | | | |
| 31 | ■ | ■ | ■ | ■ | ■ | | | | | |
| 32 | | | | | | ■ | | | | |
| 33 | ■ | | | | | ■ | | | | |
| 34 | | ■ | | | | ■ | | | | |
| 35 | ■ | ■ | | | | ■ | | | | |
| 36 | | | ■ | | | ■ | | | | |
| 37 | ■ | | ■ | | | ■ | | | | |
| 38 | | ■ | ■ | | | ■ | | | | |
| 39 | ■ | ■ | ■ | | | ■ | | | | |
| 40 | | | | ■ | | ■ | | | | |
| 41 | ■ | | | ■ | | ■ | | | | |
| 42 | | ■ | | ■ | | ■ | | | | |
| 43 | ■ | ■ | | ■ | | ■ | | | | |
| 44 | | | ■ | ■ | | ■ | | | | |
| 45 | ■ | | ■ | ■ | | ■ | | | | |
| 46 | | ■ | ■ | ■ | | ■ | | | | |
| 47 | ■ | ■ | ■ | ■ | | ■ | | | | |
| 48 | | | | | | | | ■ | | |
| 49 | ■ | | | | | | | ■ | | |
| 50 | | ■ | | | | | | ■ | | |
| 51 | ■ | ■ | | | | | | ■ | | |
| 52 | | | ■ | | | | | ■ | | |
| 53 | ■ | | ■ | | | | | ■ | | |
| 54 | | ■ | ■ | | | | | ■ | | |
| 55 | ■ | ■ | ■ | | | | | ■ | | |
| 56 | | | | ■ | | | | ■ | | |
| 57 | ■ | | | ■ | | | | ■ | | |
| 58 | | ■ | | ■ | | | | ■ | | |
| 59 | ■ | ■ | | ■ | | | | ■ | | |
| 60 | | | ■ | ■ | | | | ■ | | |
| 61 | ■ | | ■ | ■ | | | | ■ | | |
| 62 | | ■ | ■ | ■ | | | | ■ | | |
| 63 | ■ | ■ | ■ | ■ | | | | ■ | | |

| RELATIVE LUMINANCE | SF1 | SF2 | SF3 | SF4 | SF5 | SF6 | SF7A | SF7B | SF7C | SF7D |
|---|---|---|---|---|---|---|---|---|---|---|
| 64 | | | | | ■ | | | ■ | | |
| 65 | ■ | | | | ■ | | | ■ | | |
| 66 | | ■ | | | ■ | | | ■ | | |
| 67 | ■ | ■ | | | ■ | | | ■ | | |
| 68 | | | ■ | | ■ | | | ■ | | |
| 69 | ■ | | ■ | | ■ | | | ■ | | |
| 70 | | ■ | ■ | | ■ | | | ■ | | |
| 71 | ■ | ■ | ■ | | ■ | | | ■ | | |
| 72 | | | | ■ | ■ | | | ■ | | |
| 73 | ■ | | | ■ | ■ | | | ■ | | |
| 74 | | ■ | | ■ | ■ | | | ■ | | |
| 75 | ■ | ■ | | ■ | ■ | | | ■ | | |
| 76 | | | ■ | ■ | ■ | | | ■ | | |
| 77 | ■ | | ■ | ■ | ■ | | | ■ | | |
| 78 | | ■ | ■ | ■ | ■ | | | ■ | | |
| 79 | ■ | ■ | ■ | ■ | ■ | | | ■ | | |
| 80 | | | | | | ■ | | ■ | | |
| 81 | ■ | | | | | ■ | | ■ | | |
| 82 | | ■ | | | | ■ | | ■ | | |
| 83 | ■ | ■ | | | | ■ | | ■ | | |
| 84 | | | ■ | | | ■ | | ■ | | |
| 85 | ■ | | ■ | | | ■ | | ■ | | |
| 86 | | ■ | ■ | | | ■ | | ■ | | |
| 87 | ■ | ■ | ■ | | | ■ | | ■ | | |
| 88 | | | | ■ | | ■ | | ■ | | |
| 89 | ■ | | | ■ | | ■ | | ■ | | |
| 90 | | ■ | | ■ | | ■ | | ■ | | |
| 91 | ■ | ■ | | ■ | | ■ | | ■ | | |
| 92 | | | ■ | ■ | | ■ | | ■ | | |
| 93 | ■ | | ■ | ■ | | ■ | | ■ | | |
| 94 | | ■ | ■ | ■ | | ■ | | ■ | | |
| 95 | ■ | ■ | ■ | ■ | | ■ | | ■ | | |
| 96 | | | | | | | ■ | ■ | | |
| 97 | ■ | | | | | | ■ | ■ | | |
| 98 | | ■ | | | | | ■ | ■ | | |
| 99 | ■ | ■ | | | | | ■ | ■ | | |
| 100 | | | ■ | | | | ■ | ■ | | |
| 101 | ■ | | ■ | | | | ■ | ■ | | |
| 102 | | ■ | ■ | | | | ■ | ■ | | |
| 103 | ■ | ■ | ■ | | | | ■ | ■ | | |
| 104 | | | | ■ | | | ■ | ■ | | |
| 105 | ■ | | | ■ | | | ■ | ■ | | |
| 106 | | ■ | | ■ | | | ■ | ■ | | |
| 107 | ■ | ■ | | ■ | | | ■ | ■ | | |
| 108 | | | ■ | ■ | | | ■ | ■ | | |
| 109 | ■ | | ■ | ■ | | | ■ | ■ | | |
| 110 | | ■ | ■ | ■ | | | ■ | ■ | | |
| 111 | ■ | ■ | ■ | ■ | | | ■ | ■ | | |
| 112 | | | | | ■ | | ■ | ■ | | |
| 113 | ■ | | | | ■ | | ■ | ■ | | |
| 114 | | ■ | | | ■ | | ■ | ■ | | |
| 115 | ■ | ■ | | | ■ | | ■ | ■ | | |
| 116 | | | ■ | | ■ | | ■ | ■ | | |
| 117 | ■ | | ■ | | ■ | | ■ | ■ | | |
| 118 | | ■ | ■ | | ■ | | ■ | ■ | | |
| 119 | ■ | ■ | ■ | | ■ | | ■ | ■ | | |
| 120 | | | | ■ | ■ | | ■ | ■ | | |
| 121 | ■ | | | ■ | ■ | | ■ | ■ | | |
| 122 | | ■ | | ■ | ■ | | ■ | ■ | | |
| 123 | ■ | ■ | | ■ | ■ | | ■ | ■ | | |
| 124 | | | ■ | ■ | ■ | | ■ | ■ | | |
| 125 | ■ | | ■ | ■ | ■ | | ■ | ■ | | |
| 126 | | ■ | ■ | ■ | ■ | | ■ | ■ | | |
| 127 | ■ | ■ | ■ | ■ | ■ | | ■ | ■ | | |

FIG.36

| RELATIVE LUMINANCE | SF1 | SF2 | SF3 | SF4 | SF5 | SF6 | SF7A | SF7B | SF7C | SF7D |
|---|---|---|---|---|---|---|---|---|---|---|
| 128 | | | | | | ■ | ■ | ■ | | |
| 129 | ■ | | | | | ■ | ■ | ■ | | |
| 130 | | ■ | | | | ■ | ■ | ■ | | |
| 131 | ■ | ■ | | | | ■ | ■ | ■ | | |
| 132 | | | ■ | | | ■ | ■ | ■ | | |
| 133 | ■ | | ■ | | | ■ | ■ | ■ | | |
| 134 | | ■ | ■ | | | ■ | ■ | ■ | | |
| 135 | ■ | ■ | ■ | | | ■ | ■ | ■ | | |
| 136 | | | | ■ | | ■ | ■ | ■ | | |
| 137 | ■ | | | ■ | | ■ | ■ | ■ | | |
| 138 | | ■ | | ■ | | ■ | ■ | ■ | | |
| 139 | ■ | ■ | | ■ | | ■ | ■ | ■ | | |
| 140 | | | ■ | ■ | | ■ | ■ | ■ | | |
| 141 | ■ | | ■ | ■ | | ■ | ■ | ■ | | |
| 142 | | ■ | ■ | ■ | | ■ | ■ | ■ | | |
| 143 | ■ | ■ | ■ | ■ | | ■ | ■ | ■ | | |
| 144 | | | | | | | ■ | ■ | ■ | |
| 145 | ■ | | | | | | ■ | ■ | ■ | |
| 146 | | ■ | | | | | ■ | ■ | ■ | |
| 147 | ■ | ■ | | | | | ■ | ■ | ■ | |
| 148 | | | ■ | | | | ■ | ■ | ■ | |
| 149 | ■ | | ■ | | | | ■ | ■ | ■ | |
| 150 | | ■ | ■ | | | | ■ | ■ | ■ | |
| 151 | ■ | ■ | ■ | | | | ■ | ■ | ■ | |
| 152 | | | | ■ | | | ■ | ■ | ■ | |
| 153 | ■ | | | ■ | | | ■ | ■ | ■ | |
| 154 | | ■ | | ■ | | | ■ | ■ | ■ | |
| 155 | ■ | ■ | | ■ | | | ■ | ■ | ■ | |
| 156 | | | ■ | ■ | | | ■ | ■ | ■ | |
| 157 | ■ | | ■ | ■ | | | ■ | ■ | ■ | |
| 158 | | ■ | ■ | ■ | | | ■ | ■ | ■ | |
| 159 | ■ | ■ | ■ | ■ | | | ■ | ■ | ■ | |
| 160 | | | | | ■ | | ■ | ■ | ■ | |
| 161 | ■ | | | | ■ | | ■ | ■ | ■ | |
| 162 | | ■ | | | ■ | | ■ | ■ | ■ | |
| 163 | ■ | ■ | | | ■ | | ■ | ■ | ■ | |
| 164 | | | ■ | | ■ | | ■ | ■ | ■ | |
| 165 | ■ | | ■ | | ■ | | ■ | ■ | ■ | |
| 166 | | ■ | ■ | | ■ | | ■ | ■ | ■ | |
| 167 | ■ | ■ | ■ | | ■ | | ■ | ■ | ■ | |
| 168 | | | | ■ | ■ | | ■ | ■ | ■ | |
| 169 | ■ | | | ■ | ■ | | ■ | ■ | ■ | |
| 170 | | ■ | | ■ | ■ | | ■ | ■ | ■ | |
| 171 | ■ | ■ | | ■ | ■ | | ■ | ■ | ■ | |
| 172 | | | ■ | ■ | ■ | | ■ | ■ | ■ | |
| 173 | ■ | | ■ | ■ | ■ | | ■ | ■ | ■ | |
| 174 | | ■ | ■ | ■ | ■ | | ■ | ■ | ■ | |
| 175 | ■ | ■ | ■ | ■ | ■ | | ■ | ■ | ■ | |
| 176 | | | | | | ■ | ■ | ■ | ■ | |
| 177 | ■ | | | | | ■ | ■ | ■ | ■ | |
| 178 | | ■ | | | | ■ | ■ | ■ | ■ | |
| 179 | ■ | ■ | | | | ■ | ■ | ■ | ■ | |
| 180 | | | ■ | | | ■ | ■ | ■ | ■ | |
| 181 | ■ | | ■ | | | ■ | ■ | ■ | ■ | |
| 182 | | ■ | ■ | | | ■ | ■ | ■ | ■ | |
| 183 | ■ | ■ | ■ | | | ■ | ■ | ■ | ■ | |
| 184 | | | | ■ | | ■ | ■ | ■ | ■ | |
| 185 | ■ | | | ■ | | ■ | ■ | ■ | ■ | |
| 186 | | ■ | | ■ | | ■ | ■ | ■ | ■ | |
| 187 | ■ | ■ | | ■ | | ■ | ■ | ■ | ■ | |
| 188 | | | ■ | ■ | | ■ | ■ | ■ | ■ | |
| 189 | ■ | | ■ | ■ | | ■ | ■ | ■ | ■ | |
| 190 | | ■ | ■ | ■ | | ■ | ■ | ■ | ■ | |
| 191 | ■ | ■ | ■ | ■ | | ■ | ■ | ■ | ■ | |

| RELATIVE LUMINANCE | SF1 | SF2 | SF3 | SF4 | SF5 | SF6 | SF7A | SF7B | SF7C | SF7D |
|---|---|---|---|---|---|---|---|---|---|---|
| 192 | | | | | | | ■ | ■ | ■ | ■ |
| 193 | ■ | | | | | | ■ | ■ | ■ | ■ |
| 194 | | ■ | | | | | ■ | ■ | ■ | ■ |
| 195 | ■ | ■ | | | | | ■ | ■ | ■ | ■ |
| 196 | | | ■ | | | | ■ | ■ | ■ | ■ |
| 197 | ■ | | ■ | | | | ■ | ■ | ■ | ■ |
| 198 | | ■ | ■ | | | | ■ | ■ | ■ | ■ |
| 199 | ■ | ■ | ■ | | | | ■ | ■ | ■ | ■ |
| 200 | | | | ■ | | | ■ | ■ | ■ | ■ |
| 201 | ■ | | | ■ | | | ■ | ■ | ■ | ■ |
| 202 | | ■ | | ■ | | | ■ | ■ | ■ | ■ |
| 203 | ■ | ■ | | ■ | | | ■ | ■ | ■ | ■ |
| 204 | | | ■ | ■ | | | ■ | ■ | ■ | ■ |
| 205 | ■ | | ■ | ■ | | | ■ | ■ | ■ | ■ |
| 206 | | ■ | ■ | ■ | | | ■ | ■ | ■ | ■ |
| 207 | ■ | ■ | ■ | ■ | | | ■ | ■ | ■ | ■ |
| 208 | | | | | ■ | | ■ | ■ | ■ | ■ |
| 209 | ■ | | | | ■ | | ■ | ■ | ■ | ■ |
| 210 | | ■ | | | ■ | | ■ | ■ | ■ | ■ |
| 211 | ■ | ■ | | | ■ | | ■ | ■ | ■ | ■ |
| 212 | | | ■ | | ■ | | ■ | ■ | ■ | ■ |
| 213 | ■ | | ■ | | ■ | | ■ | ■ | ■ | ■ |
| 214 | | ■ | ■ | | ■ | | ■ | ■ | ■ | ■ |
| 215 | ■ | ■ | ■ | | ■ | | ■ | ■ | ■ | ■ |
| 216 | | | | ■ | ■ | | ■ | ■ | ■ | ■ |
| 217 | ■ | | | ■ | ■ | | ■ | ■ | ■ | ■ |
| 218 | | ■ | | ■ | ■ | | ■ | ■ | ■ | ■ |
| 219 | ■ | ■ | | ■ | ■ | | ■ | ■ | ■ | ■ |
| 220 | | | ■ | ■ | ■ | | ■ | ■ | ■ | ■ |
| 221 | ■ | | ■ | ■ | ■ | | ■ | ■ | ■ | ■ |
| 222 | | ■ | ■ | ■ | ■ | | ■ | ■ | ■ | ■ |
| 223 | ■ | ■ | ■ | ■ | ■ | | ■ | ■ | ■ | ■ |
| 224 | | | | | | ■ | ■ | ■ | ■ | ■ |
| 225 | ■ | | | | | ■ | ■ | ■ | ■ | ■ |
| 226 | | ■ | | | | ■ | ■ | ■ | ■ | ■ |
| 227 | ■ | ■ | | | | ■ | ■ | ■ | ■ | ■ |
| 228 | | | ■ | | | ■ | ■ | ■ | ■ | ■ |
| 229 | ■ | | ■ | | | ■ | ■ | ■ | ■ | ■ |
| 230 | | ■ | ■ | | | ■ | ■ | ■ | ■ | ■ |
| 231 | ■ | ■ | ■ | | | ■ | ■ | ■ | ■ | ■ |
| 232 | | | | ■ | | ■ | ■ | ■ | ■ | ■ |
| 233 | ■ | | | ■ | | ■ | ■ | ■ | ■ | ■ |
| 234 | | ■ | | ■ | | ■ | ■ | ■ | ■ | ■ |
| 235 | ■ | ■ | | ■ | | ■ | ■ | ■ | ■ | ■ |
| 236 | | | ■ | ■ | | ■ | ■ | ■ | ■ | ■ |
| 237 | ■ | | ■ | ■ | | ■ | ■ | ■ | ■ | ■ |
| 238 | | ■ | ■ | ■ | | ■ | ■ | ■ | ■ | ■ |
| 239 | ■ | ■ | ■ | ■ | | ■ | ■ | ■ | ■ | ■ |
| 240 | | | | | ■ | ■ | ■ | ■ | ■ | ■ |
| 241 | ■ | | | | ■ | ■ | ■ | ■ | ■ | ■ |
| 242 | | ■ | | | ■ | ■ | ■ | ■ | ■ | ■ |
| 243 | ■ | ■ | | | ■ | ■ | ■ | ■ | ■ | ■ |
| 244 | | | ■ | | ■ | ■ | ■ | ■ | ■ | ■ |
| 245 | ■ | | ■ | | ■ | ■ | ■ | ■ | ■ | ■ |
| 246 | | ■ | ■ | | ■ | ■ | ■ | ■ | ■ | ■ |
| 247 | ■ | ■ | ■ | | ■ | ■ | ■ | ■ | ■ | ■ |
| 248 | | | | ■ | ■ | ■ | ■ | ■ | ■ | ■ |
| 249 | ■ | | | ■ | ■ | ■ | ■ | ■ | ■ | ■ |
| 250 | | ■ | | ■ | ■ | ■ | ■ | ■ | ■ | ■ |
| 251 | ■ | ■ | | ■ | ■ | ■ | ■ | ■ | ■ | ■ |
| 252 | | | ■ | ■ | ■ | ■ | ■ | ■ | ■ | ■ |
| 253 | ■ | | ■ | ■ | ■ | ■ | ■ | ■ | ■ | ■ |
| 254 | | ■ | ■ | ■ | ■ | ■ | ■ | ■ | ■ | ■ |
| 255 | ■ | ■ | ■ | ■ | ■ | ■ | ■ | ■ | ■ | ■ |

METHOD FOR DRIVING PLASMA DISPLAY PANEL

BACKGROUND OF THE INVENTION

1. Field of the Invention

The present invention relates to a method for driving an AC-type plasma display panel (hereinafter referred to as an AC-PDP), more particularly, a surface-discharge type AC-PDP.

2. Description of the Background Art

As is well known, plasma display panels have two sheets of glass and small discharge cells (pixels) arranged therebetween, which are studied in various ways as thin-type television or display monitors. Known plasma display panels include AC-type plasma display panels (AC-PDPs) having a memory function. The AC-PDPs include surface-discharge type AC-PDPs. FIG. 38 is a perspective view showing the structure of a surface-discharge type AC-PDP. Japanese Patent Aplication No. 7-140922 and Japanese Patent Aplication No. 7-287548, for example, show surface-discharge type AC-PDPs having structure like this. In the diagram, the surface-discharge type plasma display panel 1 includes a front glass substrate 2 serving as a display face, a rear glass substrate 3 provided opposite to the front glass substrate 2 with a discharge space interposed therebetween, first row electrodes 4(X1–Xn) and second row electrodes 5(Y1–Yn) formed in pairs on the front glass substrate, a dielectric layer 6 covering the first and second row electrodes 4 and 5, an MgO (magnesium oxide) layer 7 formed on the dielectric layer 6 by deposition or the like, column electrodes 8(W1–Wm) formed perpendicular to the first and second row electrodes 4 and 5 on the rear glass substrate 3, phosphor layers 9 formed over the column electrodes 8 in order like stripes to emit red, green, and blue lights for the respective column electrodes 8, and partitions 10 formed between the column electrodes 8, 8 to separate the discharge cells and also to prevent the PDP from being broken by atmospheric pressure. The space between the glass substrates 2 and 3 is filled with a discharge gas, such as an Ne—Xe mixture gas or an He—Xe mixture gas, at a pressure not higher than atmospheric pressure. The discharge cells serving as pixels are formed at intersections of the pairs of the row electrodes 4, 5 and the column electrodes 8 perpendicular to the row electrodes 4, 5. Hereinafter the first row electrodes may be referred to as X electrodes, the second row electrodes as Y electrodes, and the column electrodes as W electrodes.

Next, its operation will be described. Voltage pulses are alternately applied between the first row electrodes 4 and the second row electrodes 5 to cause discharge with its polarity inverted for each half cycle to cause the cells to emit light. In color display, the phosphor layers 9 formed in the individual cells are excited by ultraviolet rays generated by the discharge and emit light. The first row electrodes 4 and the second row electrodes 5 that discharge for display are covered with the dielectric layer 6. Accordingly, once discharge occurs between the electrodes in cells, electrons and ions produced in the discharge space move in the direction of the applied voltage, and are accumulated on the dielectric layer 6. The charge of the electrons and ions accumulated on the dielectric layer are called wall charge. The electric field formed by the wall charge acts to weaken the applied electric field, and the discharge therefore rapidly disappears as the wall charge forms. After the discharge has disappeared, electric field having reverse polarity to that of the preceding discharge is applied, and then the electric field formed by wall charge and the applied electric field overlap, which allows discharge to occur at lower voltage than the preceding discharge. Subsequently, this lower voltage is inverted for each half cycle to sustain the discharge. The AC-PDP originally has this function, which is called a memory function. The discharge sustained at lower voltage with the aid of the memory function is called discharge sustain, and the voltage pulses applied to the first row electrodes 4 and the second row electrodes 5 for each half cycle are called sustain pulses. This discharge sustain lasts until the wall charge disappears, as long as the sustain pulses are applied. Eliminating the wall charge is called erasing and forming the wall charge on the dielectric layer in the first place is called writing.

Next, tonal display by the AC-PDP will be described briefly. FIG. 39 is a diagram showing the structure of one field in tonal display shown in Japanese Patent Aplication No. 7-160218, for example. One field is a time for output of one complete screen of picture, which is about 16.7 mS (60 Hz) in NTSC. In the drawing, the display lines correspond to the lines formed of the first and second row electrodes in the row direction in the AC-PDP. The lateral direction in the drawing shows passage of time. One field includes some subfields, and each of the subfields includes a reset period, an address period, and a discharge sustain period. For example, in display with 256 tones, one field includes eight subfields having respective discharge sustain periods with proportions of powers of 2, such as 1, 2, 4, 8, 16, 32, 64, 128. Although the entirety of one field shown in FIG. 39 is utilized as reset periods, address periods and discharge sustain periods, these periods may be uniformly distributed in one field with another type of periods, or may be compressed somewhere in one field.

FIG. 40 shows voltage waveforms in one subfield in the conventional method for driving a plasma display panel shown in Japanese Patent Aplication No. 7-160218, for example. In this conventional example, the first row electrodes X are connected in common, so that the same voltage is applied to all the first row electrodes X. The second row electrodes Y and the column electrodes W allow separate application of voltages to the individual lines. FIG. 40 shows voltage waveforms to a column electrode Wj, the first row electrodes X, and the second row electrodes Y1, Y2, Yn, from the top.

First, the reset period is a period for bringing all cells in the AC-type plasma display into the same state, in which an entire-face write pulse Pxp (priming pulse) is applied to the first row electrodes X connected in common in the entire screen at time "ta" at the beginning of the reset period in FIG. 40. This entire-face write pulse Pxp is set equal to or higher than the discharge starting voltage between the first row electrodes X and the second row electrodes Y so that all cells discharge and emit light independently of whether they emitted light or not in the preceding subfield. At this time, a voltage pulse is applied also to the column electrodes W to reduce potential difference between the X and W electrodes so that discharge will not readily occur between the first row electrodes X and the column electrodes W, which is approximately set at half of the voltage between the X and Y electrodes. It is not essential to apply this pulse. The application of the entire-face write pulse Pxp between the X and Y electrodes causes strong discharge between X and Y, so that a large amount of wall charge is accumulated between the X and Y electrodes, and the discharge ends. Next, at time "tb" in FIG. 40, the entire-face write pulse Pxp falls. When the voltage disappears between the first row electrodes X and the second row electrodes Y, the electric field by the wall charge accumulated by the entire-face write pulse Pxp is left between the X and Y electrodes. This electric field is so large as to start discharge by itself, and thus discharge takes place again between the X-Y electrodes. However, since no external voltage is applied, electrons and ions caused in this discharge are neutralized and disappear, without being attracted to the row electrodes X and Y. Thus, it is possible to bring all cells into a state with no wall charge for reset, by writing and erasing all cells independently of presence/absence of wall charge in the preceding subfield. The discharge caused by the accumulated wall charge without application of external voltage and erasing the wall charge is called self-erasing discharge.

When the reset period ends, at time "tc" in FIG. 40, almost no wall charge is left over the first row electrodes and second row electrodes. On the other hand, in the discharge cells, charged particles produced by the discharge with the previous entire-face write pulse Pxp are left. The charged particles, serving as priming for write discharge, ensure discharge in the following write operation. The entire-face write pulse Pxp may therefore be called a priming pulse. Accordingly, one pulse provides both of a priming effect and an erasing effect.

In the write address period, negative scanning pulses Scyp are applied to the independent second row electrodes Y1 to Yn in this order for scanning. The column electrodes W are supplied with positive address pulses Awp corresponding to contents of image data. The scanning pulses Scyp applied to the second row electrodes Y and the address pulses Awp applied to the column electrodes W allow matrix-selection of arbitrary cells in the screen. The total voltage of the scanning pulse Scyp and address pulse Awp is set not lower than the discharge starting voltage between the Y-W electrodes in cells, so that cells simultaneously supplied with the scanning pulse Scyp and the address pulse Awp discharge between the Y and W electrodes. The common first row electrodes X are kept at positive voltage during the address period. This voltage value is set so that it does not induce discharge between the X and Y electrodes even if it overlaps with the voltage value of the scanning pulse Scyp, but so that when discharge occurs between the Y and W electrodes, the discharge between the Y and W electrodes can trigger discharge between the X and Y electrodes at the same time. The discharge between the X and Y electrodes triggered by discharge between the Y and W electrodes may be called write discharge sustain. The write discharge sustain accumulates wall charge over the first and second row electrodes.

After the entire screen has been scanned, a sustain pulse Sp is applied to the entire screen all at once, so that only the cells having wall charge accumulated in the address period make discharge sustain. After discharge sustain has been produced for a given number of times, the next subfield starts. In the reset period, the entire-face write pulse Pxp is applied to all cells for reset. Thus, all cells are made to discharge at the beginning of each subfield and to accumulate wall charge, and then the wall charge in all cells are erased for reset by self-erasing discharge, so that the address write can always be performed in the same condition.

The driving method in which the write address periods and the discharge sustain periods are separated in the entire screen of an AC-type plasma display as described above is called an "address/display (sustain) separating method." Since the above-described entire-face write is performed in given cycles independently of display information, it reduces the contrast. For example, it causes the screen to be seen somewhat white in black display. It is not necessarily required that the entire-face write be performed for each subfield, since its priming effect lasts for a relatively long time. There are methods for improving the contrast by lighting the entire face for a reduced number of times for each field.

FIG. 41 is a diagram showing voltage waveforms in one subfield in the method for driving a plasma display described in Japanese Patent Aplication No. 8-278766. In the drawing, although the pulse Pxp applied in the reset period is set at discharge starting voltage between the first row electrodes X and the second row electrodes Y similarly to that shown in FIG. 40, its pulse width is as short as about 1 $\mu$S. This driving method utilizes the characteristic of PDP that when a voltage pulse exceeding discharge starting voltage is applied to electrodes, the time from the moment the pulse rises to the moment discharge starts, or the discharge delay time, largely differs depending on presence/absence of the wall charge that acts while being superimposed upon Pxp. Although it depends on the cell structure and the kind of the entrapped gas, the discharge delay time is typically 0.1 to 0.6 $\mu$S in the presence of wall charge, and is larger than 1.0 $\mu$S in the absence of wall charge. When Pxp with a pulse width of 1 $\mu$S is applied, it is possible to selectively reset only the cells that were lit in the preceding subfield.

With the use of this driving method, it is possible to entirely write/reset with Pxp having a larger pulse width shown in FIG. 40 in certain subfields in one field and selectively light/reset with Pxp having a smaller pulse width shown in FIG. 41 in remaining subfields, so as to reduce the number of times the entire screen is lit in one field, which suppresses luminance in black display.

In FIG. 41, the subfields are separated into subfields in which the entire face is written and subfields in which cells lit in the previous subfields are selectively lit by using pulses having such a high voltage as can induce discharge even in the absence of wall charge and controlling the pulse width. However, the subfields can be separated by setting the voltage value of Pxp so that the discharge starting voltage is exceeded only in the cells having wall charge. (Hereinafter, referred to as an erase pulse Exp in this case.) In this case, it may be called a small-width erase pulse or a large-width erase pulse, depending on the pulse width of Exp. Although the small-width erasing and large-width erasing are not described in detail herein since they are known to AC-PDP engineers, the contents are described in "Plasma Display" (Kenichi Owaki, et al. Kyoritsu Shuppan, 1983), for example. The small-width erase pulse has a voltage value around that of the sustain pulse and a pulse width of about 0.5 $\mu$S. Application of this pulse erases wall charge since the pulse is interrupted in the progress of discharge, that is, before wall charge of reverse polarity forms.

Japanese Patent Aplication No. 7-49663 describes another method for suppressing brightness in black display. FIG. 42 shows the method for driving a plasma display described in Japanese Aplication No. 7-49663. One field includes a plurality of subfield groups each including one entire-face write/reset period, a plurality of discharge sustain periods with equal luminance level, and address write periods corresponding to the discharge sustain periods. In the drawing, SF1A, SF1B, and SF1C, SF2A, SF2B, and SF2C, and SF3A, SF3B, and SF3C form the respective independent subfield groups. FIG. 43 is a diagram showing light-emitting pattern in the subfield group including SF1A, SF1B, SF1C, among the subfield groups above. In the case of the relative luminance level 48, write address processing is performed in the first write period, and light is emitted in all of the periods SF1A, SF1B, SF1C. In the case of the relative luminance level of 32, write address processing is performed in the second write period and light is emitted in SF1B, SF1C. In the case of the relative luminance level 16, write address processing is performed in the third write period and light is emitted only in SF1C. It is thus possible to display a plurality of luminance tones with a single entire-face write/reset period and a plurality of write address periods. This allows reduction in the number of times the entire face is written/reset in one field, which suppresses luminance in black display.

In the conventional method for driving a plasma display, if it has 480 lines of row electrodes, for example, the electrode on the first line is not made to generate discharge sustain after it has been scanned for write address until the electrode on the 480th line has been scanned. Accordingly, only a limited time can be used for discharge sustain. Then, for causing discharge sustain an increased number of times, it is necessary to increase the frequency of the discharge sustain, or reduce the pulse width of signal in the write address periods, or to reduce the number of subfields. Increasing the frequency of discharge sustain reduces the luminous efficiency in discharge. Shortening the pulse width of signal in write address periods reduces the write margin, and then imperfect writing of address data will deteriorate the picture quality. Further, reducing the number of subfields reduces the number of displayable tones, reducing the display performance.

Further, with a plasma display panel with higher definition, the increased number of display lines require increased write time of address data. Then it is necessary to further increase the discharge sustain frequency, shorten the pulse width of signal in write address periods, or to reduce the number of subfields. In order to avoid reduction in the number of subfields, there are methods in which the column electrodes are divided into upper and lower halves, and address data is written for every two lines, so as to shorten the address periods. However, this complicates the structure of the panel. Moreover, this requires a driver IC for driving doubled column electrodes, which increases the cost of the panel.

If the number of times of the entire-face write/reset is extremely reduced to suppress luminance in black display, address data will be defectively written to considerably deteriorate the picture quality.

Further, for the purpose of suppressing luminance in black display, if the number of times of writing address is increased, the time for discharge sustain is reduced. Then, it is necessary to increase the discharge sustain frequency, or reduce the pulse width of signal in write address periods, or to reduce the number of subfields.

Further, as described above, a PDP makes tonal display with one field divided into a plurality of subfields with different weights of luminance information. In such a method for tonal display, the light-emitting timing in one field differs depending on the luminance level to be displayed. Accordingly, when moving picture, more specifically, picture with smoothly varying luminance level moves on the screen in the direction of change of the luminance level, bands like stripes are seen, which are not seen when the picture is standing still. This problem is called pseudo contouring of moving picture. The mechanism of occurrence of this problem is specifically explained in "Modern Technology of Plasma Display" (Shigeo Mikoshiba, ED Research, 1996), for example, which suggests that this phenomenon relates to evenness in time in the light-emitting pattern in one field. FIG. 44 shows light-emitting pattern in a conventional plasma display panel driving method. As shown in the drawing, the center of emission is located in different positions in one field between the relative luminance levels 128 and 127, causing lack of evenness in time in the light-emitting pattern.

FIG. 45 shows an example of moving picture, more specifically, a smoothly changing picture moving from left to right on the screen, in a conventional plasma display panel driving method. In the drawing, the horizontal axis shows the position on the screen and the vertical axis shows time. In the first field, the discharge cells A and B display the relative luminance level 128 and the discharge cells C to G display the relative luminance level 127. Subsequently, it moves to the right, one pixel for every two fields. In this case, the eyes of a man unconsciously fallow the moving picture, as shown by the broken lines. FIG. 45 can be rewritten as shown in FIG. 46 on the horizontal axis showing positions on the retina. Shown in the bottom in FIG. 46 is the amount of stimulus with respect to the position on the retina, where the relative luminance level 128 is sensed between a and "b" and the relative luminance level 127 is sensed between "c" and "d," with a less perceptible area existing between "b" and "c." This area is sensed as a pseudo contour of the moving picture.

It is known that the problem of pseudo contouring of moving picture can be lightened by compressing the luminance information in one field, or by dividing a subfield having the most heavily weighted luminance information and dispersing them in the field, for example. However, either of the methods above reduces time utilization efficiency in a field or increases the number of subfields, which necessitates shortening the pulse width of signal in address write periods or increasing the frequency of discharge sustain. Then, as stated before, the luminous efficiency in discharge is reduced or the margin is reduced, leading to deterioration of picture quality.

SUMMARY OF THE INVENTION

A first aspect of the present invention is directed to a method for driving a plasma display panel using a subfield method in which tonal display is made with one field divided into a plurality of subfields for image display in a predetermined screen. Each of the plurality of subfields has an address period in which a cell on the predetermined screen can be selected on the basis of a specified address and a sustained discharge period. A display can be made in the predetermined screen by light-emitting processing with discharge produced for a specified number of times. According to the present invention, the plasma display panel driving method comprises a, assigning a light-emitting subfield group comprising two or more successive subfields including a predetermined subfield of the plurality of subfields according to a luminance level to be displayed; and emitting light in the respective sustained discharge periods in the subfields forming the light-emitting subfield group.

Preferably, according to a second aspect, in the plasma display panel driving method, and the light emission assigning step comprises the step of assigning the light-emitting subfield group from a common subfield so that the temporal center of emission in the light-emitting subfield group is positioned in the vicinity of the temporal center of the common subfield.

Preferably, according to a third aspect, in the plasma display panel driving method, the light-emitting subfield group comprises a plurality of light-emitting subfield groups, and in the light emission assigning step, when displaying with the at least part of the display luminance levels, the plurality of light-emitting subfield groups are assigned while being switched according to a predetermined procedure.

Preferably, according to a fourth aspect, in the plasma display panel driving method, the plurality of light-emitting subfield groups comprise a first light-emitting subfield group and a second light-emitting subfield group, the first light-emitting subfield group having its temporal center of emission shifted in a first direction from the center position in the common subfield, the second light-emitting subfield group having its temporal center of emission shifted in a second direction opposite to the first direction from the center position in the common subfield, and wherein the predetermined procedure comprises the procedure of alternately switching the first light-emitting subfield group and the second light-emitting subfield group for each field period.

Preferably, according to a fifth aspect, in the plasma display panel driving method, the plurality of light-emitting subfield groups comprise a first light-emitting subfield group and a second light-emitting subfield group, the first light-emitting subfield group having its temporal center of emission shifted in a first direction from the center position in the common subfield, the second light-emitting subfield group having its temporal center of emission shifted in a second direction opposite to the first direction from the center position in the common subfield, and wherein the predetermined procedure comprises the procedure of switching the first light-emitting subfield group and the second light-emitting subfield group for each predetermined display unit on the predetermined screen.

Preferably, according to a sixth aspect, in the plasma display panel driving method, the address periods comprise a write address period for applying a rite operation to a display cell selected by write addressing, and an erase address period for applying an erase operation to a non-display cell selected by erase addressing. If and wherein with the light-emitting subfield group comprising first to th ($n \geqq 2$) subfields, the light emitting step comprises the step of performing the write operation with the write address period set in the first subfield, performing the erase operation with the erase address period set in a subfield following the nth subfield and not included in the light-emitting subfield group, and causing light emission in the sustained discharge sustained periods in the first to the nth subfields.

A seventh aspect of the present invention is directed to a method for driving a plasma display panel having a structure in which at least one electrode is covered with a dielectric. A tonal display is made with one field divided into a plurality of subfields for image display on a predetermined screen. Each of the plurality of subfields comprises an address period in which a cell on the predetermined screen can be selected on the basis of a specified address and a sustained discharge period in which display can be made in the predetermined screen by light-emitting processing with discharge produced for a specified number of times. The address periods comprise a write address period for selectively accumulating wall charge on the dielectric in a write-addressed display cell, and an erase address period for selectively erasing the wall charge accumulated on the dielectric in an erase-addressed non-display cell.

Preferably, according to an eighth aspect, in the plasma display panel driving method, a potential difference between a row electrode and a column electrode corresponding to a display cell in the write address period is made different from a potential difference between a row electrode and a column electrode corresponding to a non-display cell in the erase address period.

Preferably, according to a ninth aspect, the plasma display panel driving method comprises, assigning a light-emitting subfield group comprising successive first to nth ($n \geqq 2$) ones of the plurality of subfields according to a displayed luminance level, and a light emitting step of performing the write operation with a write address period set in the first subfield, performing the erase operation with an erase address period set in a subfield following the nth subfield and not included in the light-emitting subfield group, and causing light emission in light-emission periods in the first to nth subfields.

The plasma display panel driving method according to the first aspect comprises a light emission assigning step of, when displaying with at least part of a plurality of displayable luminance levels, assigning a light-emitting subfield group comprising successive two or more subfields including a predetermined subfield of the plurality of subfields according to a displayed luminance, and a light emitting step of causing light emission in the sustained discharge periods in the subfields forming the light-emitting subfield group.

Since the light-emitting subfield group necessarily includes the predetermined subfield, it is possible to suppress the amount of shift of the center of emission when displaying the at least part of luminance levels.

As a result, setting a large area as the at least part of luminance levels allows reduction in the amount of shift of the center of emission in displaying most of the luminance levels. Hence, the application of the plasma display panel driving method of the first aspect provides the effect of reducing pseudo contouring when displaying moving picture on the predetermined screen.

In the light emission assigning step in the plasma display panel driving method according to the second aspect, the light-emitting subfield group is assigned from the common subfield so that the center of emission in the light-emitting subfield group is located in the vicinity of the center of the common subfield. This reduces the amount of shift of the center of emission and also reduces dispersion of the center of emission among fields, thus further reducing occurrence of the pseudo contouring of moving picture.

In the light emission assigning step in the plasma display panel driving method according to the third aspect, when displaying with a displayed luminance level, a plurality of light-emitting subfield groups are assigned while being switched according to a predetermined procedure, so that pseudo contouring of moving picture can be dispersed to be less detectable.

In the plasma display panel driving method according to the fourth aspect, the first and second light-emitting subfield groups having their respective centers of emission shifted in different directions from the center position in the common subfield are alternately switched for each field period. Accordingly, even if the center of emission is shifted in a certain direction from the center position in a field, the center of emission is shifted from the center position in the opposite direction to the certain direction in the next field.

As a result, when averaged in time, the center of emission is located in the vicinity of the center position. Hence, when considering passage of time, the amount of shift of the center of emission is reduced and the pseudo contouring of moving picture is thus reduced.

In the plasma display panel driving method according to the fifth aspect, the first light-emitting subfield group and the second light-emitting subfield group having their respective centers of emission shifted in different directions from the center position of the common subfield are switched for a predetermined display unit in the predetermined screen.

As a result, when averaged in area in the predetermined screen, the center of light emission is located in the vicinity of the center position, reducing the amount of shift of the center of emission in the entirety of the predetermined screen and reducing the pseudo contouring of moving picture.

The light emitting step in the plasma display panel driving method according to the sixth aspect comprises the step of, with the light-emitting subfield group formed of first to nth ($n \geqq 2$) subfields, performing write operation with the write address period set in the first subfield, performing the erase operation with the erase address period set in a subfield following the nth subfield outside the light-emitting subfield group, and causing light emission in the sustained discharge periods in the first to nth subfields.

Accordingly, in the light emission assigning step, the light-emitting subfield group can be assigned to include, among the plurality of subfields, a subfield in which only the erase-address period is set. Since the erase-address period can be set shorter than the write-address period, the total of the address periods in one field becomes shorter. This allows improvement of display performance of the plasma display panel with reduced cost.

In the plasma display panel driving method according to the seventh aspect of the invention, the address periods include a write address period for selectively accumulating wall charge on the dielectric in a write-addressed display cell and an erase address period for selectively erasing wall charge accumulated on the dielectric in an erase-addressed non-display cell.

Accordingly, the write address period and the erase address period can be set to reduce the number of times of reset processings for collectively erasing the predetermined screen, which reduces the luminance in black display.

In the plasma display panel driving method according to the eighth aspect, the potential difference between a row electrode and a column electrode corresponding to a display cell in the write address period is made different from the potential difference between a row electrode and a column electrode corresponding to a non-display cell in the erase address period. This optimizes the individual address periods to enhance the display performance.

Further, the plasma display panel driving method according to the ninth aspect comprises a light emission assigning step of, when displaying with at least part of a plurality of displayable luminance levels, assigning a light-emitting subfield group comprising successive first to nth ($n \geqq 2$) ones of the plurality of subfields according to a displayed luminance level, and a light emitting step of performing write operation with the write address period set in the first subfield, performing erase operation with the erase address period set in a subfield following the nth subfield and not included in the light-emitting subfield group, and causing light emission in the sustained discharge periods in the first to nth subfields.

Accordingly, in the light emission assigning step, the light-emitting subfield group can be assigned to include, among the plurality of subfields, a subfield in which only the erase address period is set. Since the erase address period can be set shorter than the write address period, the total of the address periods in one field becomes shorter. This allows improvement of display performance of the plasma display panel with suppressed cost.

The present invention has been made to solve the problems described above, and an object of the present invention is to suppress luminance in black display in a plasma display panel without deteriorating its picture quality and with suppressed cost and to suppress pseudo contouring of moving picture.

These and other objects, features, aspects and advantages of the present invention will become more apparent from the following detailed description of the present invention when taken in conjunction with the accompanying drawings.

BRIEF DESCRIPTION OF THE DRAWINGS

FIGS. 22 and 23 show light-emitting pattern in the eighth preferred embodiment of the present invention.

FIGS. 24 and 25 show light-emitting pattern in a ninth preferred embodiment of the present invention.

FIGS. 28 and 29 show light-emitting pattern in the tenth preferred embodiment of the present invention.

FIGS. 30 and 31 show light-emitting pattern in the tenth preferred embodiment of the present invention.

FIGS. 33 and 34 show light-emitting pattern in the eleventh preferred embodiment of the present invention.

FIGS. 35 and 36 show light-emitting pattern in the eleventh preferred embodiment of the present invention.

DESCRIPTION OF THE PREFERRED EMBODIMENTS

Figure 1:
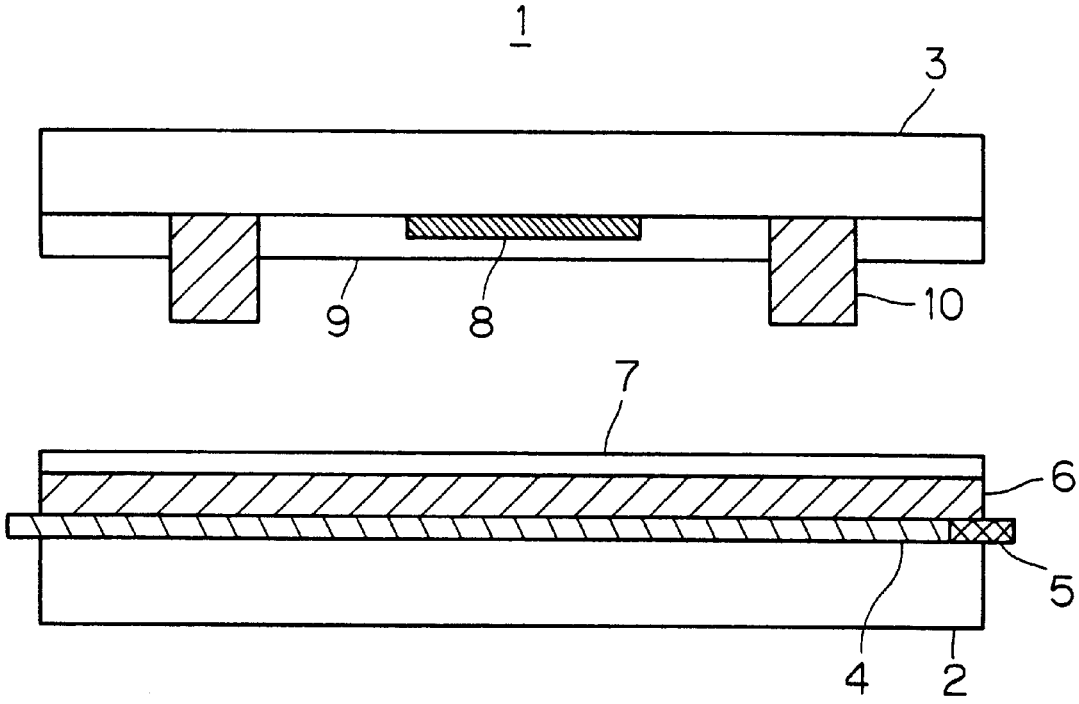
FIG. 1 shows a part of a cross-section of a plasma display panel to which the present invention is applied.

The invention will now be described referring to the drawings showing the preferred embodiments.

First Preferred Embodiment

FIG. 1 is a partial sectional view showing cells of a surface-discharge type AC-PDP, to which a plasma display panel driving method according to a preferred embodiment of the present invention is applied. In the drawing, the surface-discharge type plasma display panel 1 includes a front glass substrate 2 serving as a display face, a rear glass substrate 3 provided opposite to the front glass substrate 2 with a discharge space interposed therebetween, first row electrodes 4(X) and second row electrodes 5(Y1–Yn) formed in pairs on the front glass substrate, a dielectric layer 6 covering the row electrodes 4 and 5, an MgO (magnesium oxide) layer 7 formed on the dielectric layer 6 by deposition or the like, column electrodes 8(W1–Wm) formed perpendicular to the row electrodes on the front glass substrate 3, phosphor layers 9 formed over the column electrodes in order like stripes to emit red, green, and blue lights for the respective column electrodes, and partitions 10 formed between the column electrodes 8 to separate the discharge cells and also to prevent the PDP from being broken by atmospheric pressure. The space between the glass substrates 2 and 3 is filled with a discharge gas, such as an Ne—Xe mixture gas or an He—Xe mixture gas, at a pressure not higher than the atmospheric pressure.

Figure 2:
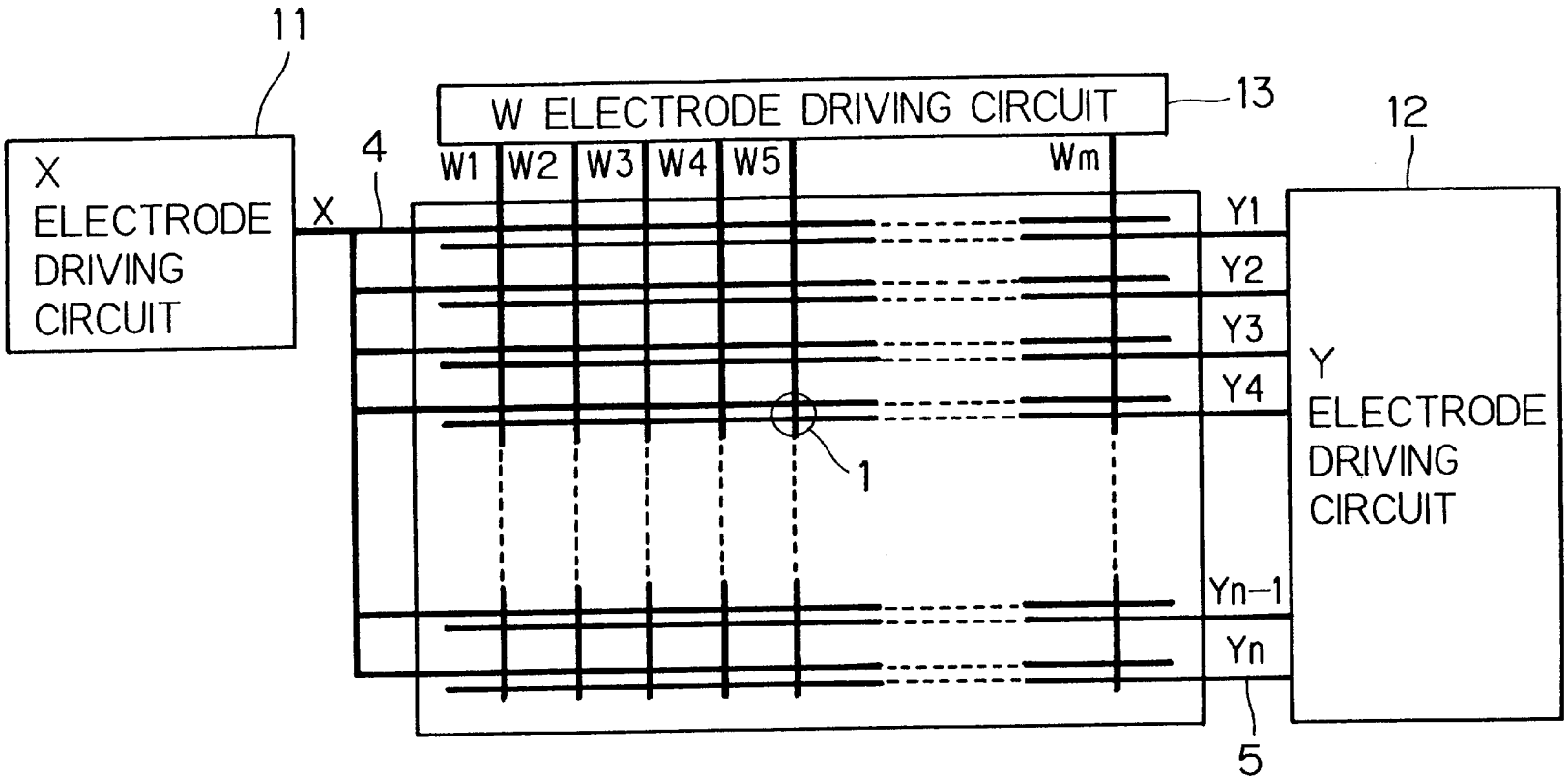
FIG. 2 is a diagram showing the structure of the plasma display panel to which the present invention is applied.

FIG. 2 is a diagram showing the structure of the plasma display panel to which the plasma display panel driving method according to the preferred embodiment of the invention is applied, which shows its peripheral circuits, too. The first row electrodes X are connected in common to an X driving circuit 11, the second row electrodes Y1 to Yn are independently connected to a Y driving circuit 12, and the column electrodes 8 W1 to Wm are independently connected to a W driving circuit 13.

Figure 3:
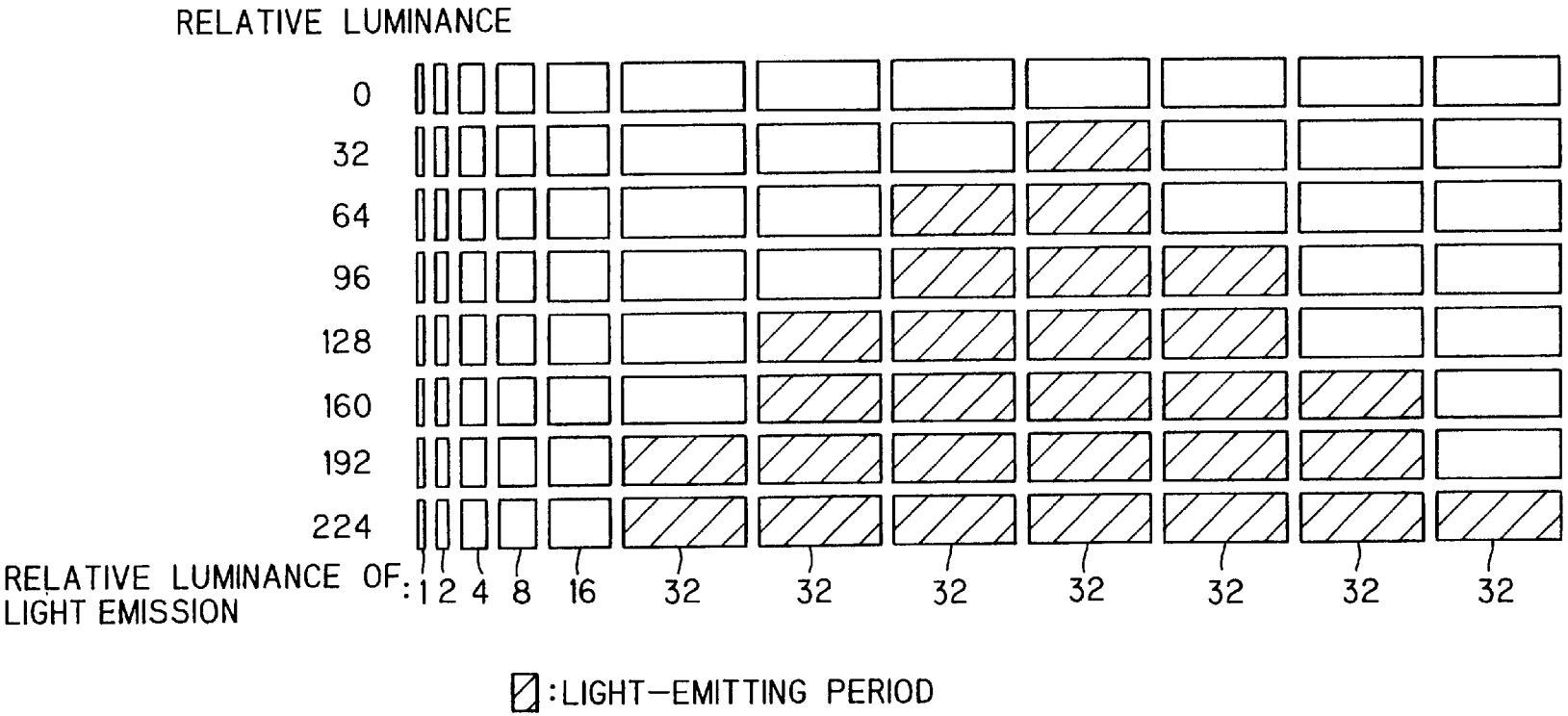
FIG. 3 is a diagram showing light-emitting pattern in discharge sustain according to a first preferred embodiment of the present invention.

FIG. 3 is a diagram showing an example of light-emitting pattern for tonal display in the plasma display panel driving method according to the first preferred embodiment of the present invention. In FIG. 3, 12 sustained discharge periods for relative luminance levels with proportions 1, 2, 4, 8, 16, 32, 32, 32, 32, 32, 32, and 32 display the relative luminance levels 0, 32, 64, 96, 128, 160, 192, 224. As shown in the diagram, a plurality of sustained discharge periods that display the same relative luminance level are arranged collectively in a given period in one field, where they are controlled so that light emission is produced preferentially starting from the sustained discharge period provided in the temporal center part. This reduces the amount of shift of the temporal center of emission caused when displaying the different relative luminance levels. Accordingly, the plasma display panel can display moving picture with reduced unevenness in light-emitting pattern, thus lightening the problem of pseudo contouring of moving picture.

Figure 4:
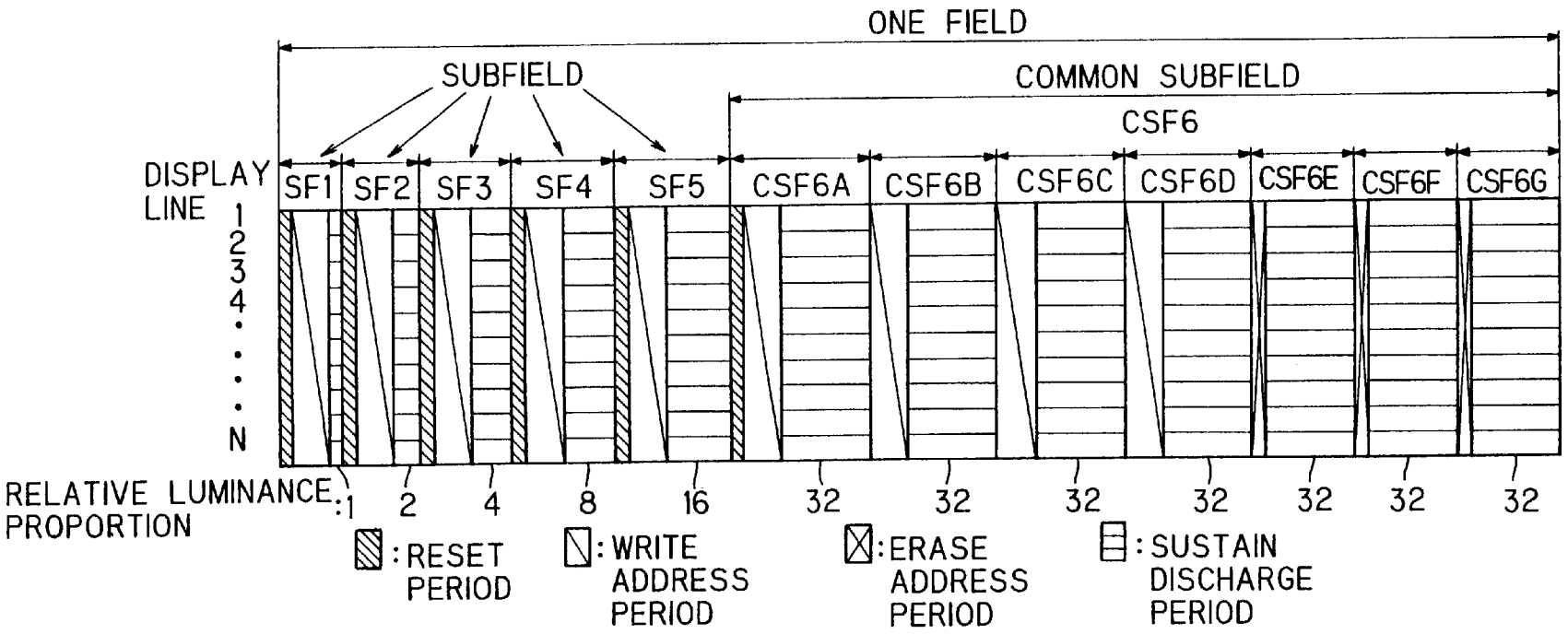
FIG. 4 is a diagram showing the structure of one field in the first preferred embodiment of the present invention.

FIG. 4 is a diagram showing the structure of one field in the plasma display panel driving method according to the first preferred embodiment of the present invention. The operation will now be explained in more detail referring to the drawing. One field includes five subfields SF1 to SF5 and one common subfield CSF6, for example. The subfields SF1 to SF5 each include a reset period, a write address period, and a discharge sustain period, where their respective discharge sustain periods display the relative luminance levels of 1:2:4:8:16. The common subfield CSF6 includes a reset period, discharge sustain periods divided into seven by six resting periods, four write address periods, and three erase address periods, where the divided discharge sustain periods each display the relative luminance level 32. The combinations of the discharge sustain periods divided by the resting periods and the corresponding write address periods or erase address periods are sequentially referred to as subfields CSF6A, CSF6B, CSF6C, CSF6D, CSF6E, CSF6F, CSF6G. The plasma display panel can display 256 tones of luminance with combinations of presence/absence of light emission in these discharge sustain periods.

Figure 5:
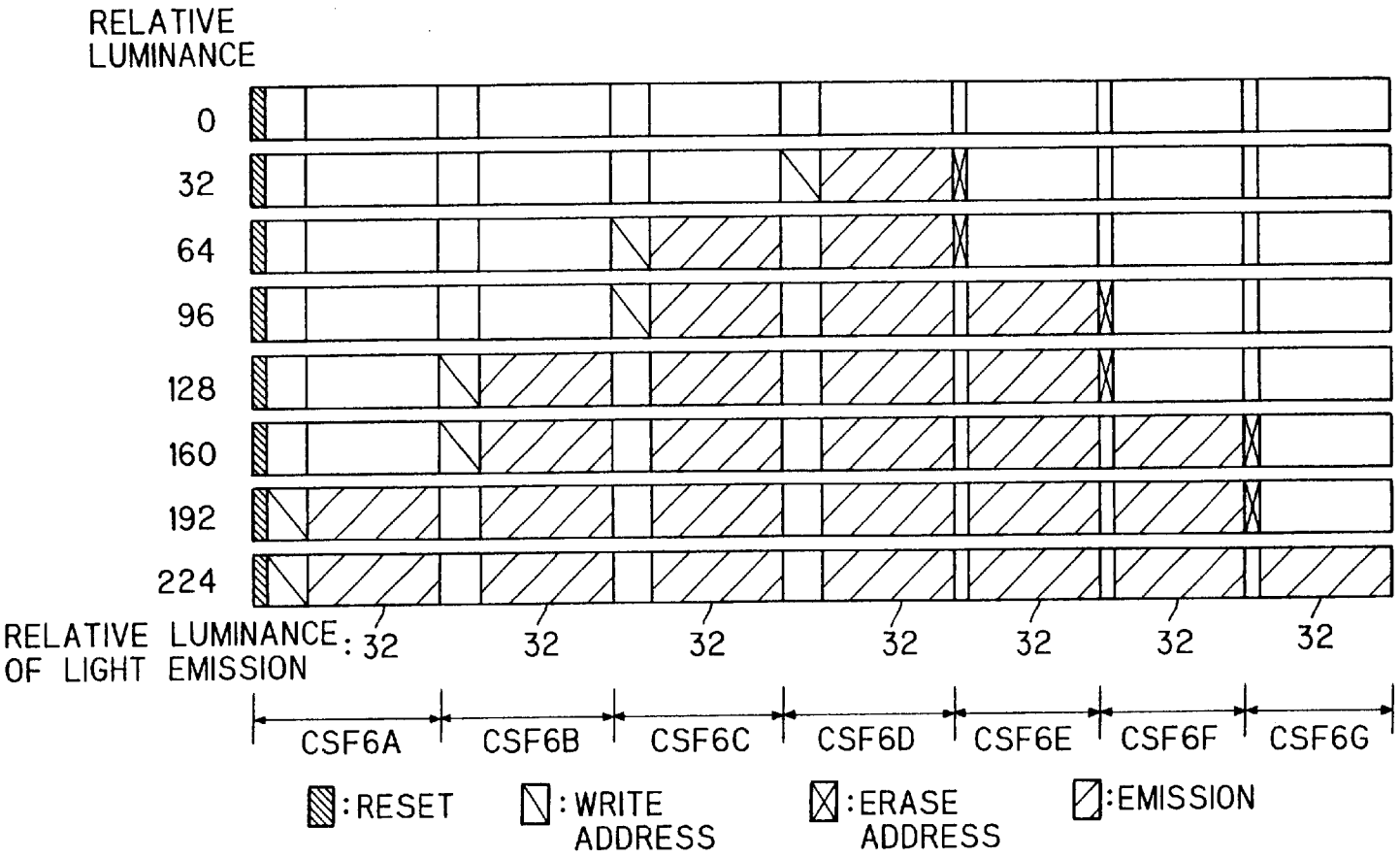
FIG. 5 is a diagram showing the light-emitting pattern and operating timing in the first preferred embodiment of the present invention.

FIG. 5 is a diagram more fully showing the operation in the common subfield CSF6, which shows write address and erase address operations and the light-emitting pattern with respect to the relative luminance levels that can be displayed in the common subfield CSF6. When the common subfield CSF6 displays the relative luminance level 0, only the reset operation is performed at the beginning of the subfield. With the relative luminance level 32 (the light-emitting subfield group CSF6D), write address processing is performed in CSF6D and light is emitted in the discharge sustain period CSF6D, and erasing is selectively performed in the erase address period in CSF6E to end the light emission. With the relative luminance level 64 (the light-emitting subfield group CSF6C, CSF6D), write address processing in CSF6C and erase address processing in CSF6E are performed and light is emitted in the discharge sustain periods in CSF6C and CSF6D. In this case, write operation is not performed in the write address period in CSF6D. Next, when the relative luminance level is 96 (the light-emitting subfield group CSF6C to CSF6E), write address processing in CSF6C and erase address processing in CSF6F are performed and light is emitted in the discharge sustain periods of CSF6C to CSF6E. At this time, write operation and erasing operation are not performed in the write address period in CSF6D and the erase address period in CSF6E. Similarly, with the relative luminance levels 128, 160, 192, 224, write address processing and erase address processing are performed by the timing shown in FIG. 5 and the number of light-emitting periods is increased one by one on the left or right side of the CSF6D in the center This reduces the luminance in black display, since reset operation is performed only once at the beginning of the common subfield CSF6 independently of the relative luminance level.

Further, the center of emission in the common subfield CSF6 is always placed in the period CSF6D, since the light-emitting pattern can be developed with its center placed in CSF6D by using write address processing and erase address processing. This reduces the unevenness in time in the light-emitting pattern for displaying the individual tones, thus suppressing occurrence of pseudo contouring of moving picture.

As shown in FIG. 4, one field includes ordinary subfields SF1 to SF5, as well as the common subfield CSF6. These subfields SF1 to SF5 operate to shift the center of light emission in display of individual tones, that is, they operate to make the light-emitting pattern uneven in time. However, the total relative luminance in the discharge sustain periods of SF1 to SF5 is as small as 31, which is sufficiently smaller than the maximum relative luminance 224 in the discharge sustain periods in the common subfield CSF6. Hence they do not severely cause the pseudo contouring of moving picture.

Figure 6:
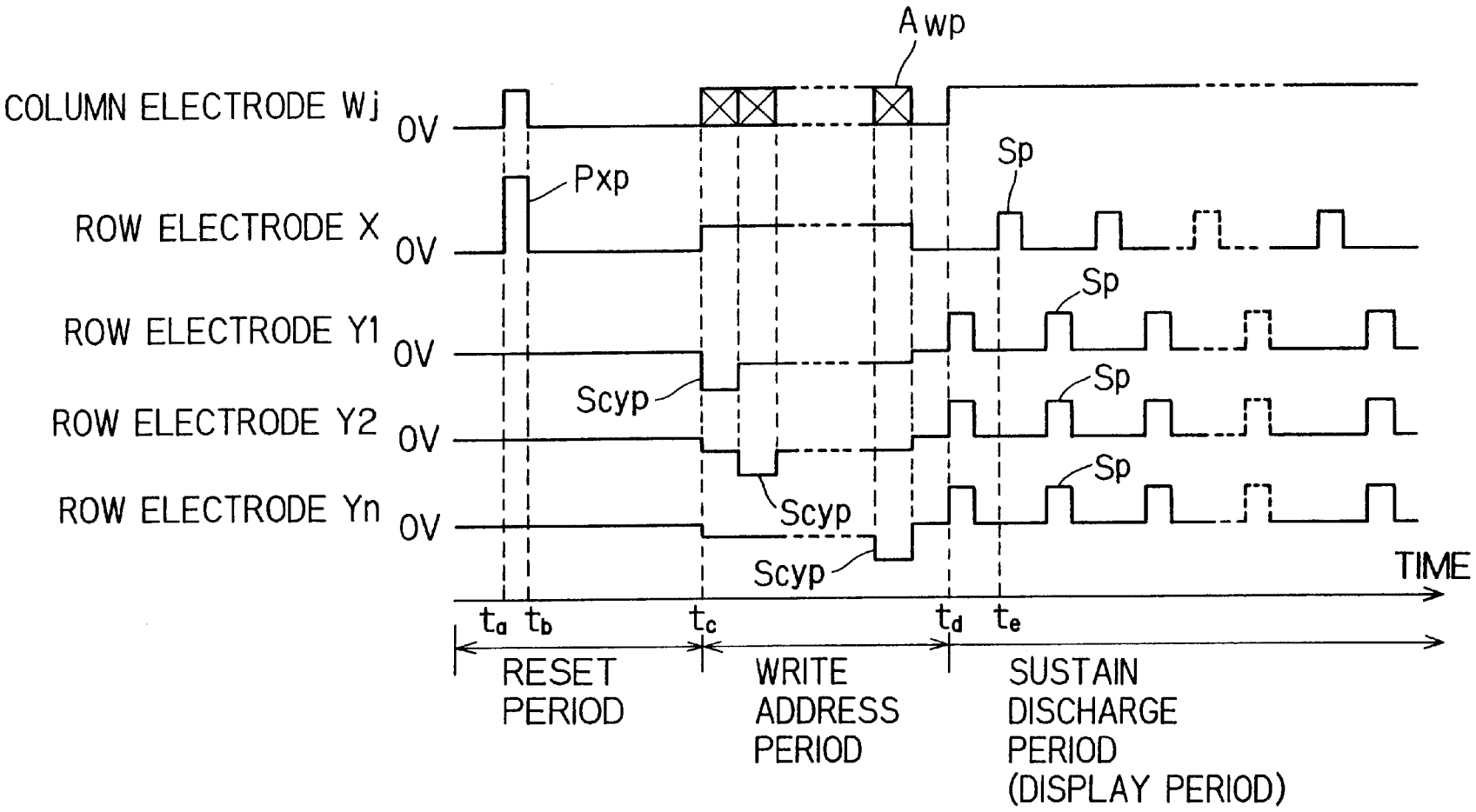
FIGS. 6 to 8 are diagrams showing voltage waveforms of electrodes in the first preferred embodiment of the present invention.

Next, voltage waveforms of the electrodes in the first preferred embodiment will be specifically described. FIG. 6 is a diagram showing the voltage waveforms in the subfields SF1 to SF5 and the first block subfield CSF6A in the common subfield CSF6 in FIG. 4. At time "ta" in FIG. 6, an entire-face write pulse Pxp (priming pulse) is applied to the first row (X) electrodes 4 connected in common in the entire screen. The pulse Pxp has a voltage of 330 V and a pulse width of 7 $\mu$S, for example. This entire-face write pulse Pxp is set equal to or higher than the discharge starting voltage between the first row electrodes 4 and the second row (Y1 to Yn) electrodes 5, so that all cells discharge and emit light independently of whether they emitted light or not in the preceding subfield. At this time, a voltage pulse is applied also to the column (W1 to Wm) electrodes 8 to reduce potential difference between the X and W electrodes so that discharge will not readily occur between the first row electrodes 4 and the column electrodes 8. This pulse is set about one half of the voltage between the X and Y electrodes. It is not essential to apply this pulse. The application of the entire-face write pulse Pxp between the X and Y electrodes causes strong discharge between the X and Y electrodes, so that a large amount of wall charge is accumulated between the X and Y electrodes and the discharge ends. Next, when the entire-face write pulse Pxp falls at time tb in FIG. 6 and the voltage disappears between the first row electrodes 4 and the second row electrodes 5, the electric field produced by wall charge accumulated due to the entire-face write pulse Pxp is left between the X and Y electrodes. This electric field is so large that it can start discharge by itself, and discharge therefore takes place between the X and Y electrodes again. However, since no voltage is applied from the outside, electrons and ions produced by this discharge are neutralized and disappear without being attracted toward the row electrodes X and Y.

In the write address period between time tc and td in FIG. 6, negative scanning pulses Scyp are applied sequentially to the independent second row electrodes Y1 to Yn for scanning. At this time, the pulse Scyp has a pulse width of 3 $\mu$S and a voltage of −170 V, for example. Applied to the column electrodes W are positive address pulses Awp corresponding to contents of picture data. At this time, the pulse Awp has a pulse width of 3 $\mu$S and a voltage of 60 V, for example. The scanning pulse Scyp applied to the second row electrodes Y and the address pulse Awp applied to the column electrodes W allow matrix-selection of arbitrary cells in the screen. The total voltage of the scanning pulse Scyp and the address pulse Awp is set equal to or higher than the discharge starting voltage between the Y and W electrodes in the cells, so that cells simultaneously supplied with the scanning pulse Scyp and the address pulse Awp discharge between the Y and W electrodes. In the write address period, the common first row electrodes X are kept at positive voltage. This voltage value is set so that no discharge is caused between the X and Y electrodes even if it overlaps with the voltage value of the scanning pulse Scyp, but so that when discharge occurs between the Y and W electrodes, discharge occurs also between the X and Y electrodes at the same time, triggered by the discharge between the Y and W electrodes. The write discharge sustain triggered by the discharge between the Y and W electrodes accumulates wall charge over the first and second row electrodes.

After the entire screen has been scanned, a sustain pulse Sp is applied to the entire screen all at once, and cells that have accumulated wall charge in the write address period develop discharge sustain. The sustain pulse Sp at this time is a pulse having a pulse width of 3.5 $\mu$S and a voltage of 180 V, for example. When it is in the subfields SF1 to SF5, the next subfield starts after discharge sustain has been caused for a given number of times with the sustain pulses Sp, and the entire-face write pulse Pxp is applied to all cells in the reset period for resetting. If it is in the common subfield CSF6A, the next write address period starts without a reset period.

Figure 7:
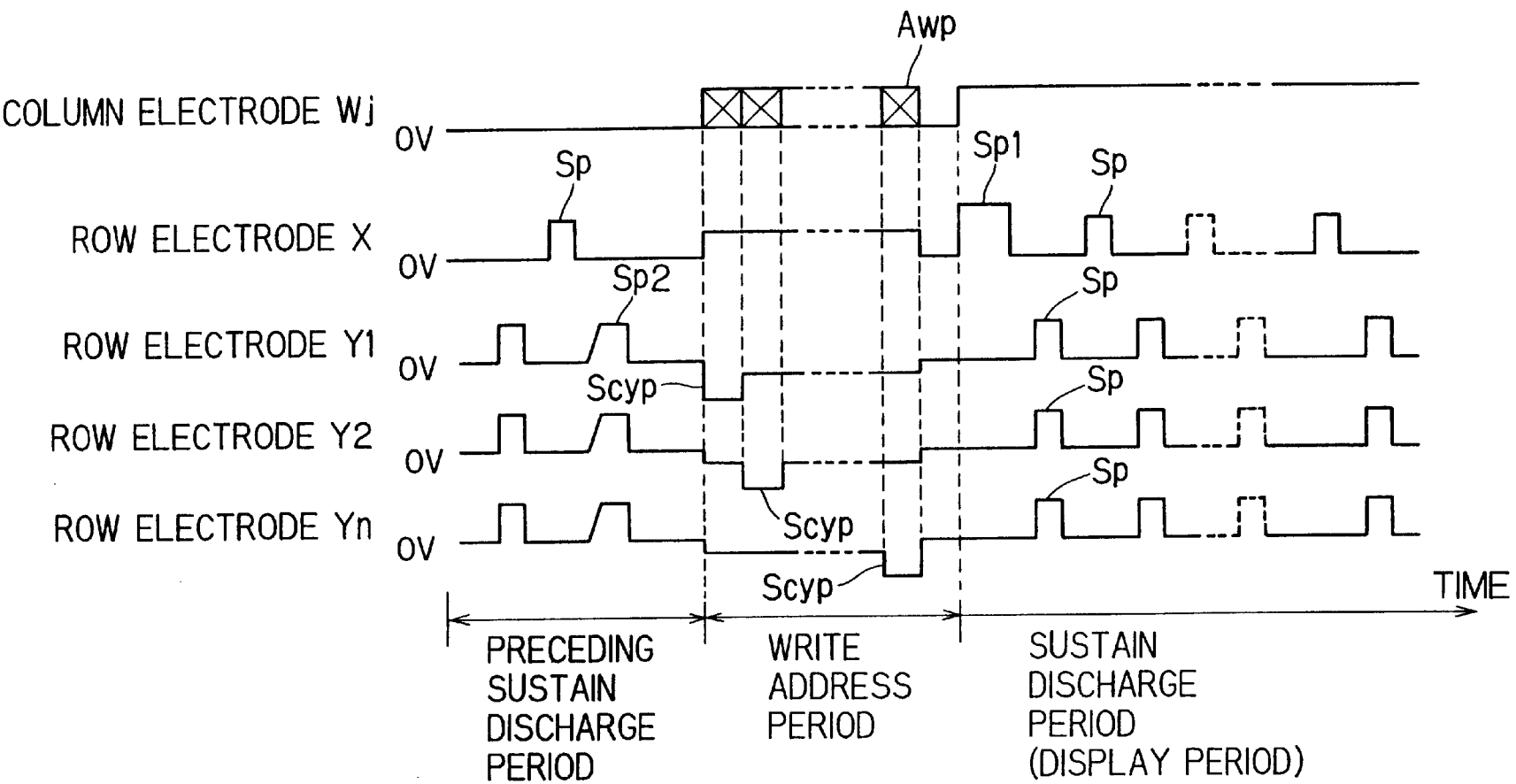

FIG. 7 is a diagram showing voltage waveforms in the periods CSF6B to CSF6D in the common subfield CSF6. In CSF6B to CSF6D, write address processing is performed without reset operation. The operation in the write address periods is not specifically described, since it is the same as that in the write address periods in the subfields SF1 to SF5 and in CSF6A.

Figure 8:
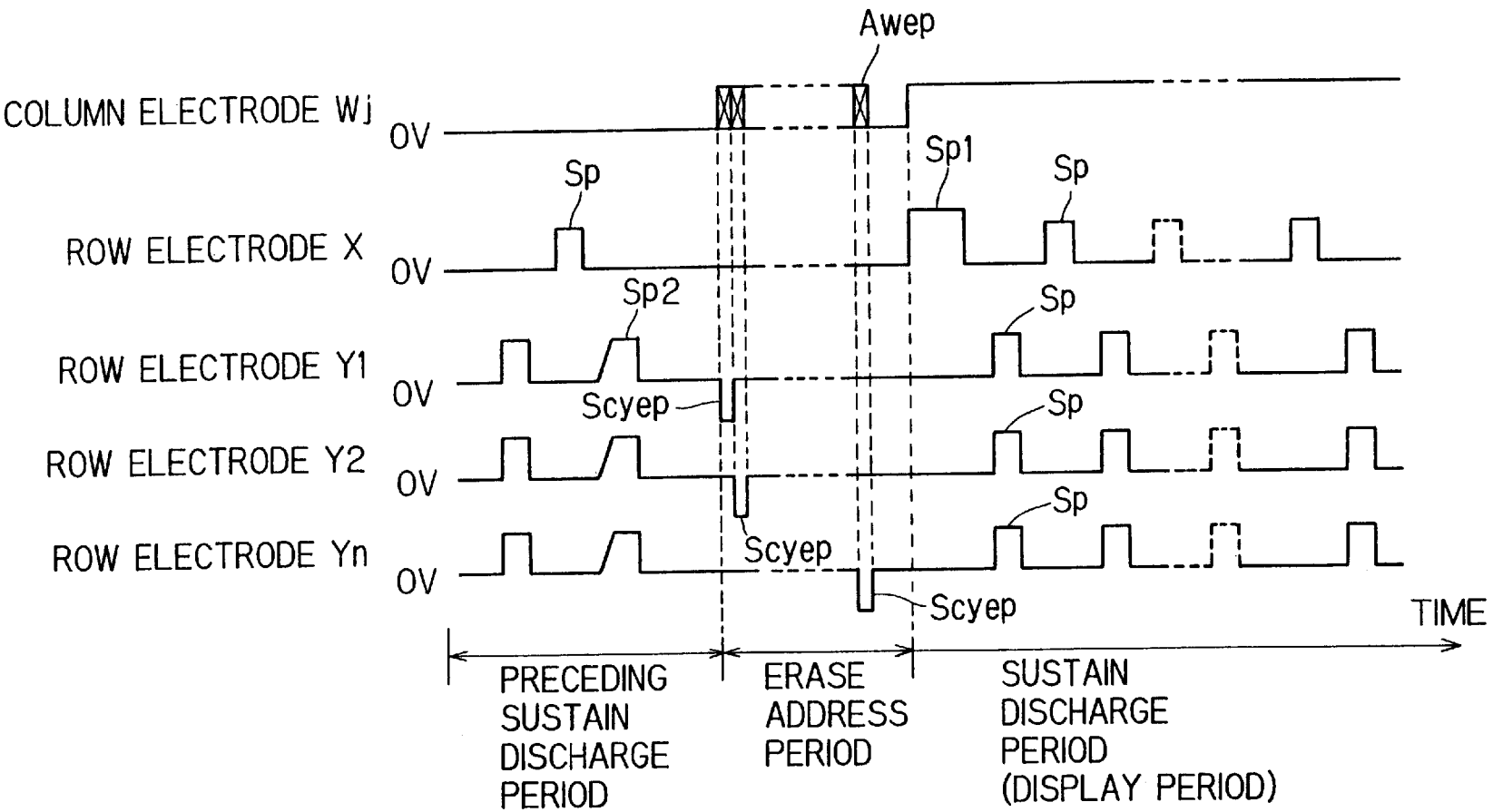

FIG. 8 is a diagram showing voltage waveforms in the periods CSF6E to CSF6G in the common subfield CSF6. In CSF6E to CSF6G, erase address processing is performed without reset operation. The erase address operation will be specifically described. In the erase address period in FIG. 8, negative scanning pulses Scyep are applied sequentially to the independent second row electrodes Y1 to Yn for scanning. At this time, Scyep is a pulse with a pulse width of 0.5 $\mu$S and a voltage of −150 V, for example. This voltage value cannot induce discharge between the X and Y electrodes by itself. Applied to the column electrodes W are positive erase pulses Awep corresponding to contents of picture data. The pulse Awep has a pulse width of 0.5 $\mu$S and a voltage of 60 V, for example. Since the total voltage of the scanning pulse Scyep and the erase address pulse Awep is set equal to or higher than the discharge starting voltage between the Y and W electrodes in the cells, cells simultaneously supplied with the scanning pulse Scyep and the erase address pulse Awep discharge between the Y and W electrodes. Further, the discharge between the W and Y electrodes triggers discharge between the X and Y electrodes. Generally, when discharge takes place, a large amount of space charge is produced in the discharge space and the charge moves in such a direction as to cancel the potential difference applied between the electrodes. The charge formed on electrodes is called wall charge. It takes about 1 $\mu$S before the wall charge forms. The pulse widths of Scyep and Awep applied in the erase address period are 0.5 $\mu$S. The X and Y electrodes are brought back to equal potential after that. Hence, while the wall charge does not sufficiently form, the produced space charge neutralizes the small amount of accumulated wall charge, so that almost no wall charge is left between the X and Y electrodes in the selected cells after the erase address period has been ended. Although the X electrodes are kept at positive potential in the write address period so as to strengthen discharge between the X and Y electrodes so that wall charge can surely be accumulated, the X electrodes are not kept at positive potential in the erase address period. Accordingly, formation of wall charge is prevented not only by the above-described time effect but also prevented in respect of the potential difference. Accordingly, it is possible in the erase address period to selectively erase arbitrary ones of the cells lit in the preceding subfield. A pulse with a lower voltage, or a round pulse is added to the last sustain pulse Sp2 in the preceding discharge sustain period to weaken the discharge. The application of this pulse prevents discharge in unselected cells (erroneous discharge) when the voltage of the erase address pulse Awe is lowered in the erase address period. A pulse with a higher voltage is used as the first sustain pulse Sp1 in the discharge sustain period to certainly maintain discharge sustain caused in the preceding block. However, such modified pulses Sp1 and Sp2 are not necessarily required.

After the entire screen has been scanned, the sustain pulse Sp is applied to the entire screen all at once. Then, among the cells that discharged in the discharge sustain period in the previous block, cells that were not erased in the erase address period perform discharge sustain. The sustain pulse Sp at this time is a pulse with a pulse width of 3.5 $\mu$S and a voltage of 180 V, for example. A pulse with a higher voltage is used as the first pulse Sp1 in the sustain period, so as to certainly continue the discharge sustain in the previous subfield. After discharge sustain has been developed for a given number of times with the sustain pulses Sp, the next block or the next subfield starts.

A picture of one field can be displayed by the above-described operation with the structure shown in FIG. 4. According to the driving method described above, cells lit in the preceding sustain period are selectively erased as non-displaying cells. Further, light emission in the erase address period can be included in sustain emission in the preceding sustain period. Accordingly, unnecessary light emission is not caused at all. This enables high-speed write without reducing the dark contrast.

In the above-described preferred embodiment, the voltage required for write or voltage required for erasing are adjusted by varying the voltages of Scyp and Scyep, with the voltage of the address pulse Awp for write address and the voltage of the erase address Awep set equal. However, the voltage may be adjusted by varying the voltages of Awp and Awep, with the voltages of Scyp and Scyep set equal. Needless to say, both may be independently varied.

Second Preferred Embodiment

Figure 9:
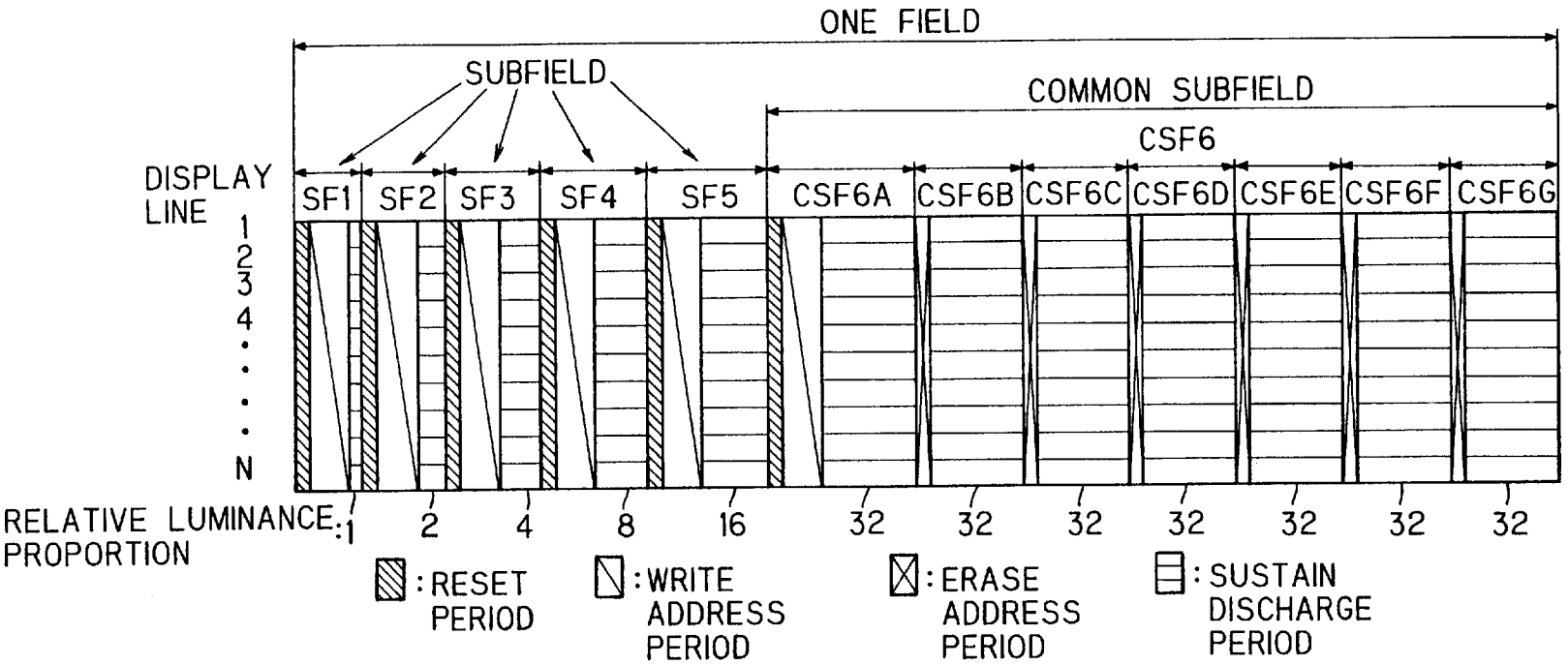
FIG. 9 is a diagram showing the structure of one field in a second preferred embodiment of the present invention.

In the first preferred embodiment, the address periods in CSF6A to CSF6D in the common subfield CSF6 are used for write address and the address periods in CSF6E to CSF6G for erase address. As shown in FIG. 9, the address periods in CSF6B to CSF6G may be used for erase address, with the address period in CSF6A used for write address.

Figure 10:
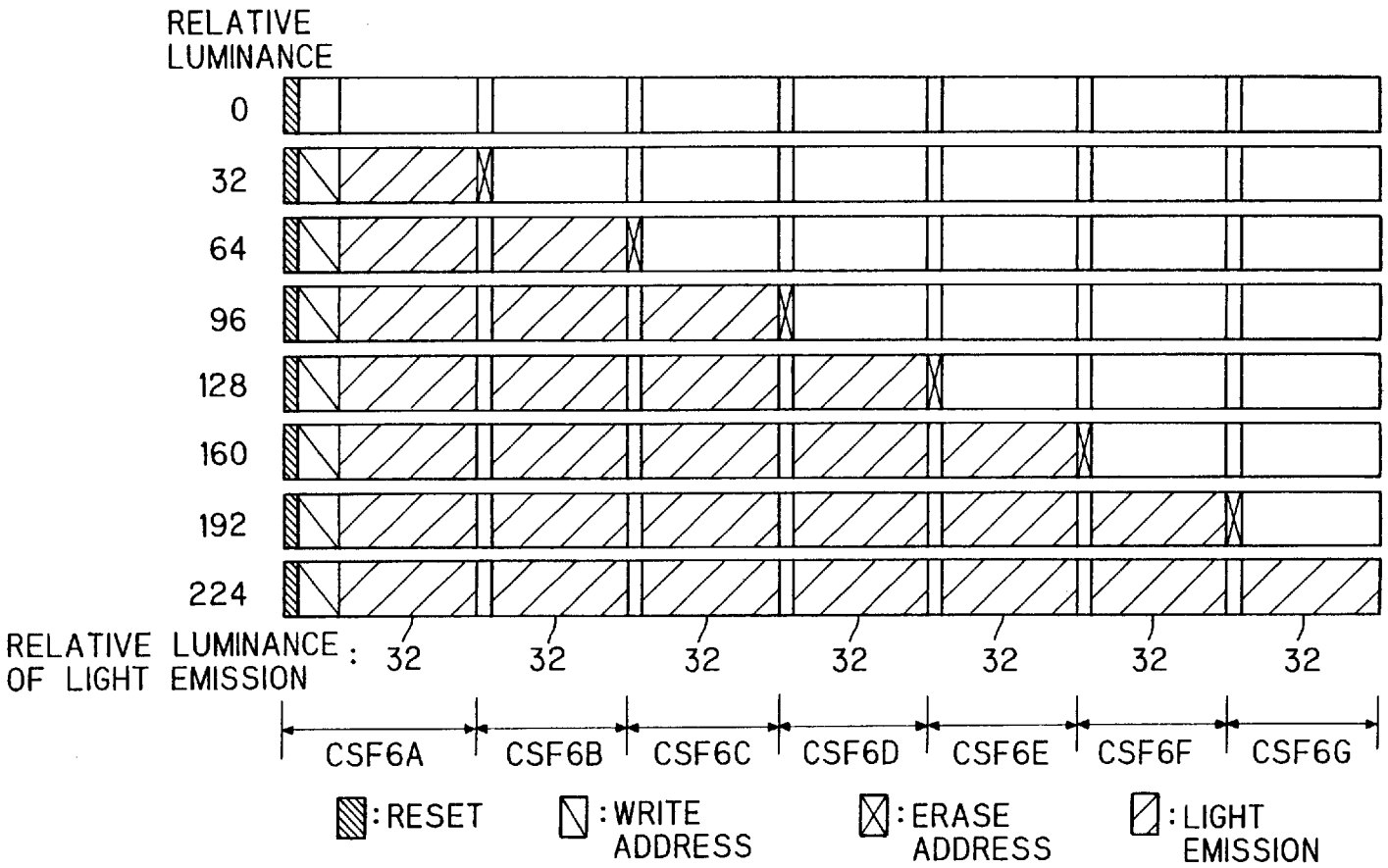
FIG. 10 is a diagram showing light-emitting pattern and operating timing in the second preferred embodiment of the present invention.

Next, operation in the common subfield CSF6 in the second preferred embodiment will be described in more detail. FIG. 10 shows write address and erase address operations and the light-emitting pattern with respect to relative luminance levels that can be displayed in the common subfield CSF6. When the relative luminance level for the common subfield CSF6 is zero, only the reset operation at the beginning of the subfield is performed. With the relative luminance level 32, address data is written in CSF6A and light is emitted in the discharge sustain period in CSF6A, and erasing is selectively performed in the erase address period in CSF6B to end emission. With the relative luminance level 64, write address processing is performed in CSF6A and erase address processing is performed in CSF6C, and light is emitted in the discharge sustain periods in CSF6A and CSF6B. At this time, no erase operation is performed in the erase address period of CSF6B. Next, with the relative luminance level 96, with write address processing in CSF6A and erase address processing in CSF6D, light is emitted in the discharge sustain periods in CSF6A to CSF6C. At this time, no erase operation is performed in the erase address periods in CSF6B and CSF6C. Similarly, with the relative luminance levels 128, 160, 192, 224, write address processing and erase address processing are performed by the timing shown in FIG. 10, with light-emitting periods increased in number, one by one, starting from CSF6A. Since reset operation is performed only once at the beginning of the common subfield CSF6 independently of the relative luminance level, the luminance in black display can be reduced.

Since erase address is capable of higher-speed operation than write address, performing write address processing only once in CSF6A and performing erase address processing in the remaining blocks CSF6B to CSF6G shortens the address period in one field. Then the number of display lines can be increased without complicating the structure of the panel and peripheral circuits, providing a lower-cost and higher-definition plasma display.

Further, since an increased time period can be used as the discharge sustain period, it is possible to enhance the luminous efficiency in discharge and ensure the margin.

Further, since the discharge sustain periods can be spaced closer, instead of being dispersed in one field, dispersion in the light-emitting pattern can be reduced when displaying various tones, which suppresses occurrence of pseudo contouring of moving picture.

As shown in FIG. 9, one field includes ordinary subfields SF1 to SF5, as well as the common subfield CSF6. These subfields SF1 to SF5 operate in such a way that the center of light emission is shifted in display of individual tones, that is, that the light-emitting pattern becomes uneven in time. However, the total relative luminance in the discharge sustain periods in SF1 to SF5 is as small as 31, which is sufficiently smaller than the maximum relative luminance 224 in the discharge sustain periods in the common subfield CSF6. Hence they do not severely cause the pseudo contouring of moving picture.

The operation of the electrodes is not fully described in the second preferred embodiment because it is the same as that in the first preferred embodiment.

Third Preferred Embodiment

Figure 11:
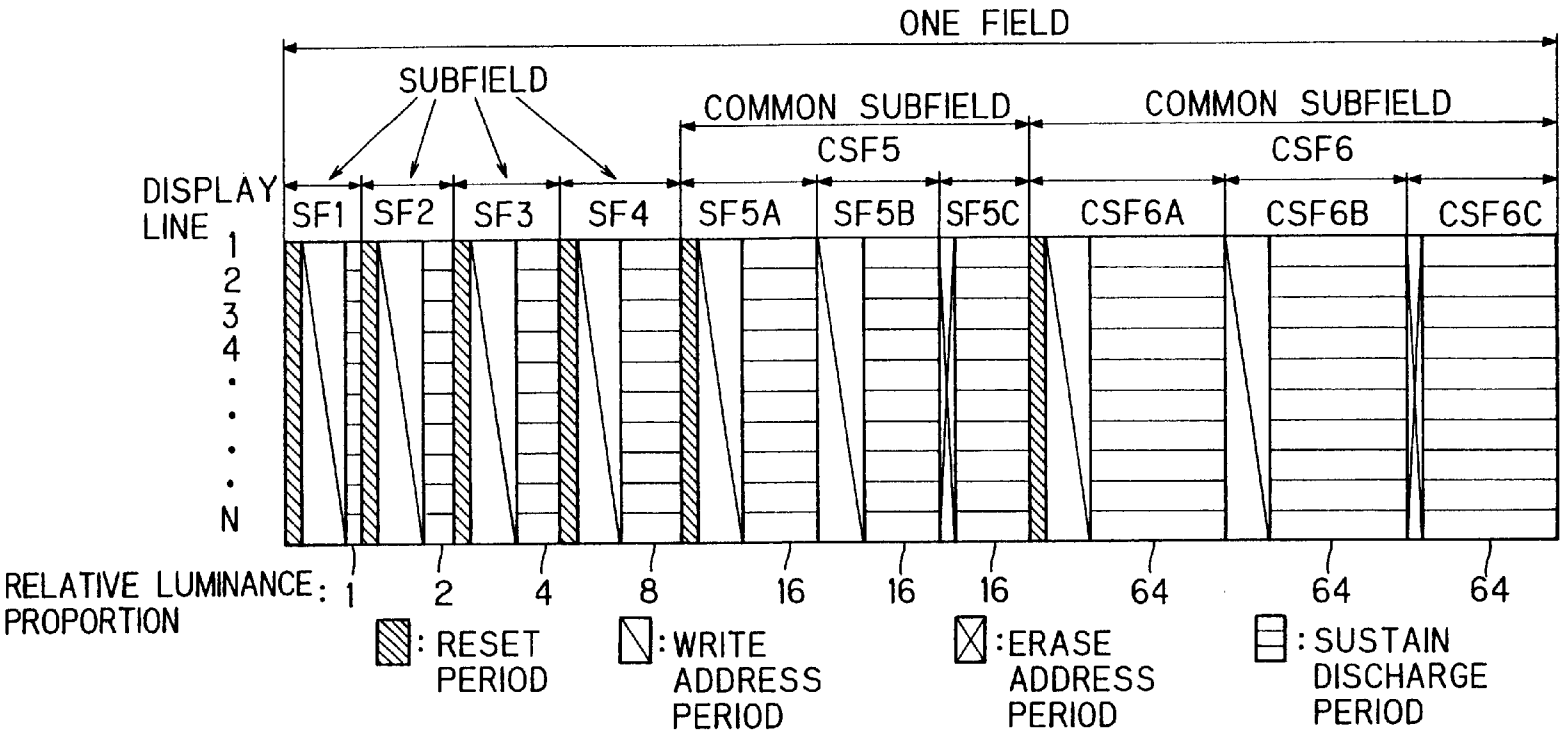
FIG. 11 is a diagram showing the structure of one field in a third preferred embodiment of the present invention.
Figure 12:
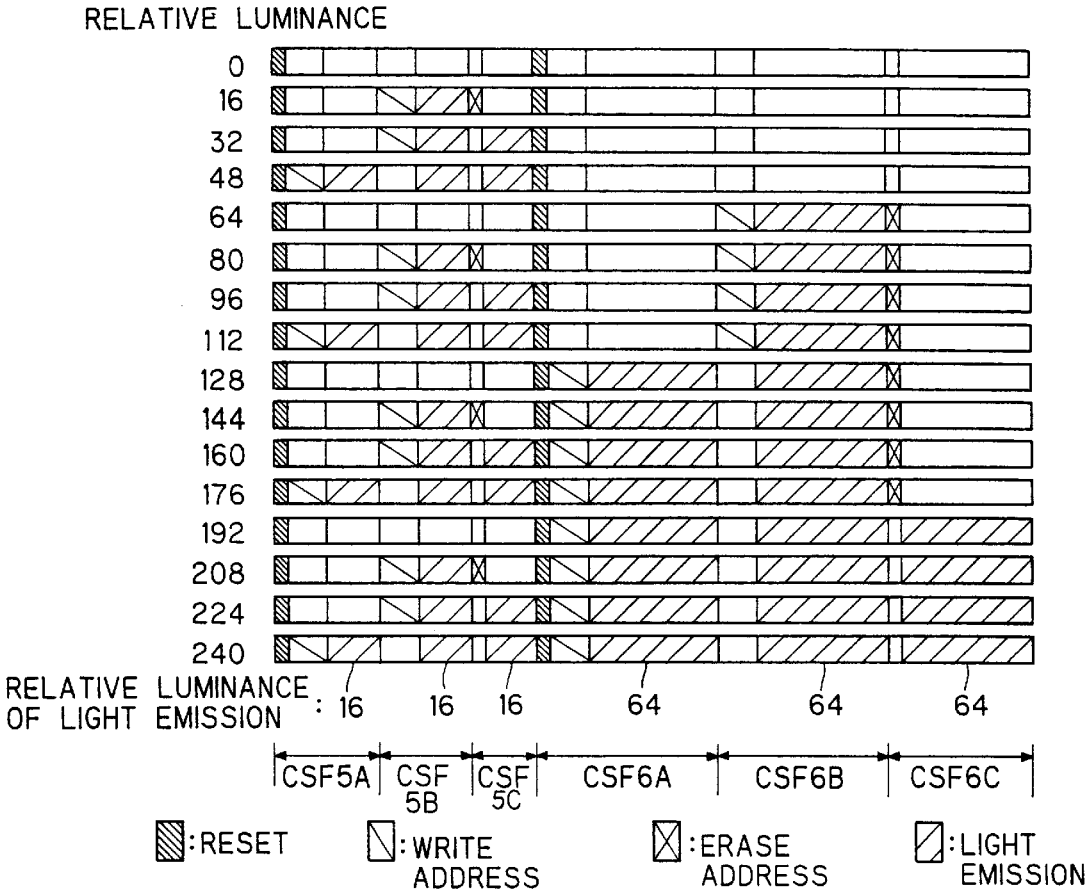
FIG. 12 is a diagram showing light-emitting pattern and operating timing in the third preferred embodiment of the present invention.

FIG. 11 is a diagram showing a third preferred embodiment of the present invention, which has two common subfields CSF5 and CSF6. The CSF5 includes three discharge sustain periods with the relative luminance level 16 and CSF 6 includes three discharge sustain periods with the relative luminance level 64. FIG. 12 shows write address and erase address operations and the light-emitting pattern with respect to the relative luminance levels that the common subfields CSF5 and SCF6 can display. Such a structure as has two or more common subfields provides the same effects as the first preferred embodiment.

Fourth Preferred Embodiment

Figure 13:
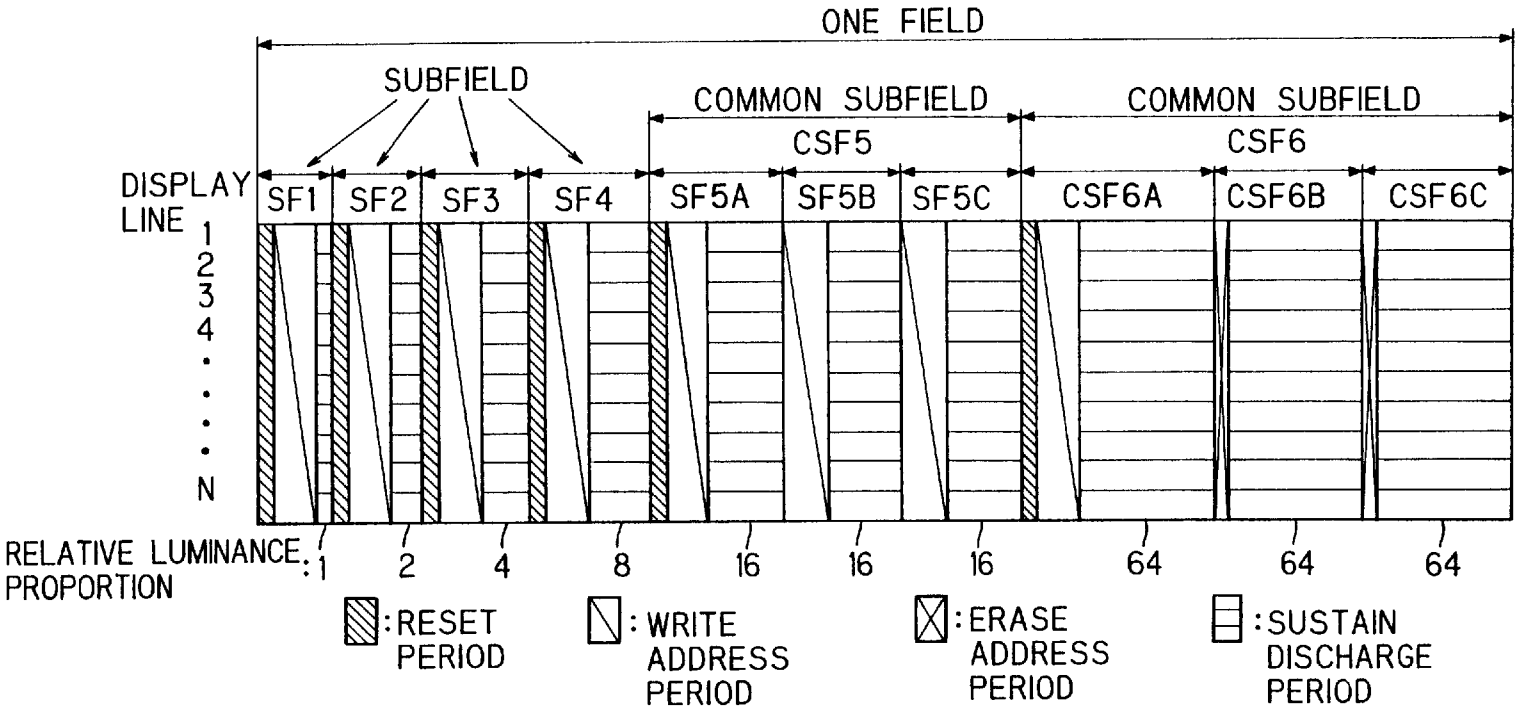
FIG. 13 is a diagram showing the structure of one field in a fourth preferred embodiment of the present invention.
Figure 14:
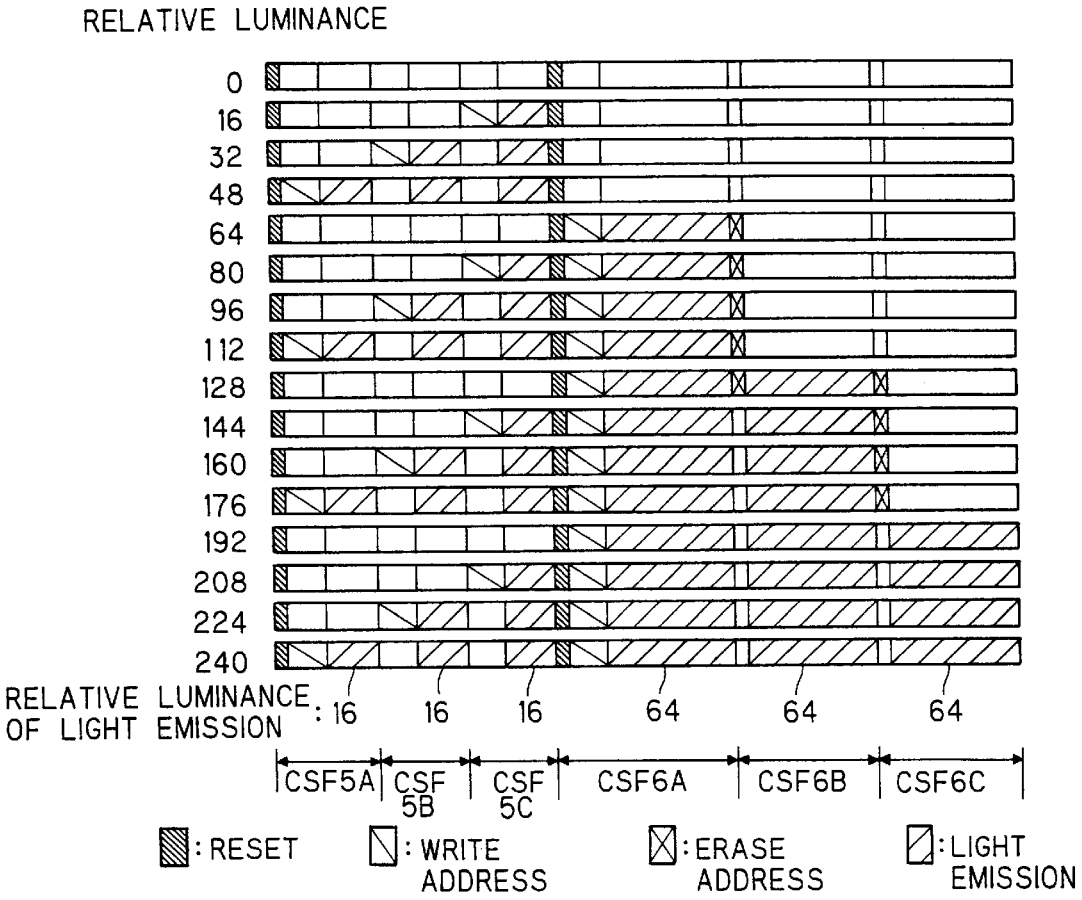
FIG. 14 is a diagram showing light-emitting pattern and operating timing in the fourth preferred embodiment of the present invention.

FIG. 13 is a diagram showing another structure of the third preferred embodiment above, where all address periods in the common subfield CSF5 are used for write address. FIG. 14 shows write address and erase address operations and the light-emitting pattern with respect to the relative luminance levels that can be displayed in the common subfields CSF5 and CSF6 in the fourth preferred embodiment. When light is emitted in CSF5 and CSF6 by the timing shown in FIG. 14, the center of emission is placed around CSF6A at the respective relative luminance levels, which provides the same effects as the first preferred embodiment.

Fifth Preferred Embodiment

Figure 15:
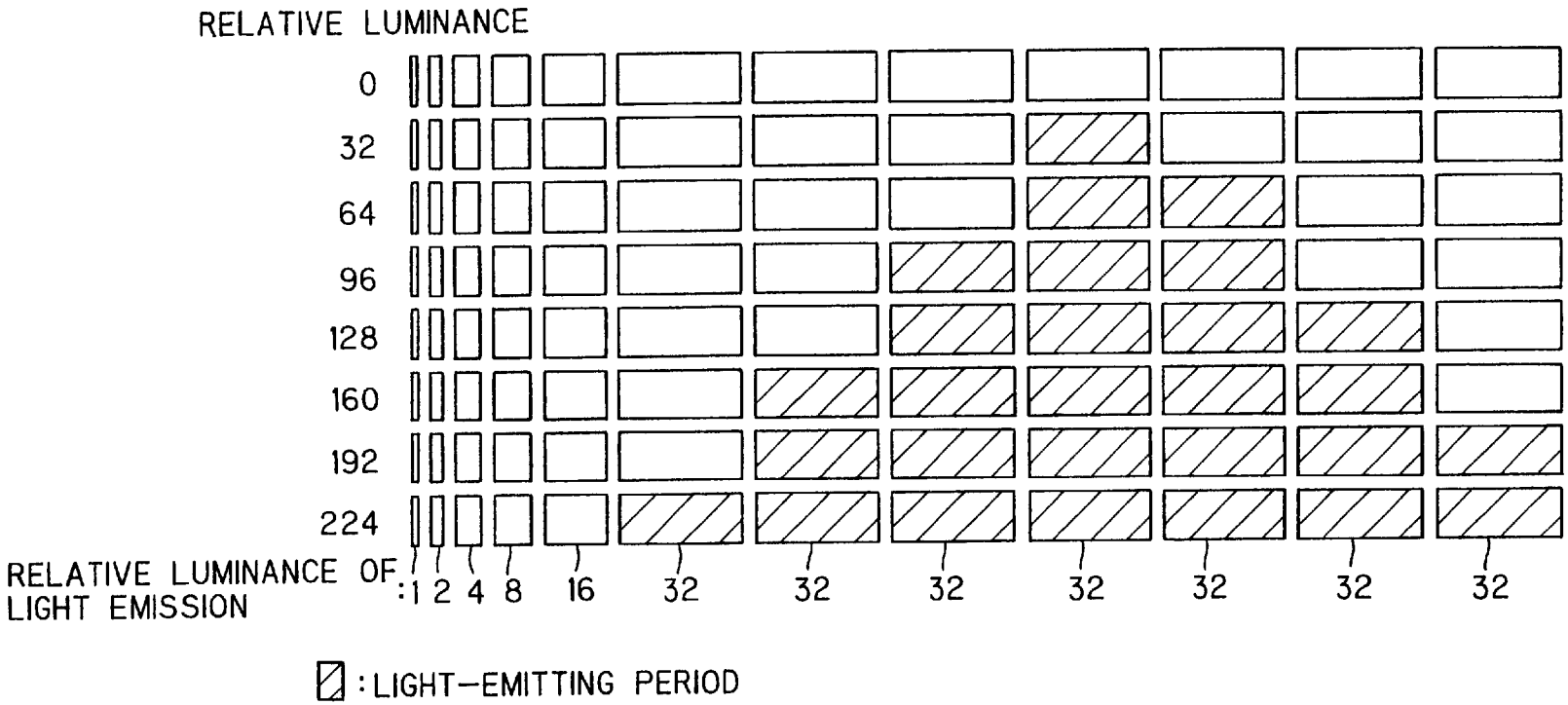
FIG. 15 is a diagram showing light-emitting pattern in a fifth preferred embodiment of the present invention.

FIG. 15 is a diagram showing another combination of light-emitting pattern in the plasma display panel driving method shown in the first preferred embodiment. The pattern shown in FIG. 15 includes, like that shown in FIG. 3, 12 discharge sustain periods with the relative luminance levels proportioned as 1, 2, 4, 8, 16, 32, 32, 32, 32, 32, 32, 32. In FIG. 15 in display of the relative luminance levels 0, 32, 64, 96, 128, 160, 192, 224, the light-emitting pattern in the discharge sustain periods with the relative luminance level 32 is in a symmetrical relation on right and left sides with respect to that shown in FIG. 3. Accordingly, the center of luminance in FIG. 3 and that in FIG. 15 shift in a symmetrical relation. Hence, it is possible to cancel the pseudo contouring of moving picture by switching the two patterns in FIG. 3 and FIG. 15.

Figure 16:
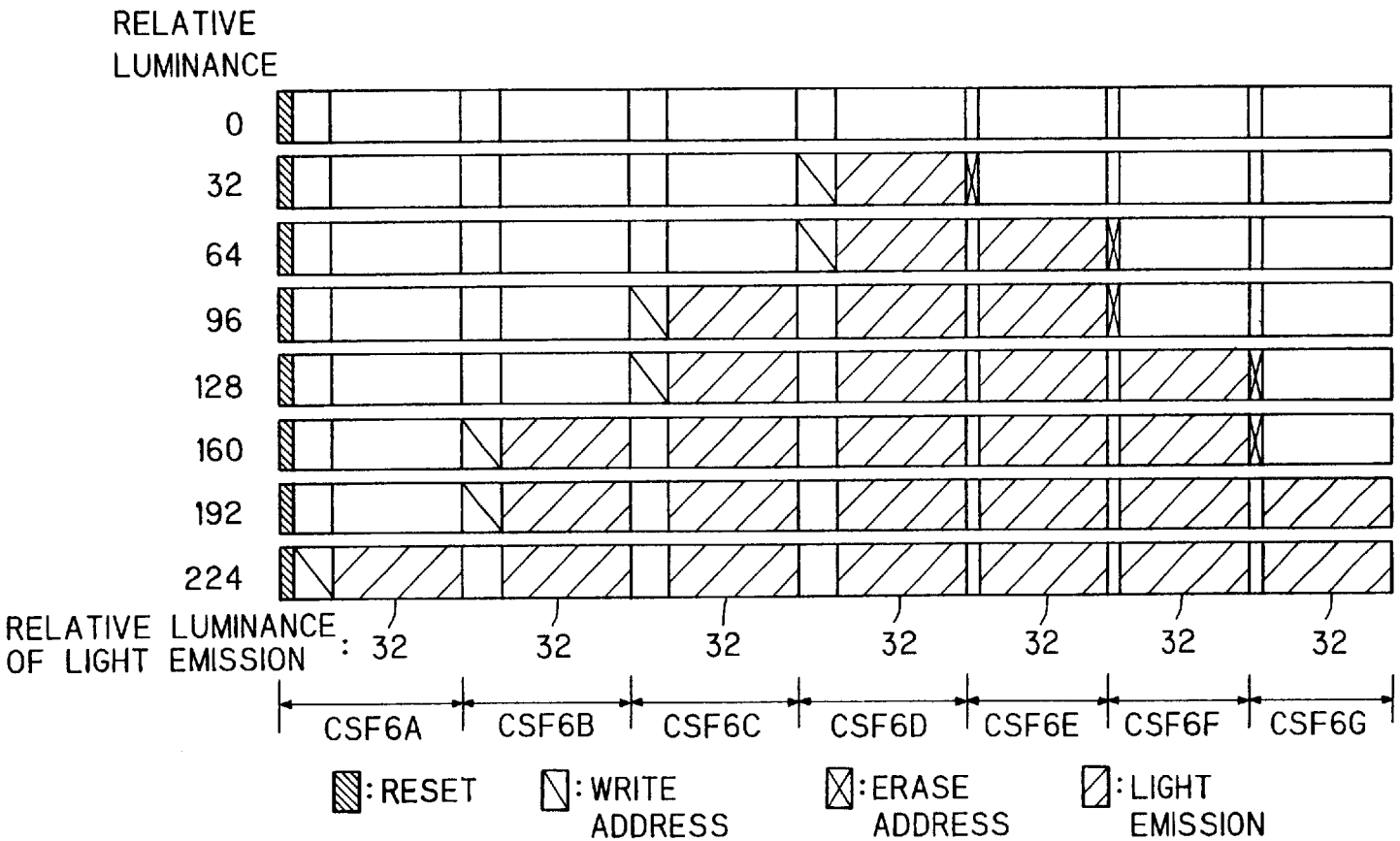
FIG. 16 is a diagram showing the light-emitting pattern and operating timing in the fifth preferred embodiment of the present invention.
Figure 17:
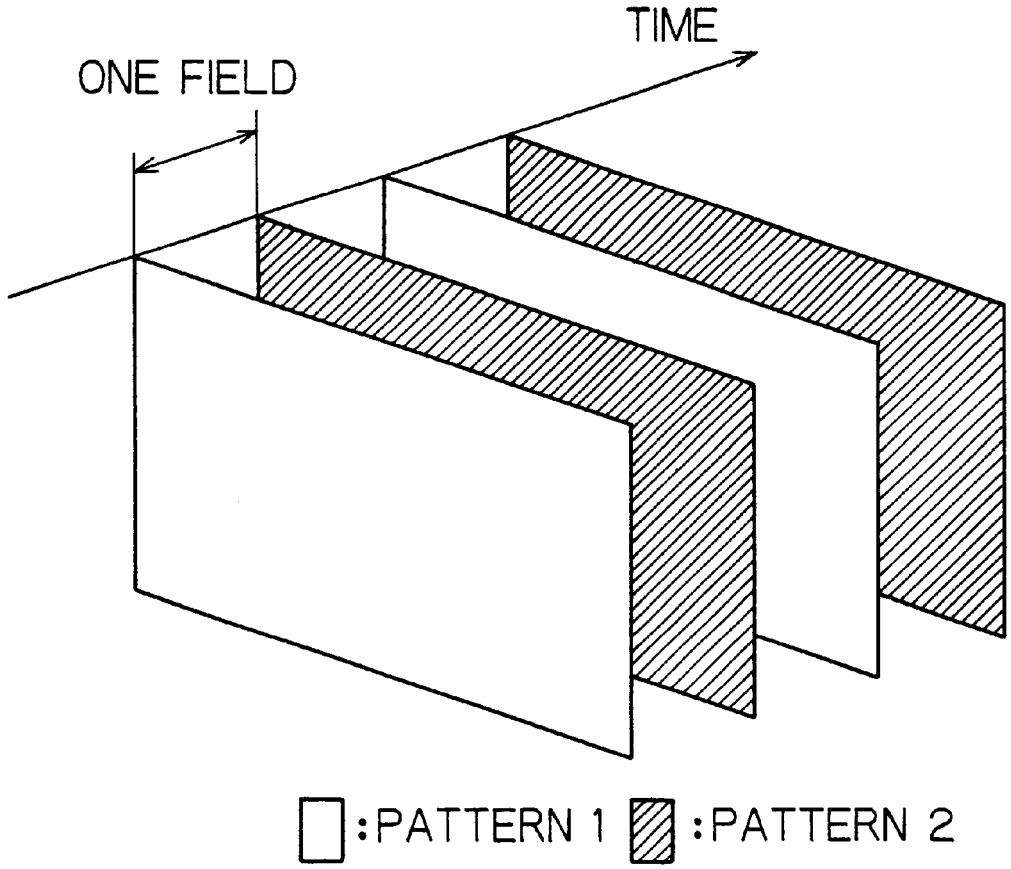
FIG. 17 is a diagram showing switching of light-emitting patterns in the fifth preferred embodiment of the present invention.

FIG. 16 is a diagram showing the operation in the common subfield CSF6 in more detail, which shows write address and erase address operations and the light-emitting pattern with respect to the relative luminance levels that can be displayed in the common subfield CSF6. When the relative luminance level of the common subfield CSF6 is zero, only the reset operation at the beginning of the subfield is performed. With the relative luminance level 32, write address processing is performed in CSF6D, light is emitted in the discharge sustain period in CSF6D, and erasing is selectively performed in the erase address period of CSF6E to end the light emission. With the relative luminance level 64, write address processing in CSF6D and erase address processing in CSF6F are performed and light is emitted in the discharge sustain periods of CSF6D and CSF6E. At this time, erase operation is not performed in the erase address period of CSF6E. Next, with the relative luminance level 96, write address processing in CSF6C and erase address processing in CSF6F are performed and light is emitted in the discharge sustain periods of CSF6C to CSF6E At this time, write operation and erase operation are not performed in the write address period of CSF6D and the erase address period of CSF6E. Similarly, with the relative luminance levels 128, 160, 192, 224, write address processing and erase address processing are performed by the timing shown in FIG. 16, and the number of light-emitting periods is increased one by one on left or right side of the CSF6D in the center in the opposite direction to that shown in FIG. 5. The center shifts in the opposite directions in FIG. 5 and FIG. 16. Accordingly, switching the two light-emitting patterns for each field as shown in FIG. 17 cancels the shift of the center of emission in time. Thus, with a structure having an odd number of discharge sustain periods with the same relative luminance level, it is possible to form a plurality of light-emitting patterns and switch the patterns so that the shift of the center of emission can be canceled in time, which reduces occurrence of the pseudo contouring of moving picture.

Since its operation is the same as that of the first preferred embodiment in other respects, it is not fully described here again.

Sixth Preferred Embodiment

Figure 18:
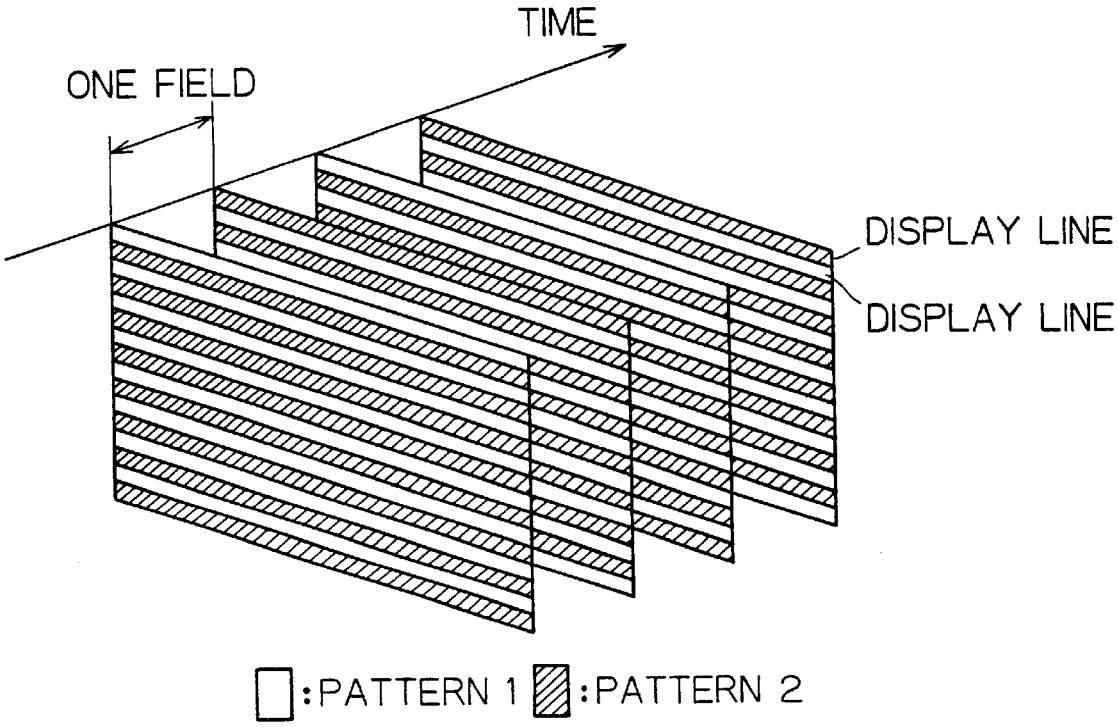
FIG. 18 is a diagram showing switching of light-emitting patterns in a sixth preferred embodiment of the present invention.

Although the fifth preferred embodiment above has shown a method in which the light emitting patterns are switched for each field to cancel the shift of the center of emission, the light-emitting patterns may be switched for each line and for each field as shown in FIG. 18 to cancel the shift of the center of emission in space and in time, with the same effects.

Seventh Preferred Embodiment

Figure 19:
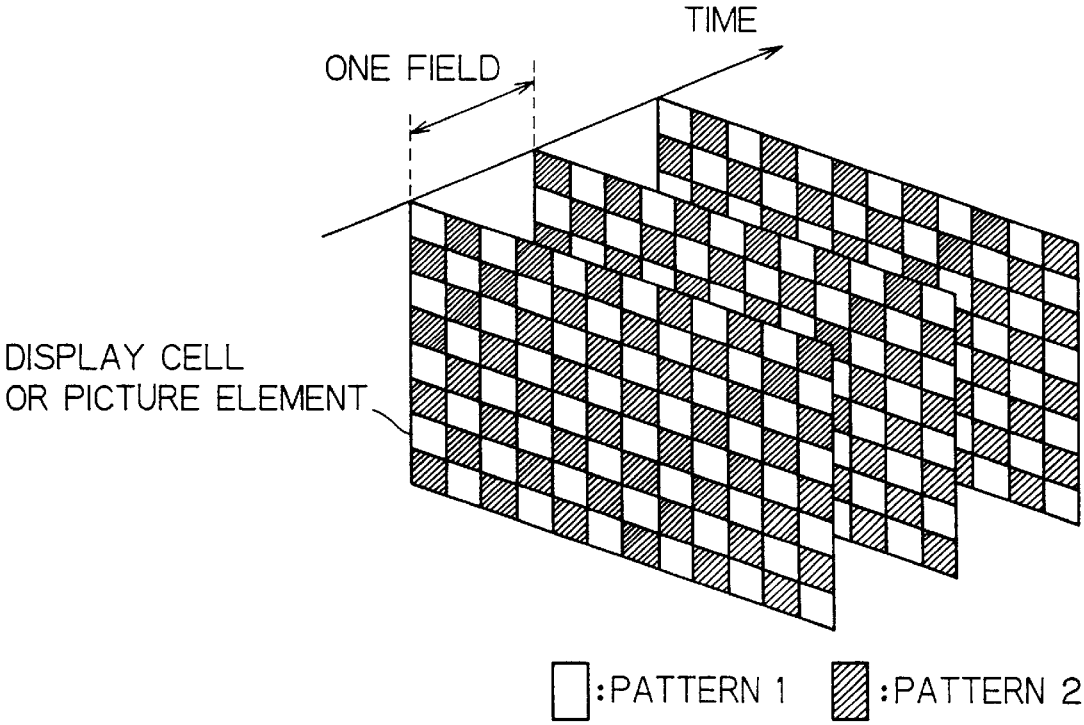
FIG. 19 is a diagram showing switching of light-emitting patterns in a seventh preferred embodiment of the present invention.

Further, although the sixth preferred embodiment above has shown a method in which the light-emitting patterns are switched for each line and for each field, the light-emitting patterns may be switched, as shown in FIG. 19, for each pixel (a set of three, red, green, and blue light-emitting cells) or for each light-emitting cell, and for each field, providing the same effects.

Eighth Preferred Embodiment

Figure 20:
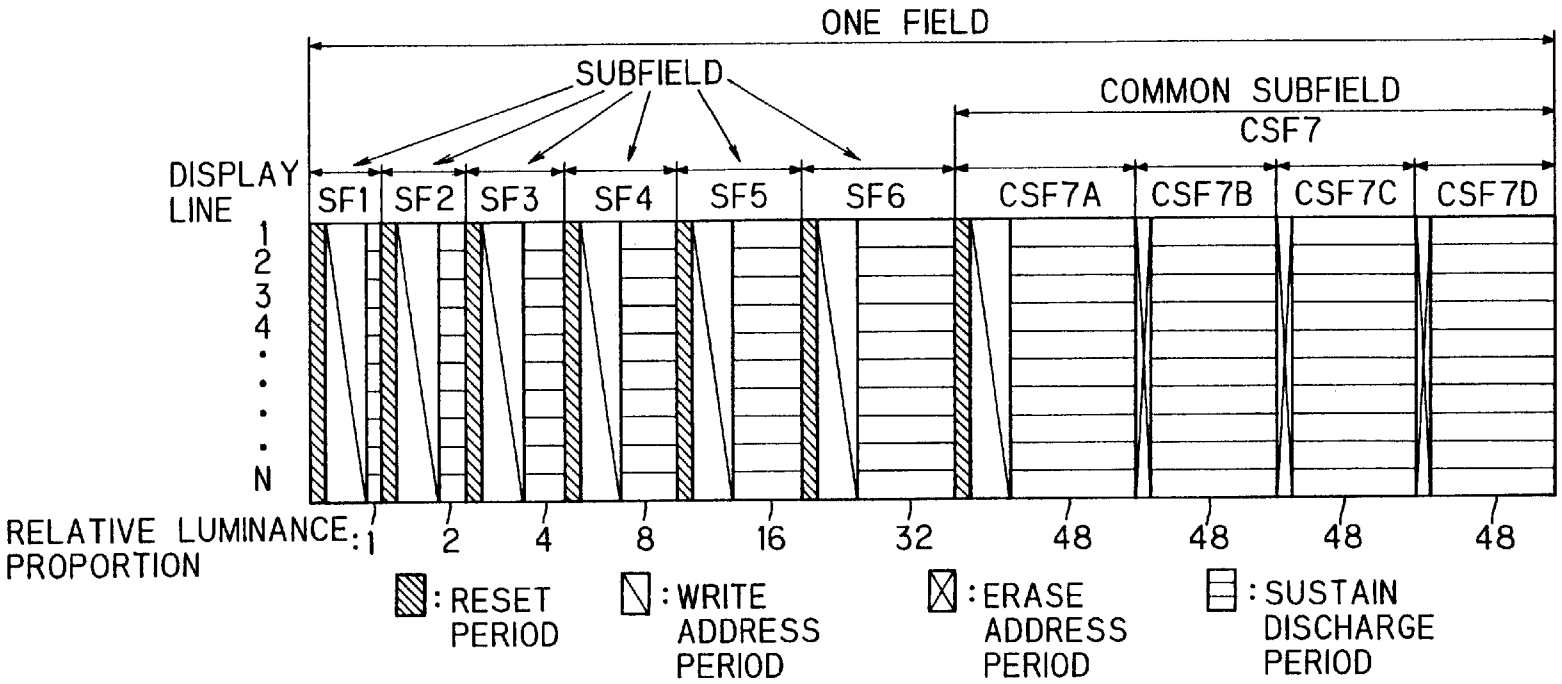
FIG. 20 is a diagram showing the structure of one field in an eighth preferred embodiment of the present invention.

FIG. 20 is a diagram showing another structure of one field in the invention, where one field includes six subfields SF1 to SF6 and one common subfield CSF7, for example. The subfields SF1 to SF6 each include a reset period, a write address period, and a discharge sustain period. The respective discharge sustain periods are for relative luminance levels of 1:2:4:8:16:32. The common subfield CSF7 includes a reset period, four discharge sustain periods divided by three resting periods, one write address period, and three erase address periods. The divided discharge sustain periods each have the relative luminance level 48, which is not a power of 2. The sets of the discharge sustain periods divided by the resting periods and the corresponding write address period or erase address periods are sequentially referred to as CSF7A, CSF7B, CSF7C, and CSF7D. The plasma display panel can display luminance of 256 tones with combinations of presence/absence of emission in these discharge sustain periods.

Figure 21:
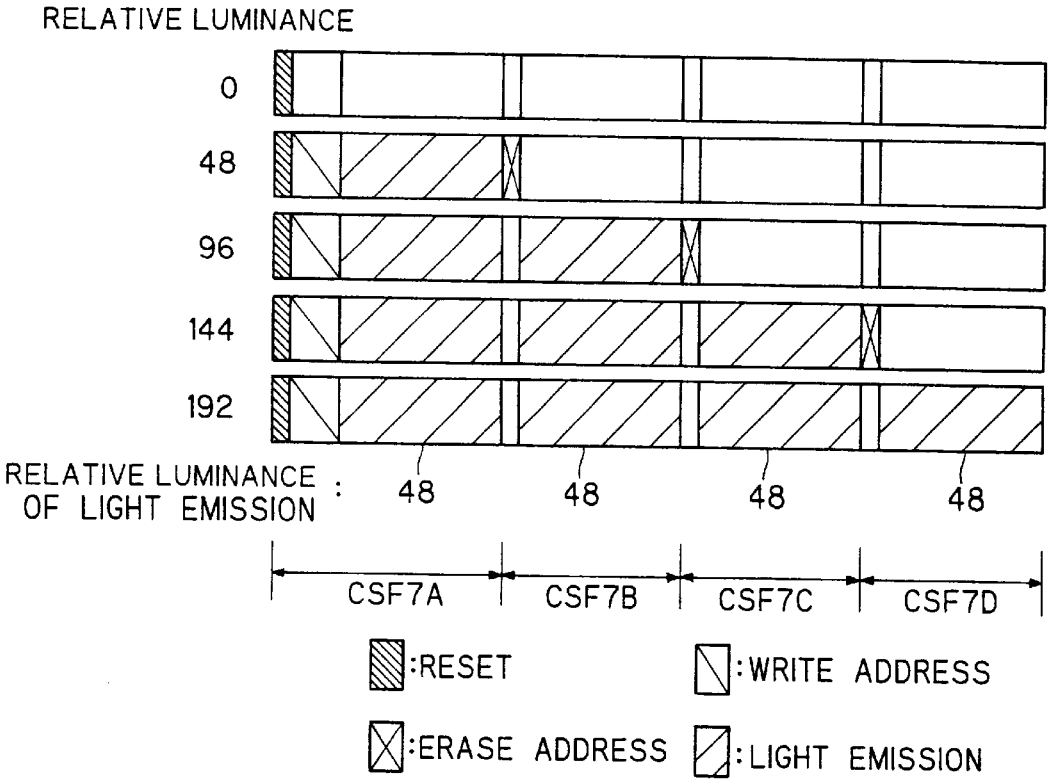
FIG. 21 is a diagram showing light-emitting pattern and operating timing in the eighth preferred embodiment of the present invention.

The operation in the common subfield CSF7 will be described more fully referring to FIG. 21. FIG. 21 shows write address and erase address operations and the light-emitting pattern with respect to the relative luminance levels that can be displayed in the common subfield CSF7. When the common subfield CSF7 is for the relative luminance level zero, only the reset operation at the beginning of the subfield is performed. With the relative luminance level 48, write address processing is performed in CSF7A and light is emitted in the discharge sustain period in CSF7A, and erasing is selectively performed in the erase address period in CSF7B to end the light emission. With the relative luminance level 96, write address processing in CSF7A and erase address processing in CSF7C are performed and light is emitted in the discharge sustain periods in CSF7A and CSF7B. At this time, erasing operation is not performed in the erase address period of CSF7B. Next, with the relative luminance level 144, write address processing in CSF7A and erase address processing in CSF7D are performed and light is emitted in the discharge sustain periods in CSF7A to CSF7C. At this time, erase operation is not performed in the erase address periods of CSF7B and CSF7C. Similarly, with the relative luminance level 192, write address processing and erase address processing are performed by the timing shown in FIG. 21. In this case, reset operation is performed only once at the beginning of the common subfield CSF7 independently of the relative luminance level, which reduces the luminance in black display.

Figure 23:
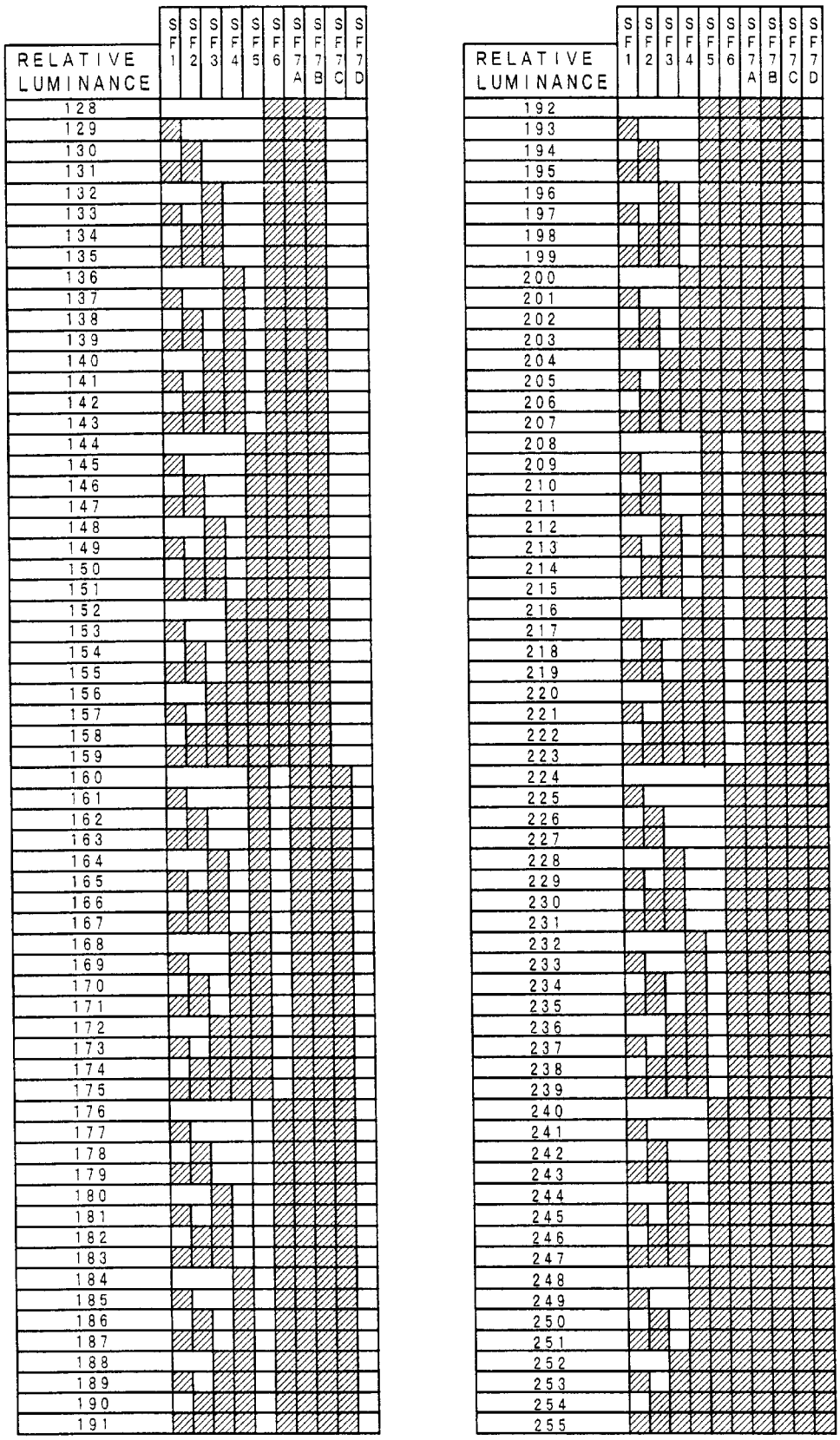

As shown in FIG. 20, one field includes usual subfields SF1 to SF6, as well as the common subfield CSF7. These subfields SF1 to SF6 operate to shift the center of emission in display of individual tones, or to make the light-emitting pattern uneven in time. However, as compared with a structure in which the discharge sustain periods have relative luminance levels of powers of 2, the structure in which each block in CSF7 has the relative luminance level of 48 eliminates such large shift of the center with a carry as will occur when the relative luminance level changes from 63 (emission of relative luminance levels 1, 2, 4, 8, 16, 32) to 64 (emission of the relative luminance level 64). FIG. 22 and FIG. 23 show an example of light-emitting pattern in the eighth preferred embodiment (the blacked parts show light emission). For example, in display of the relative luminance level 63, light is emitted in SF1, SF2, SF3, SF4, SF5 and SF6 (relative luminance levels 1, 2, 4, 8, 16, 32), and in display of relative luminance level 64, light is emitted in SF5 and SF7A (the relative luminance levels 16 and 48). Thus, a structure having discharge sustain periods with relative luminance proportioned without using powers of 2 reduces the shift of the center of luminance, thus lightening the problem of pseudo contouring of moving picture.

The operation of the electrodes in the eighth preferred embodiment is the same as that in the first preferred embodiment, and it is therefore not described here again.

Ninth Preferred Embodiment

FIG. 24 and FIG. 25 show another combination of light-emitting pattern of the eighth preferred embodiment (the blacked parts show light emission). As shown in the diagrams, with discharge sustain periods having relative luminance levels other than powers of 2, it is possible to form light-emitting patterns in which carries occur at different relative luminance levels. Accordingly, the light-emitting patterns can be switched for each field, or each line, or for each cell as shown in FIG. 17, FIG. 18, FIG. 19 to disperse the shift of the center of emission caused by carries in space or in time, thereby alleviating the pseudo contouring of moving picture.

Tenth Preferred Embodiment

Figure 26:
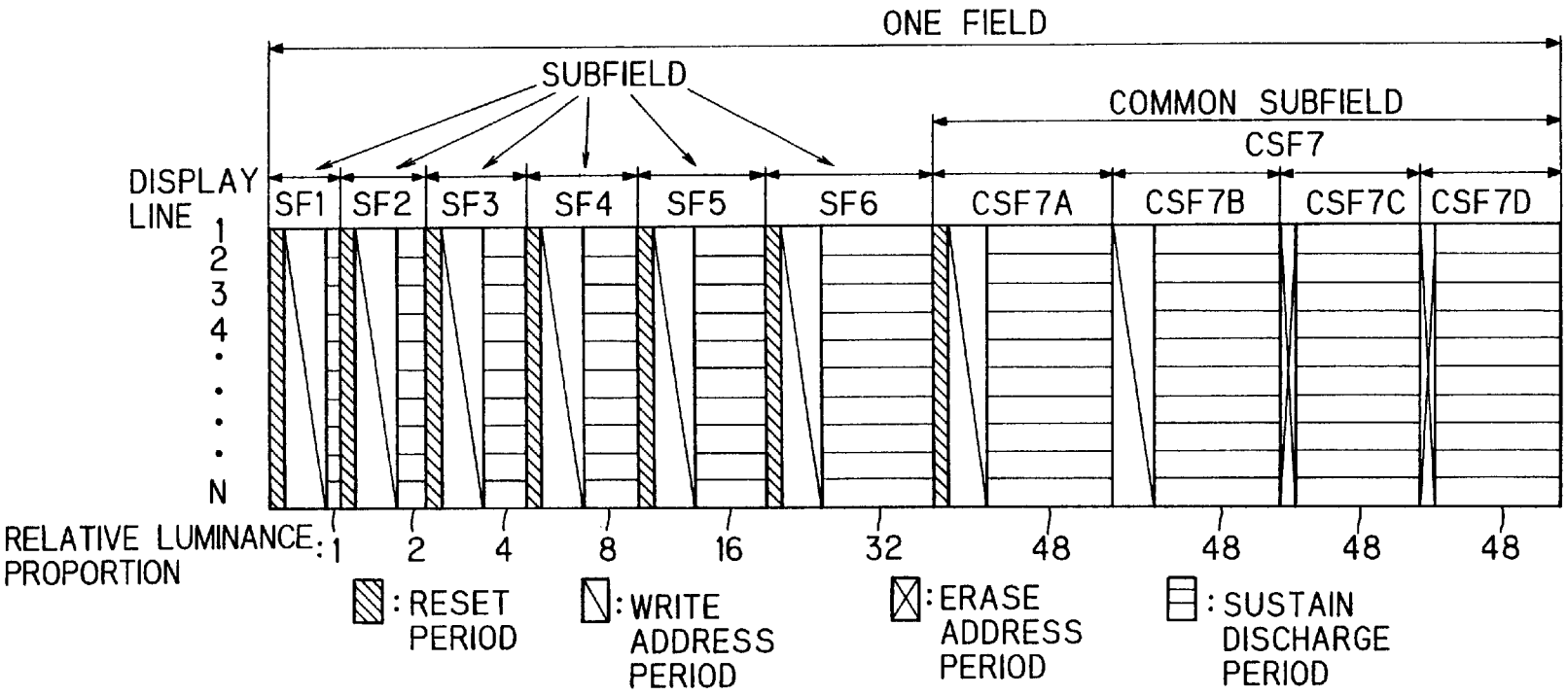
FIG. 26 is a diagram showing the structure of one field in a tenth preferred embodiment of the present invention.

FIG. 26 is a diagram showing another structure of one field of the present invention, where one field includes six subfields SF1 to SF6 and one common subfield CSF7, for example. The subfields SF1 to SF6 each include a reset period, a write address period, and a discharge sustain period. The respective discharge sustain periods have relative luminance levels of 1:2:4:8:16:32. The common subfield CSF7 includes a reset period, four discharge sustain periods divided by three resting periods, two write address periods and two erase address periods. The divided discharge sustain periods have the relative luminance level 48, not a power of 2. The combinations of the discharge sustain periods divided by the resting periods and the corresponding write address periods or erase address periods are sequentially referred to as CSF7A, CSF7B, CSF7C, CSF7D. The plasma display panel can display 256 tones of luminance with combinations of emission/no emission in the discharge sustain periods.

Figure 27:
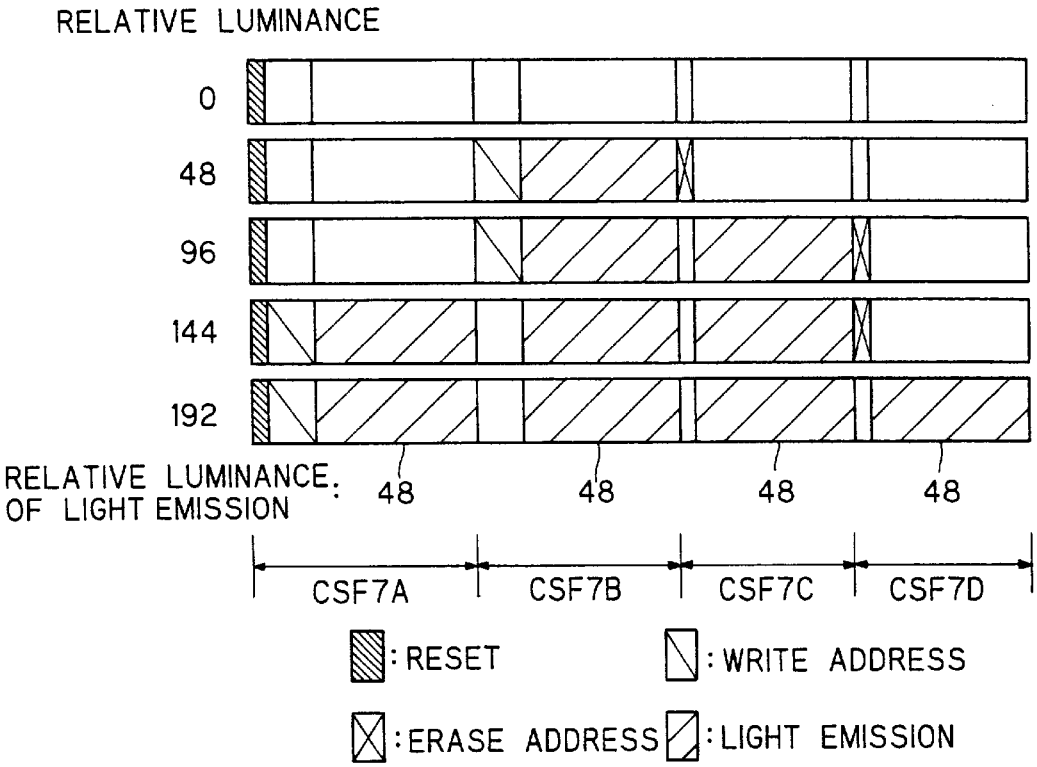
FIG. 27 is a diagram showing light-emitting pattern and operating timing in the tenth preferred embodiment of the present invention.
Figure 28:
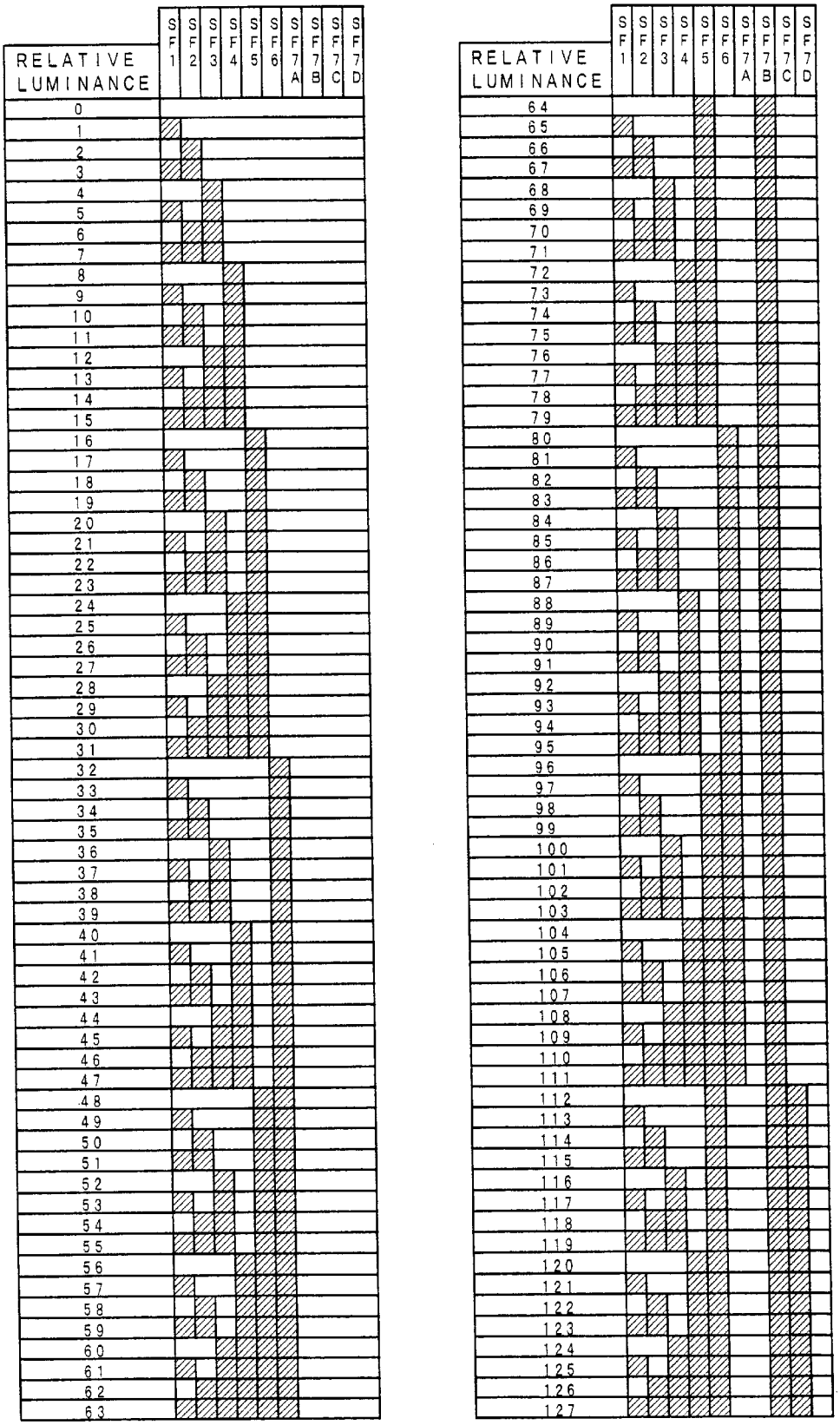
Figure 30:
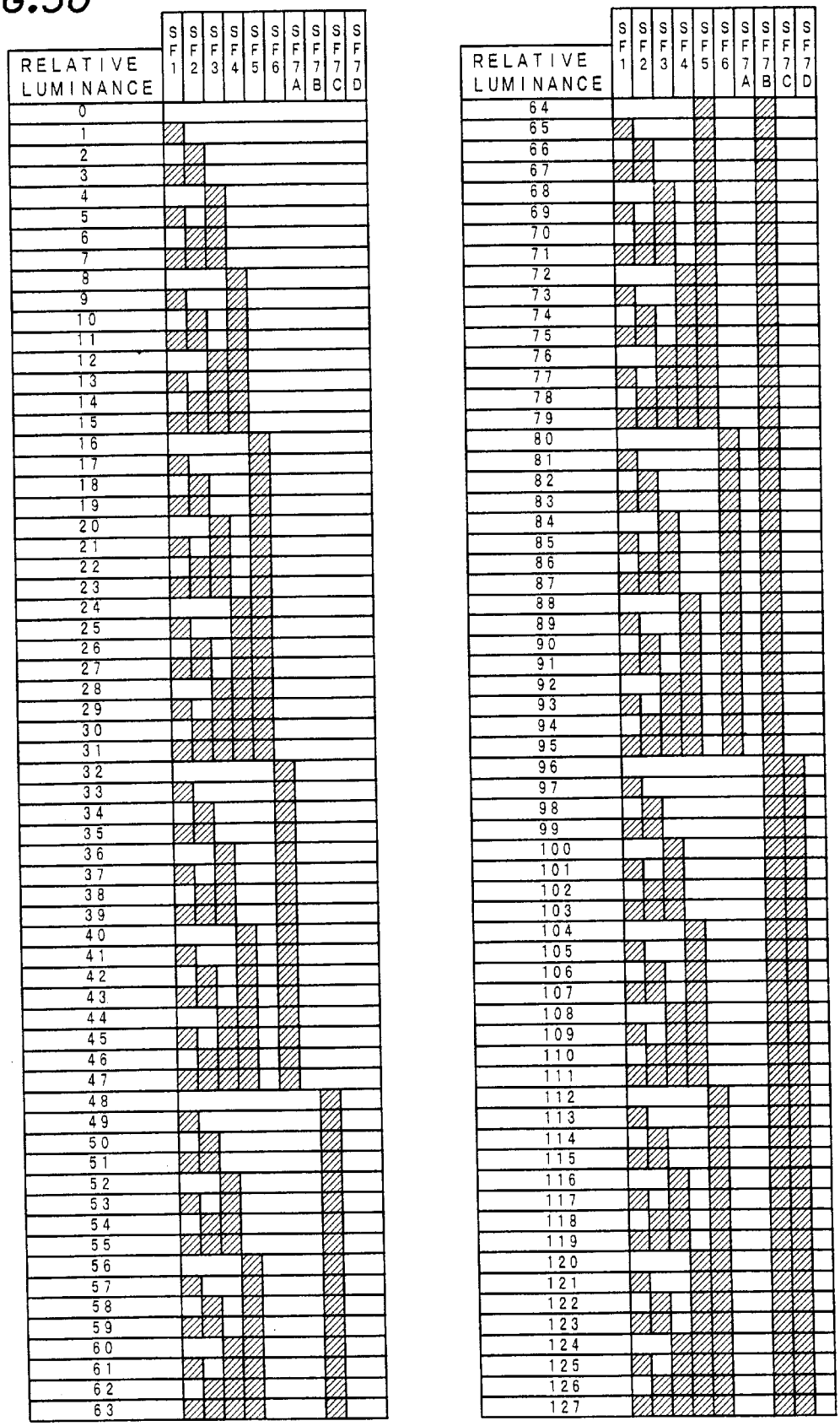

The operation in the common subfield CSF7 will more fully be described referring to FIG. 27. FIG. 27 shows write address and erase address operations and the light-emitting pattern with respect to the relative luminance levels that can be displayed in the common subfield CSF7. When the common subfield CSF7 is for the relative luminance level zero, only the reset operation at the beginning of the subfield is performed. With the relative luminance level 48, write address processing is performed in CSF7B, light is emitted in the discharge sustain period in CSF7B, and erasing is selectively performed in the erase address period in CSF7C to end the light emission. With the relative luminance level 96, write address processing in CSF7B and erase address processing in CSF7D are performed and light is emitted in the discharge sustain periods in CSF7B and CSF7C. At this time, erase operation is not performed in the erase address period of CSF7C. Next, with the relative luminance level 144, write address processing in CSF7A and erase address processing in CSF7D are performed and light is emitted in the discharge sustain periods in CSF7A to CSF7C. At this time, write and erase operations are not performed in the write address period in CSF7B and in the erase address period in CSF7C. With the relative luminance level 192, similarly, write address and erase address processings are performed by the timing shown in FIG. 27 and the number of the light-emitting periods is increased one by one on the left or right side of the CSF7B in the center. Since reset operation is performed only once at the beginning of the common subfield CSF7 independently of the relative luminance level, the luminance in black display can be reduced.

Further, since it is possible to develop the light-emitting pattern around CSF7B with write address and erase address processings, the center of emission in the common subfield CSF7 always exists around CSF7B. This reduces the unevenness in time in the light-emitting pattern for display of individual tones, thereby inhibiting the pseudo contouring of moving picture.

Further, like the ninth preferred embodiment, it is possible to form light-emitting patterns with different carries. FIG. 28, FIG. 29, and FIG. 30, FIG. 31 show a combination of two kinds of light-emitting patterns (the blacked parts show light emission). When the combination of the two kinds of light-emitting patterns is switched for each field, or each line, or for each pixel or each cell, as described in the ninth preferred embodiment, the shift of the center of emission caused by carries can be dispersed in space or in time, which reduces the occurrence of pseudo contouring of moving picture.

Eleventh Preferred Embodiment

Figure 32:
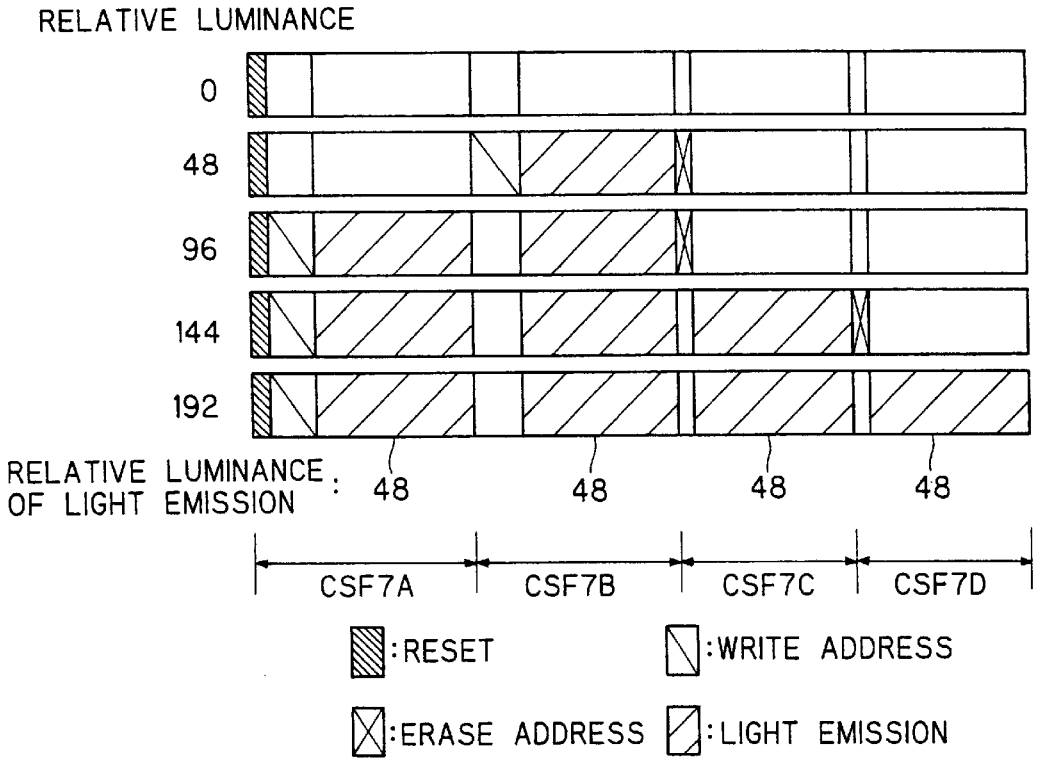
FIG. 32 shows light-emitting pattern and operating timing in an eleventh preferred embodiment of the present invention.

FIG. 32 is a diagram showing another light-emitting pattern in the common subfield CSF7 in the plasma display panel driving method shown in the tenth preferred embodiment. In FIG. 32, the number of light-emitting discharge sustain periods is increased in the order of CSF7B, CSF7A, CSF7C, CSF7D. Accordingly, the center of emission in the common subfield CSF7 always exists in the vicinity of CSF7B. However, since the light-emitting pattern shown in FIG. 32 is developed in a symmetrical relation on right and left sides with respect to the light-emitting pattern shown in FIG. 27, the center of emission is shifted in the opposite direction with varying relative luminance levels. As described in the tenth preferred embodiment, light-emitting patterns with different carries can be formed. FIGS. 33 and 34, and FIGS. 35 and 36 show a combination of two kinds of light-emitting patterns (the blacked parts show light emission).

Figure 37:
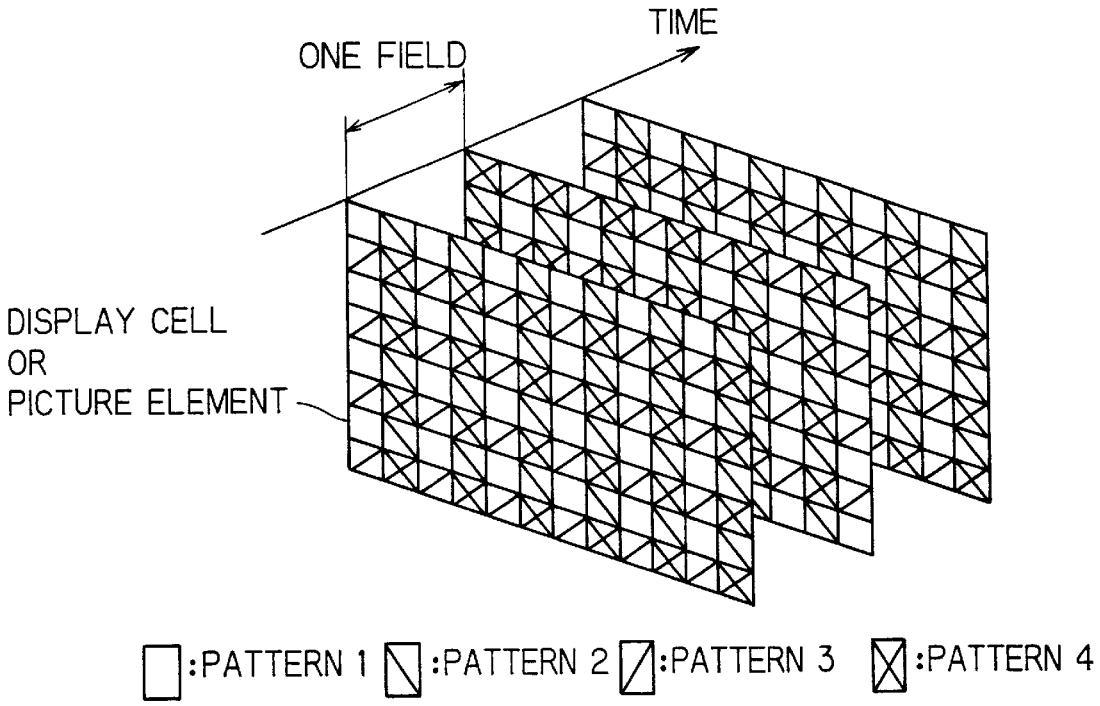
FIG. 37 shows switching of light-emitting patterns in the eleventh preferred embodiment of the present invention.
Figure 38:
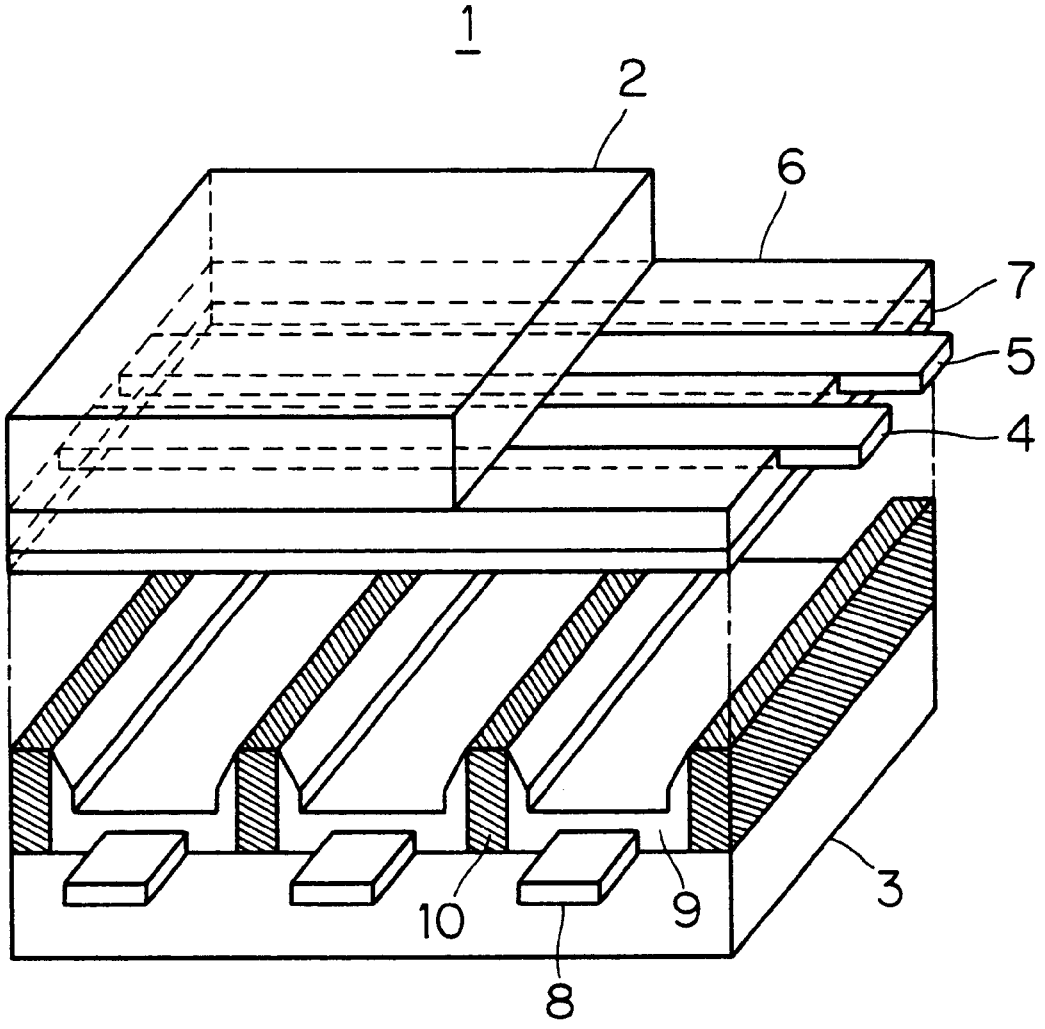
FIG. 38 is a diagram showing a surface-discharge type plasma display panel.
Figure 39:
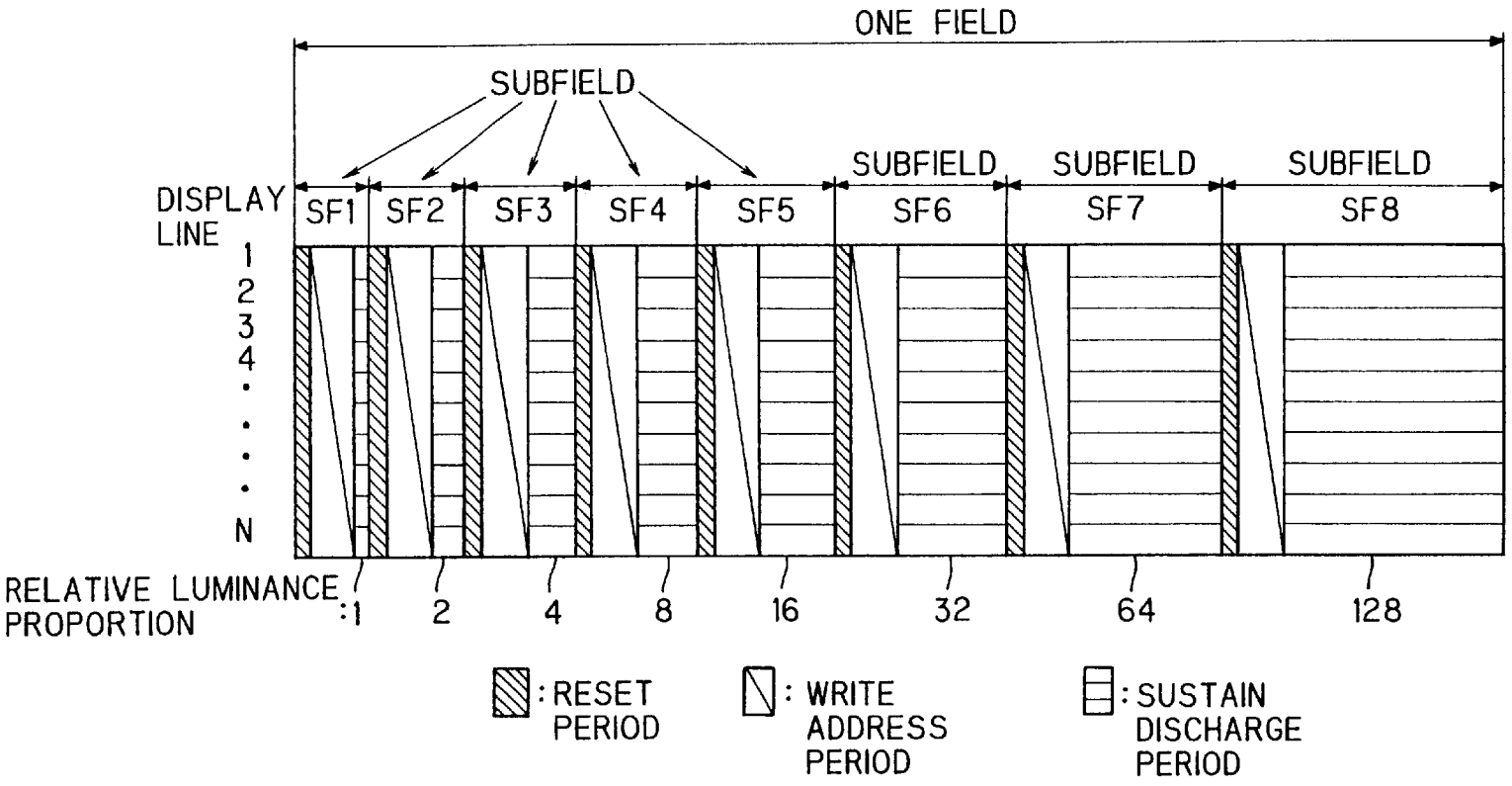
FIG. 39 is a diagram showing a conventional plasma display panel driving method.
Figure 40:
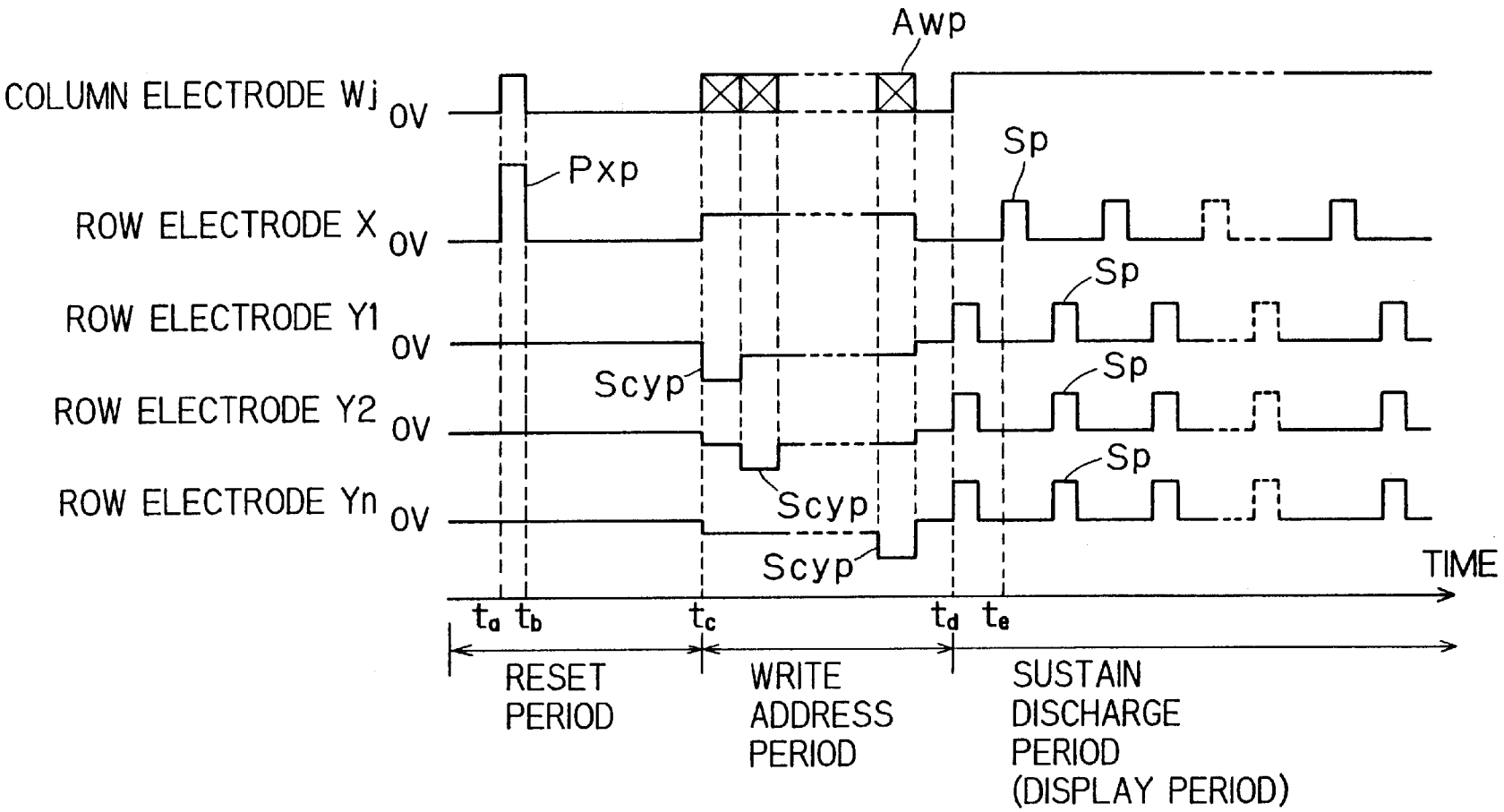
FIG. 40 is a diagram showing voltage waveforms in the conventional plasma display panel driving method.
Figure 41:
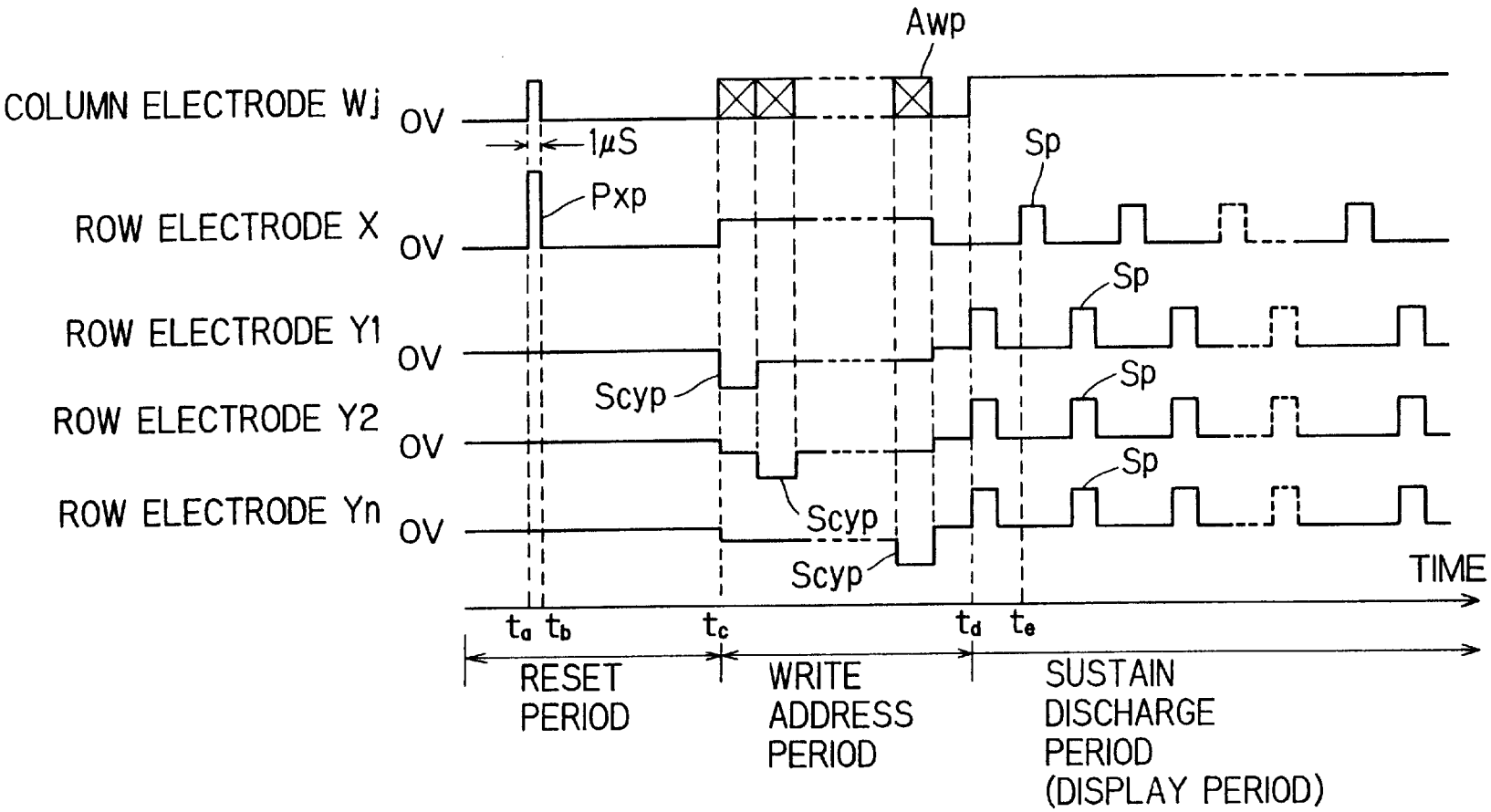
FIG. 41 is a diagram showing voltage waveforms in a conventional plasma display panel driving method.
Figure 42:
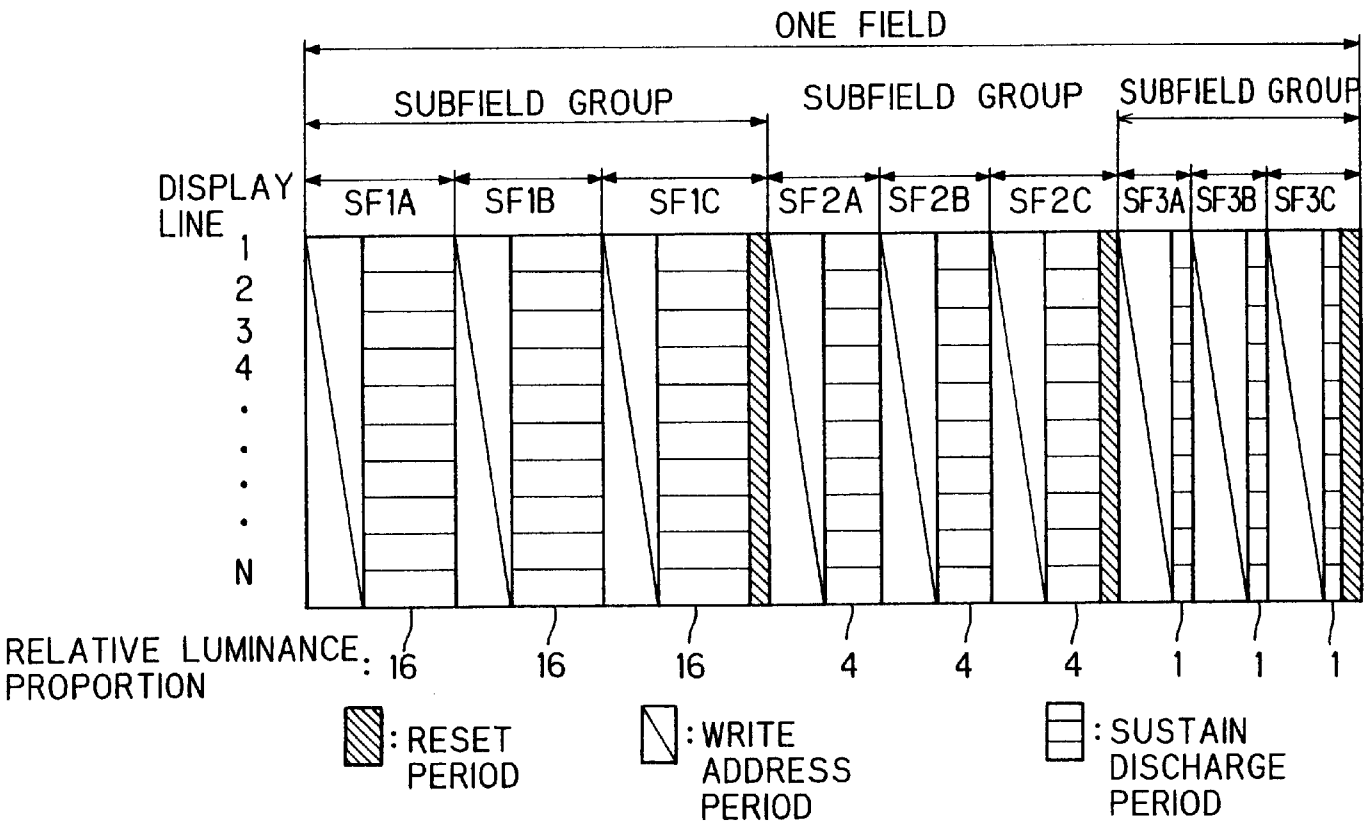
FIG. 42 is a diagram showing a conventional plasma display panel driving method.
Figure 43:
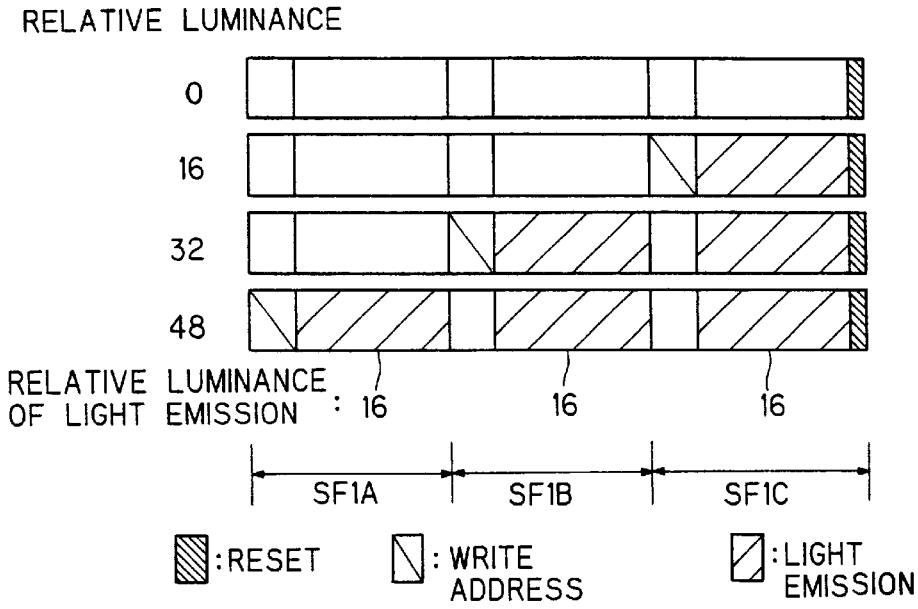
FIG. 43 is a diagram showing operation in the conventional plasma display panel driving method.
Figure 44:
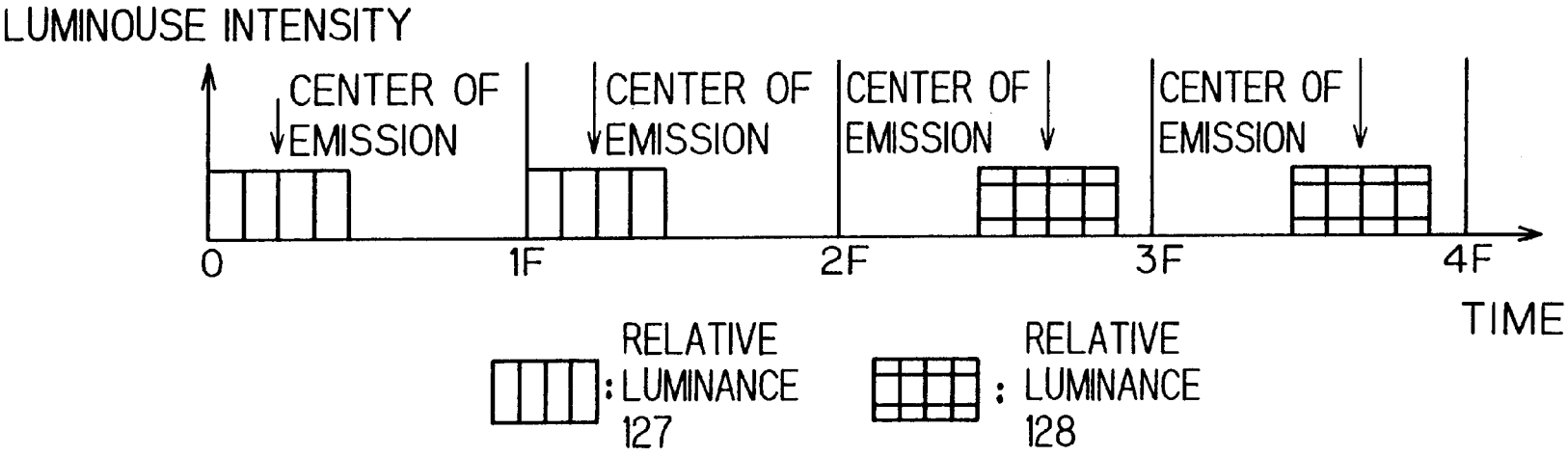
FIG. 44 is a diagram showing the center of emission in a conventional plasma display panel driving method.
Figure 45:
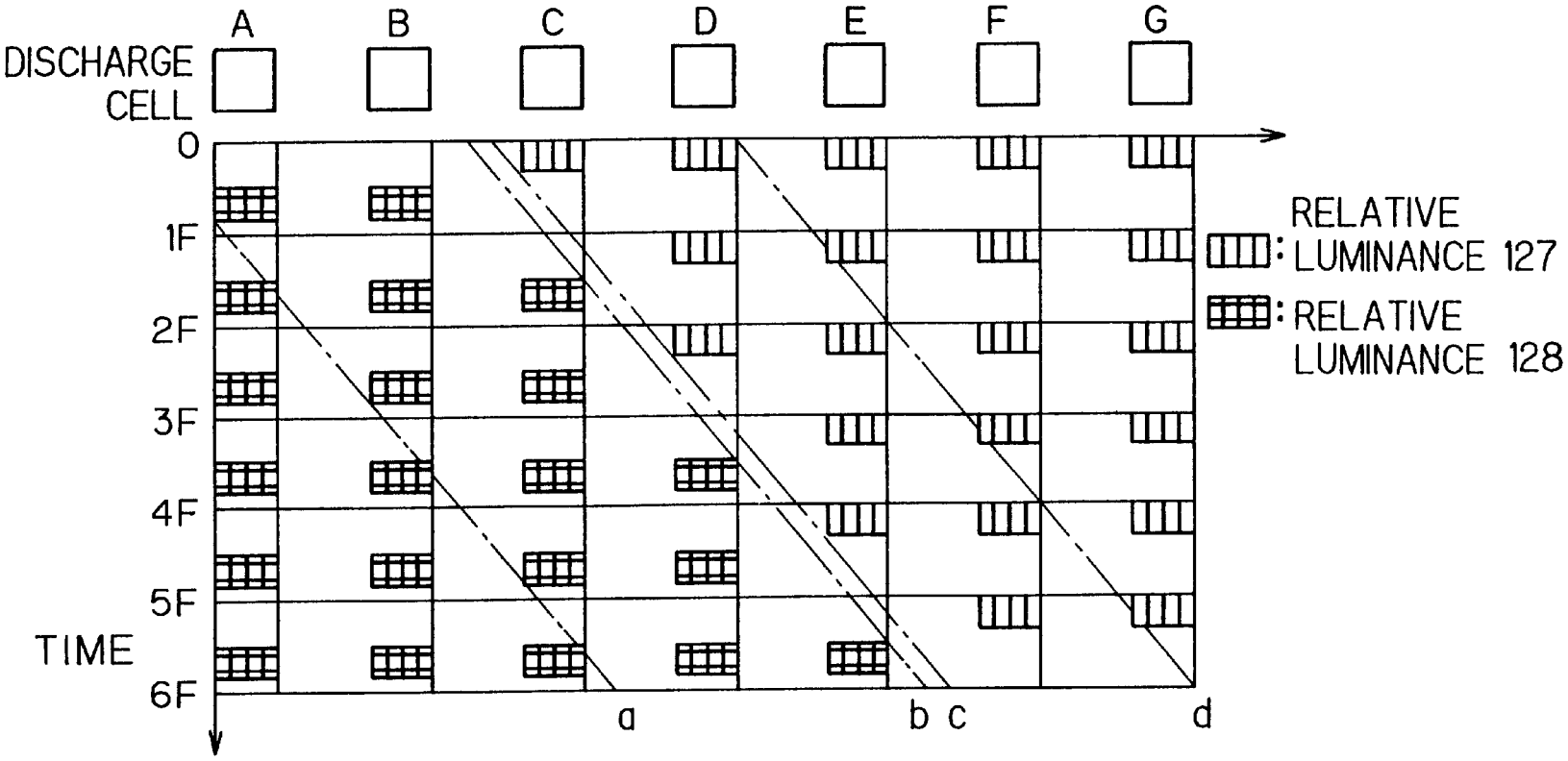
FIG. 45 is a diagram showing display of moving picture in the conventional plasma display panel driving method.
Figure 46:
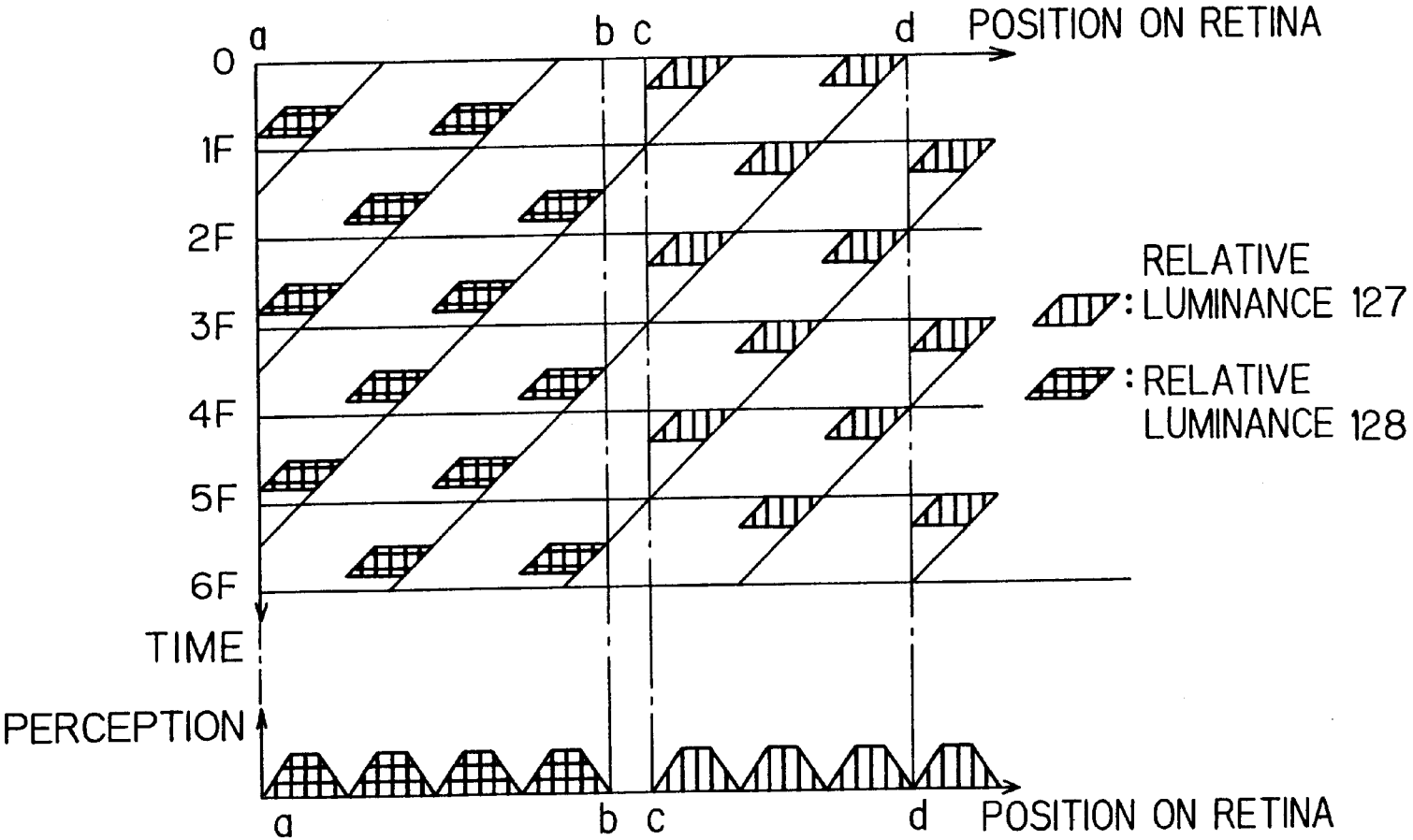
FIG. 46 is a diagram showing the mechanism of occurrence of pseudo contouring of moving picture in the conventional plasma display panel driving method.

The two light-emitting patterns can be switched for each field or line, or for each pixel or each cell as described in the ninth preferred embodiment, or the four kinds of light-emitting patterns including the combination of light-emitting patterns shown in FIG. 33 to FIG. 36 and the combination of light-emitting patterns shown in FIG. 28, FIG. 29, FIG. 30, FIG. 31 can be switched for each pixel or each cell as shown in FIG. 37 to cancel the shift of the center of emission in time or in space, so as to reduce the sensible pseudo contouring of moving picture.

While the invention has been described in detail, the foregoing description is in all aspects illustrative and not restrictive. It is understood that numerous other modifications and variations can be devised without departing from the scope of the invention.

We claim:

1. A method for driving a plasma display panel for image display comprising:

establishing an address period associated with a corresponding subfield of a field to activate a cell of the plasma display panel on the basis of a specified address and a sustained discharge period with discharge produced for a specified number of times;

assigning a light-emifting subfield group comprising two or more subfields, at least two of said subfields having sustained discharge periods having sustain pulses of substantially equal aggregate duration; and emitting light having an intensity level based on an aggregate duration of sustain pulses for the subfields forming said light-emitting subfield group.

2. The method according to claim 1, wherein the assigning step comprises assigning a plurality of light-emitting subfield groups with different temporal distributions of discharge periods according to a predetermined procedure.

3. The method according to claim 2, wherein said predetermined procedure comprises alternately switching between said plurality of light-emitting subfield groups for each field period.

4. The method according to claim 2, wherein said predetermined procedure comprises switching said plurality of light-emitting subfield groups for each line display portion on a screen of the plasma display panel.

5. The method according to claim 2, wherein said predetermined procedure comprises switching said plurality of light-emitting subfield groups for each pixel display portion on a screen of the plasma display panel.

6. The method according to claim 2, wherein said assigning step comprises assigning a plurality of light-emitting subfield groups including a first light-emitting subfield group and a second light-emitting subfield group, said first light-emitting subfield group having its center of emission shifted with a first time offset from a temporal center position in said common subfield, said second light-emitting subfield group having its center of emission shifted with a second time offset opposite to said first time offset from the temporal center position in said common subfield, and wherein said predetermined procedure comprises alternately switching between said first light-emitting subfield group and said second light-emitting subfield group for each field period.

7. The method according to claim 2, wherein said assigning step comprises assigning a plurality of light-emitting subfield groups including a first light-emitting subfield group and a second light-emitting subfield group, said first light-emitting subfield group having its center of emission shifted with a first time offset from a temporal center position in said common subfield, said second light-emitting subfield group having its center of emission shifted with a second time offset opposite to said first time offset from the temporal center position in said common subfield, and wherein said predetermined procedure comprises switching between said first light-emitting subfield group and said second light-emitting subfield group for each predetermined display unit on said predetermined screen.

8. The method according to claim 7, wherein said predetermined display unit comprises one line display portion on the plasma display panel.

9. The method according to claim 7, wherein said predetermined display unit comprises one pixel display portion on the plasma display panel.

10. The method according to claim 1, wherein said address period comprises:

a write address period for applying a write operation to a display cell selected by write addressing, and and erase address period for applying an erase operation to a non-display cell selected by erase addressing, and wherein with said light-emitting subfield group comprising first to nth ($n \geqq 2$) subfields, said light emitting step comprises the step of performing said write operation with said write address period set in said first subfield, performing said erase operation with said erase address period set in a subfield following said nth subfield and not included in said light-emitting subfield group, and causing light emission in the discharge sustain periods in said first to nth subfields.

11. The method of claim 1 wherein said sustained discharge periods having sustain pulses of substantially equal aggregate duration of at least two subfields emit the same perceived light intensity.

12. A method for driving a plasma display panel for image display comprising:

assigning an address period associated with a corresponding subfield of a field on the basis of a specified address and a sustained discharge period;

assigning a light-emitting subfield group comprising first to nth subfields having sustained discharge periods having sustain pulses of substantially eaual aggregate duration, wherein n is greater or equal to two;

establishing a write address period for selectively accumulating wall charge on a dielectric covering an electrode in a write-addressed display cell, during a write address period of said first subfield;

continuously emitting light for each following subfield within the subfield group until canceled; and establishing an erase address period for selectively erasing the wall charge accumulated on said dielectric in an erase-addressed non-display cell during an erase address period set in a subfield following said nth subfield, the erasing canceling the continuous emission of light during the subfield group.

13. The method according to claim 12, further comprising the step of setting a potential difference between a row electrode and a column electrode corresponding to a display cell in said write address period to be different from a potential difference between a row electrode and a column electrode corresponding to a non-display cell in said erase address period.

14. The method according to claim 13, comprising, assigning a light-emitting subfield group comprising successive first to nth ($n \geqq 2$) ones of said plurality of subfields according to a displayed luminance level, and performing a write operation with said write address period set in said first subfield to facilitate the emission of light from the display, performing an erase operation with said erase address period set in a subfield following said nth subfield and not included in said light-emifting subfield group, and causing light emission in said discharge sustain periods in said first to nth subfields.

15. The method of claim 12 wherein said sustained discharge periods having sustain pulses of substantially equal aggregate duration of at least two subfields emit the same perceived light intensity.

16. A method for driving a plasma display panel comprising:

establishing discharge periods associated with corresponding subfields of a field;

assigning a subfield group including a plurality of subfields within said subfield group, each of said subfields developing at least one sustain pulse having a sustained discharge period, at least two of said subfields having sustain pulses of substantially equal aggregate duration;

activating the identical discharge periods to be centered about a temporal center of the subfield group; and emitting light having an intensity level based on an aggregate discharge period for all of the subfields forming the assigned subfield group.

17. The method according to claim 16 wherein the assigning step includes establishing a first time offset from the temporal center, and wherein the assigning step includes assigning a second subfield group including a plurality of successive subfields with substantially identical discharge periods and establishing a second time offset approximately opposite from the first temporal time offset.

18. The method according to claim 17 further comprising the step of alternately switching between the subfield group and the second subfield group during successive field periods.

19. The method according to claim 17 wherein the emitting step includes associating the subfield group with a line of the plasma display unit for emitting light.

20. The method according to claim 17 wherein the emitting step includes associating the subfield group with a pixel of the plasma display unit for emitting light.

21. The method according to claim 16 wherein the assigning step comprises assigning the subfield group comprising successive first to nth subfields with substantially identical sustained discharge periods, wherein n is greater than or equal to two.

22. The method according to claim 21 further comprising the steps of:

establishing a write address period for selectively accumulating wall charge on a dielectric covering an electrode in a display cell during a write address period of said first subfield;

continuously emitting light from the display cell for each following subfield within the subfield group until canceled; and establishing an erase address period for selectively erasing the wall charge accumulated on said dielectric following said nth subfield, the erasing canceling the continuous emission of light during the subfield group.

23. The method of claim 16 wherein said sustained discharge periods having sustain pulses of substantially equal aggregate duration of at least two subfields emit the same perceived light intensity.

* * * * *